US012807350B2

(12) United States Patent
Takemura

(10) Patent No.: US 12,807,350 B2
(45) Date of Patent: Nov. 24, 2026

(54) TAPE CLAMPING METHOD, BINDING MACHINE, AND BINDING ARTICLE

(71) Applicant: Max Co., Ltd., Tokyo (JP)

(72) Inventor: Hajime Takemura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 15 days.

(21) Appl. No.: 18/647,705

(22) Filed: Apr. 26, 2024

(65) Prior Publication Data

US 2024/0359845 A1 Oct. 31, 2024

(30) Foreign Application Priority Data

Apr. 28, 2023 (JP) ..... 2023-075090

(51) Int. Cl.
*B65B 13/34* (2006.01)
*B65B 13/02* (2006.01)
*B65B 13/16* (2006.01)

(52) U.S. Cl.
CPC ..... *B65B 13/345* (2013.01); *B65B 13/025* (2013.01); *B65B 13/16* (2013.01)

(58) Field of Classification Search
CPC ..... B65B 13/345; B65B 13/025; B65B 13/16; B65B 13/12; B65B 13/187; B65B 13/24; B65B 13/18; B65B 51/05; B65B 65/02; A01G 9/128; A01G 17/085
See application file for complete search history.

(56) References Cited

U.S. PATENT DOCUMENTS

| | | | |
|---|---|---|---|
| 3,250,209 | A | 5/1966 | Gage et al. |
| 3,266,138 | A | 8/1966 | Tipper |
| 3,391,440 | A | 7/1968 | Harms |
| 2021/0053705 | A1 | 2/2021 | Taguchi et al. |
| 2021/0269208 | A1 | 9/2021 | Taguchi et al. |
| 2024/0199294 | A1 | 6/2024 | Taguchi et al. |
| 2025/0320079 | A1 | 10/2025 | Taguchi et al. |

FOREIGN PATENT DOCUMENTS

| | | | | |
|---|---|---|---|---|
| EP | 0336020 | A1 | 10/1989 | |
| EP | 3476210 | A1 | 5/2019 | |
| EP | 3825249 | A1 | 5/2021 | |
| JP | S58-125418 | A | 7/1983 | |
| JP | 2020-142860 | A | 9/2020 | |
| JP | 2021-031124 | A | 3/2021 | |
| WO | WO-2015162595 | A1 * | 10/2015 | ..... A01G 17/08 |

OTHER PUBLICATIONS

Sep. 23, 2025—(AU) Examination Report No. 1—App 2024202750.
Oct. 9, 2024—Extended Search Report—App 24172783.3.

* cited by examiner

*Primary Examiner* — Alex B Efta
*Assistant Examiner* — Alexander S Wright
(74) *Attorney, Agent, or Firm* — Banner & Witcoff, Ltd.

(57) ABSTRACT

A tape clamping method is used for clamping a band-shaped tape surrounding an object to be bound with a staple. The method includes: overlapping a first end that is one end of the tape and a second end that is another end of the tape; and clamping the tape by deforming the staple in a manner of clamping an overlapped part of the first end and the second end from an outer side of at least one of a pair of side edges of the tape.

8 Claims, 58 Drawing Sheets

TAPE CLAMPING METHOD, BINDING MACHINE, AND BINDING ARTICLE

CROSS-REFERENCE TO RELATED APPLICATIONS

This application is based on and claims priority under 35 USC § 119 from Japanese Patent Application No. 2023-075090 filed on Apr. 28, 2023, the contents of which are incorporated herein by reference.

TECHNICAL FIELD

The present embodiment relates to a tape clamping method, a binding machine, and a binding article.

BACKGROUND ART

In the related art, a binding machine for an induced binding operation is used in a binding operation of agricultural products, electric wires, and the like. For example, Patent Literature 1 discloses a binding machine that wraps a tape held by a holder around an object to be bound and ties the tape.

CITATION LIST

Patent Literature

Patent Literature 1: JP2021-031124A

SUMMARY OF INVENTION

In a technique disclosed in Patent Literature 1, when one end and the other end of the tape surrounding the object to be bound are fixed so as not to separate from each other, the ends of the tape are fixed to each other by piercing the tape with a staple. At this time, it is found that the tape may be broken from a hole through which the staple is pierced according to studies of the present inventors. When the tape is broken, a binding of bound objects such as a plurality of electric wires bound together may be loosened.

The present disclosure is made in view of the above problem, and an object thereof is to provide a binding machine that can prevent breakage of a tape.

An aspect of the present disclosure provides a tape clamping method for clamping a band-shaped tape surrounding an object to be bound with a staple. The method includes: overlapping a first end that is one end of the tape and a second end that is another end of the tape; and clamping the tape by deforming the staple in a manner of clamping an overlapped part of the first end and the second end from an outer side of at least one of a pair of side edges of the tape.

The present disclosure provides a binding machine that can prevent breakage of a tape.

DESCRIPTION OF EMBODIMENTS

Figure 1:
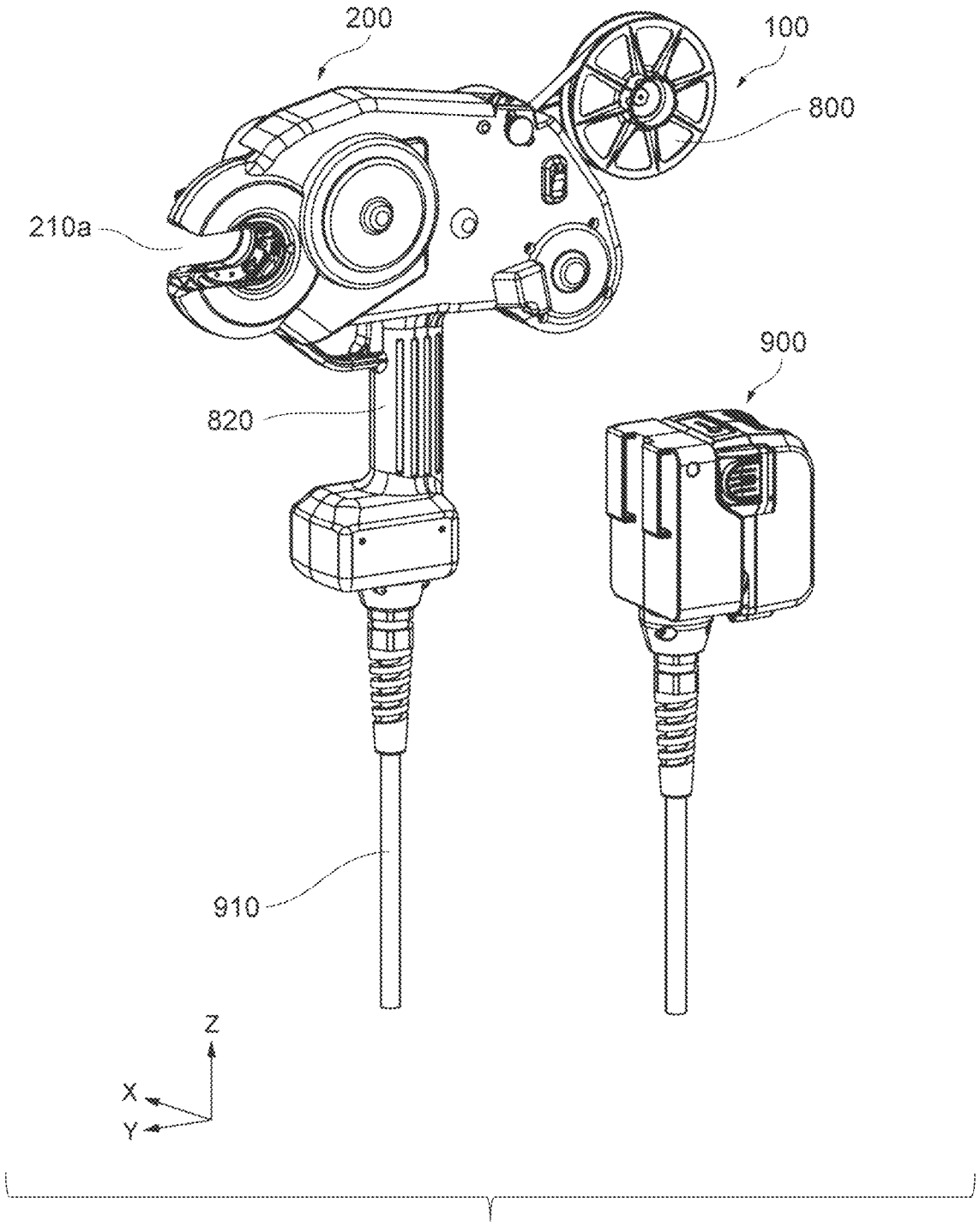
FIG. 1 is an overall perspective view of a binding machine 100 according to an embodiment.

Hereinafter, an embodiment will be described with reference to the accompanying drawings. To facilitate understanding of the description, the same elements in the drawings are denoted by the same reference numerals as much as possible, and redundant description will be omitted.

Hereinafter, a configuration of a binding machine 100 according to the embodiment of the present disclosure will be described. In the drawings, an X axis, a Y axis, and a Z axis may be illustrated. The X axis, the Y axis, and the Z axis constitute a right-handed three-dimensional orthogonal coordinate system. Hereinafter, an arrow direction of the X axis is referred to as a +X direction, and a direction opposite to the arrow is referred to as a −X direction. The same applies to the other axes. A +Z direction and a −Z direction may be referred to as an "upper side" and an "upward direction" and a "lower side" and a "downward direction", respectively. A plane orthogonal to each of the X axis, the Y axis, and the Z axis may be referred to as a YZ plane, a ZX plane, and an XY plane. These directions and the like are used for convenience in describing relative positional relationships. Accordingly, these directions and the like do not define absolute positional relationships.

Hereinafter, in the binding machine 100 according to the present embodiment, a band-shaped tape is described as an example of a binding article (which may be referred to as a "binding material") used for binding an object to be bound. The binding machine 100 according to the present embodiment is applicable to binding with a stretchable tape.

FIG. 1 is an overall perspective view of the binding machine 100 according to the embodiment of the present disclosure. As illustrated in FIG. 1, the binding machine 100 includes a binding machine body 200 and a tape reel 800. As illustrated in FIG. 1, the binding machine 100 further includes a battery 900, and the binding machine body 200 and the battery 900 are connected via a power cord 910. The binding machine body 200 includes the tape reel 800, an opening 210a, and a handle 820. The binding machine 100 supplies electric power from the battery 900 to the binding machine body 200 via the power cord 910, and surrounds and binds an object to be bound (not illustrated) inserted into the opening 210*a* with a tape 70 drawn out from the tape reel 800.

Figure 2A:
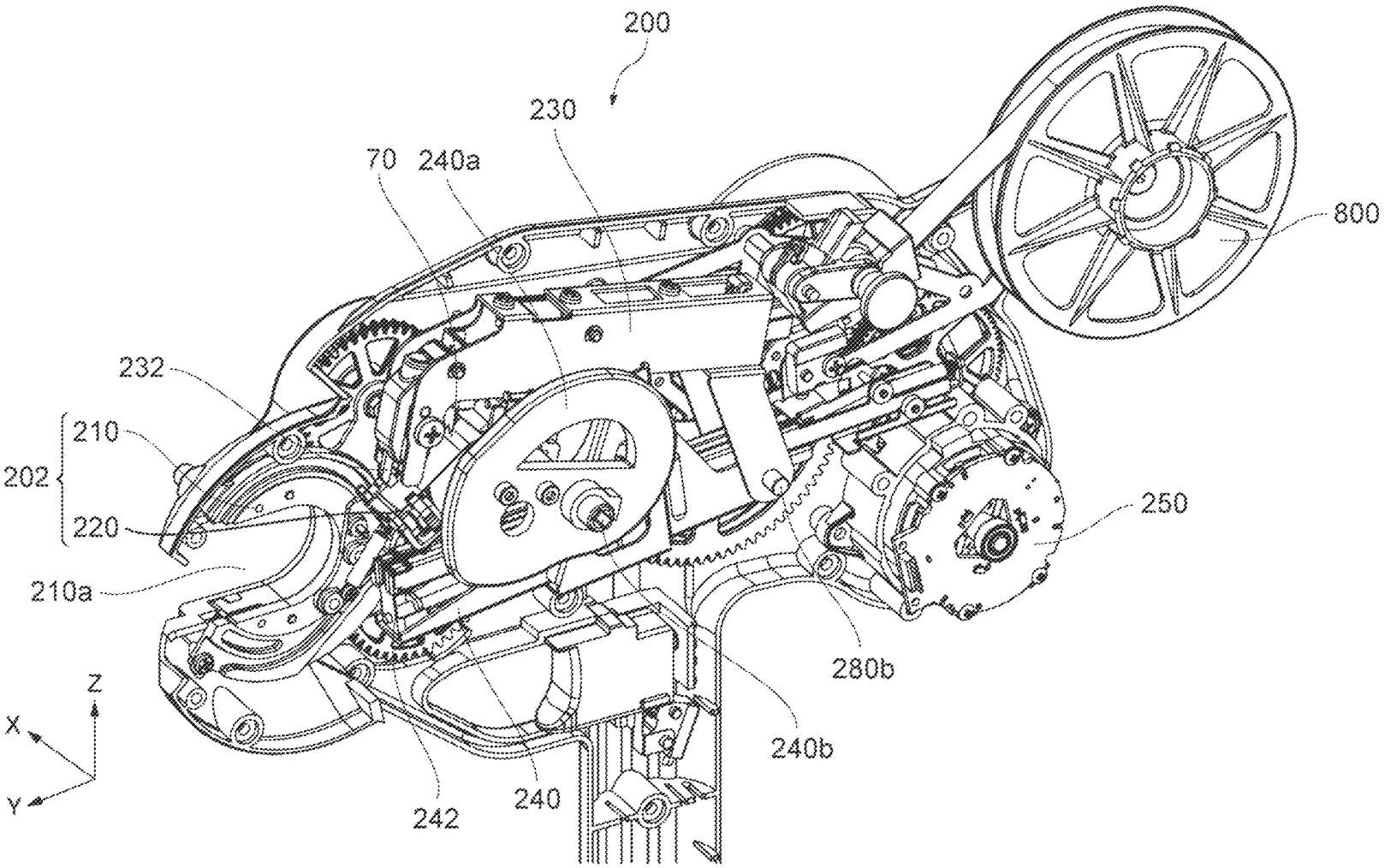
FIG. 2A is a perspective view illustrating an inside of a binding machine body 200 according to the present embodiment.
Figure 2B:
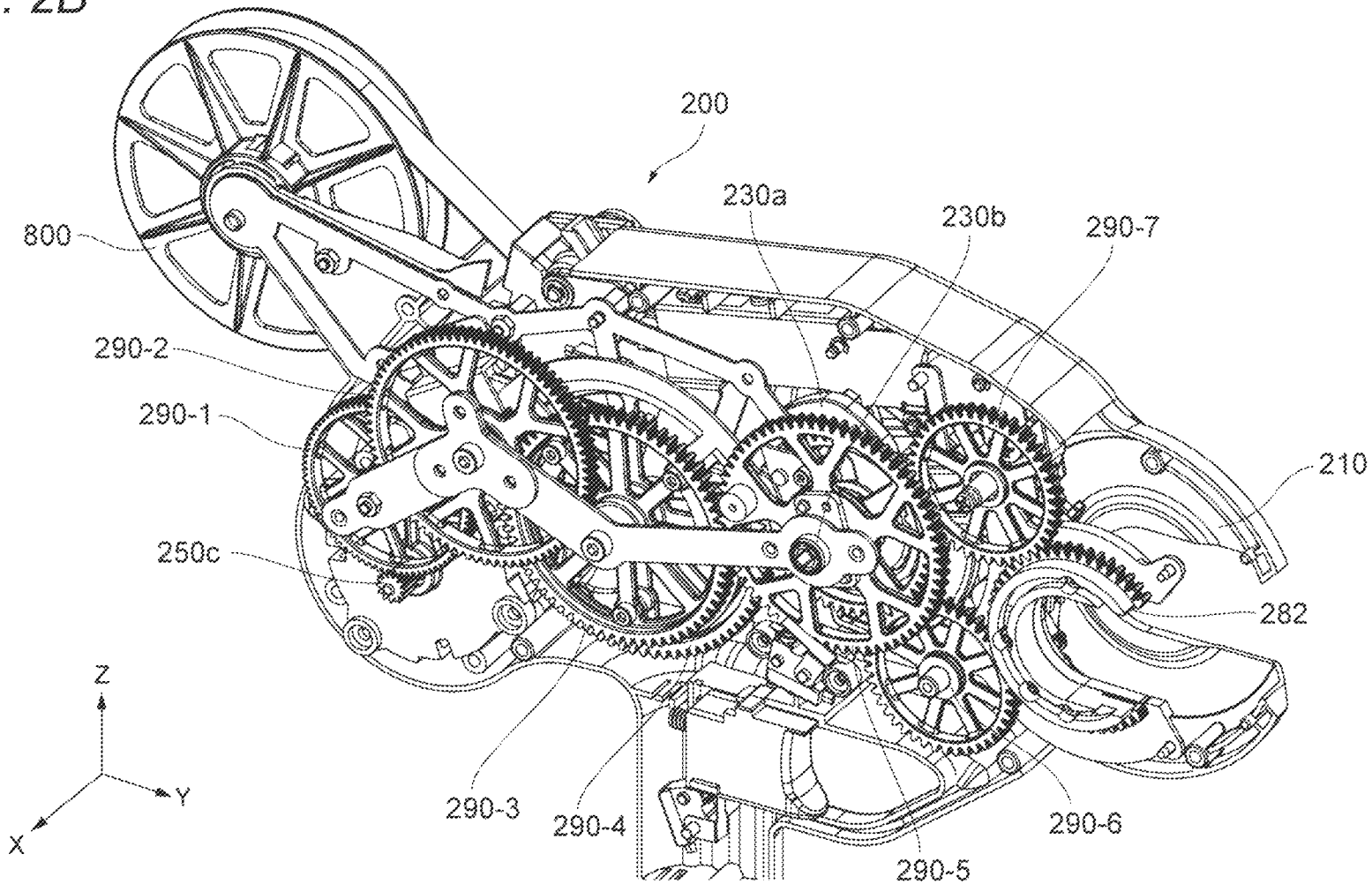
FIG. 2B is a perspective view illustrating an inside of the binding machine body 200 according to the present embodiment.
Figure 3:
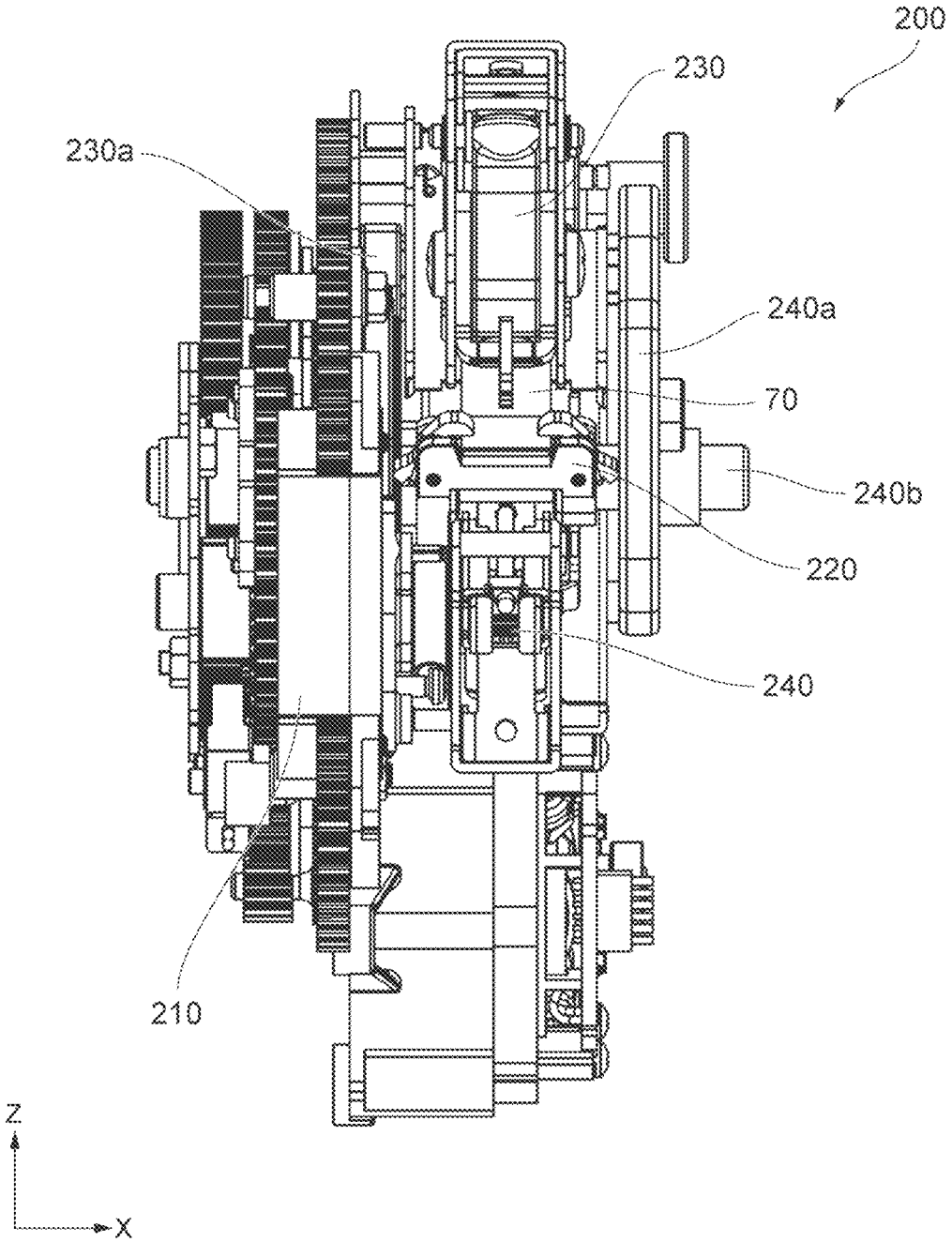
FIG. 3 illustrates the binding machine body 200 according to the present embodiment viewed from a front side in a Y direction.

Hereinafter, the binding machine body 200 will be described with reference to FIGS. 2A to 3. FIG. 2A is a perspective view illustrating an inside of the binding machine body 200 from which a first case of a case thereof on a −X side (left side in an X direction in FIG. 1) is removed. FIG. 2B is a perspective view illustrating an inside of the binding machine body 200 from which a second case of the case thereof on a +X side (right side in the X direction in FIG. 1) is removed. FIG. 3 is a front view (viewed from a front side in a Y direction in FIG. 1) of the binding machine body 200 in a state in which the first case and the second case are removed.

As illustrated in FIG. 2A, the binding machine body 200 includes a binding material feeder 202 (also referred to as the tape feeder 202 in the present embodiment) including a rotator 210 and a tape holder 220 (in the present embodiment, the binding material holder 220), a clincher unit 230, a magazine unit 240, a motor 250, a magazine unit drive cam

240*a*, a magazine unit drive camshaft 240*b*, and an arm shaft 280*b*. FIG. 2A also illustrates the tape 70. As will be described in detail later, in the binding machine 100 according to the present embodiment, an object to be bound that is inserted into the opening 210*a* of the U-shaped rotator 210 of the binding machine body 200 is bound, in a state in which the tape 70 surrounding the object to be bound by the tape holder 220 is located between a crown (crown 52 to be described later) and a leg (at least one of a first leg 54*a* and a second leg 54*b* to be described later) of a staple (staple 50 to be described later) supplied from the magazine unit 240, by bending the staple 50 with a driver 242 of the magazine unit 240 and a clincher 232 of the clincher unit 230. Accordingly, in the present embodiment, the clincher unit 230 and the magazine unit 240 constitute a binding portion. As described above, in the present embodiment, the rotator 210 and the tape holder 220 constitute the binding material feeder 202.

As illustrated in FIG. 2B, on a side (+X direction in FIG. 2B) of the binding machine body 200 opposite to the side illustrated in FIG. 2A, a clincher unit drive cam 230*a*, a clincher unit drive camshaft 230*b*, a motor gear 250*c*, and a gear train 290 including a plurality of gears are provided. In the example illustrated in FIG. 2B, the gear train 290 includes a first gear 290-1, a second gear 290-2 to a seventh gear 290-7. When driving of the motor 250 is transmitted to a freely selected number of the gears 290-1 to 290-*n* (n is a natural number) constituting the gear train 290 via the motor gear 250*c*, configurations of the binding machine body 200 are driven. In the present embodiment, a driving force of one drive motor is transmitted by the gear train 290 to drive the rotator 210, the clincher unit 230, the magazine unit 240, and the like. The tape holder 220 also moves following the rotator 210. Accordingly, in the present embodiment, the binding material feeder 202 including the tape holder 220 and the rotator 210 and the binding portion including the clincher unit 230 and the magazine unit 240 are coordinated by being driven by a driving force of the motor 250, which is a freely selected drive motor.

As illustrated in FIG. 3, in the binding machine body 200, the clincher unit 230 and the magazine unit 240 are arranged side by side in this order in a Z direction, and the clincher unit 230 is arranged in the +Z direction of the magazine unit 240. The clincher unit drive cam 230*a* and the magazine unit drive cam 240*a* are arranged in opposite directions in the X direction relative to the clincher unit 230 and the magazine unit 240. The magazine unit drive cam 240*a* is arranged in the −X direction of the clincher unit 230 and the magazine unit 240, and the clincher unit drive cam 230*a* is arranged in the +X direction of the clincher unit 230 and the magazine unit 240. In the present embodiment, the clincher unit drive cam 230*a* and the magazine unit drive cam 240*a* rotate about the same rotation shaft. Accordingly, in the present embodiment, the clincher unit drive camshaft 230*b* and the magazine unit drive camshaft 240*b* are integrally formed, and hereinafter, the clincher unit drive camshaft 230*b* and the magazine unit drive camshaft 240*b* are collectively referred to as a drive camshaft 230*b*1.

Figure 4:
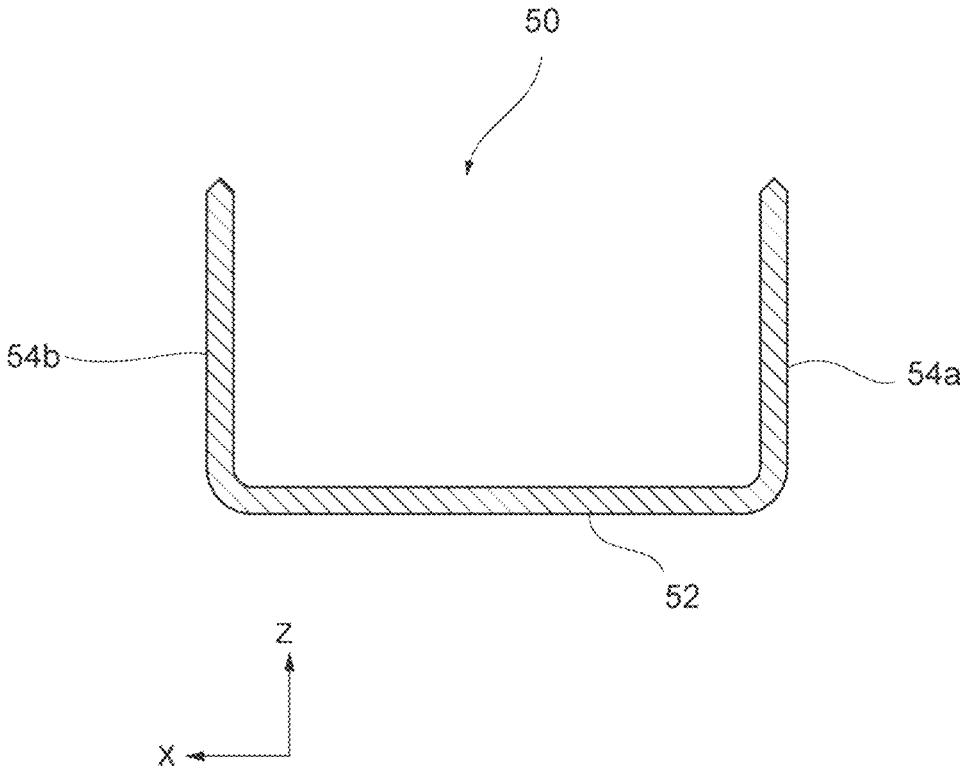
FIG. 4 is a schematic sectional view of a staple 50 before binding according to the present embodiment.

A configuration of the staple 50 used in the binding machine 100 according to the present embodiment will be described with reference to FIG. 4. FIG. 4 is a schematic sectional view of the staple 50 before binding according to the present embodiment. As illustrated in FIG.

4, the staple 50 includes the crown 52 and a pair of legs (first leg 54*a*, second leg 54*b*). In the binding machine 100 according to the present embodiment, binding of a binding material using the staple 50, which is supplied from the magazine unit 240, is performed by clamping the staple 50 by the driver 242 of the magazine unit 240 and the clincher 232 of the clincher unit 230 from the +Z direction and the −Z direction and bending the first leg 54*a* and the second leg 54*b* toward the crown 52.

Figure 5:
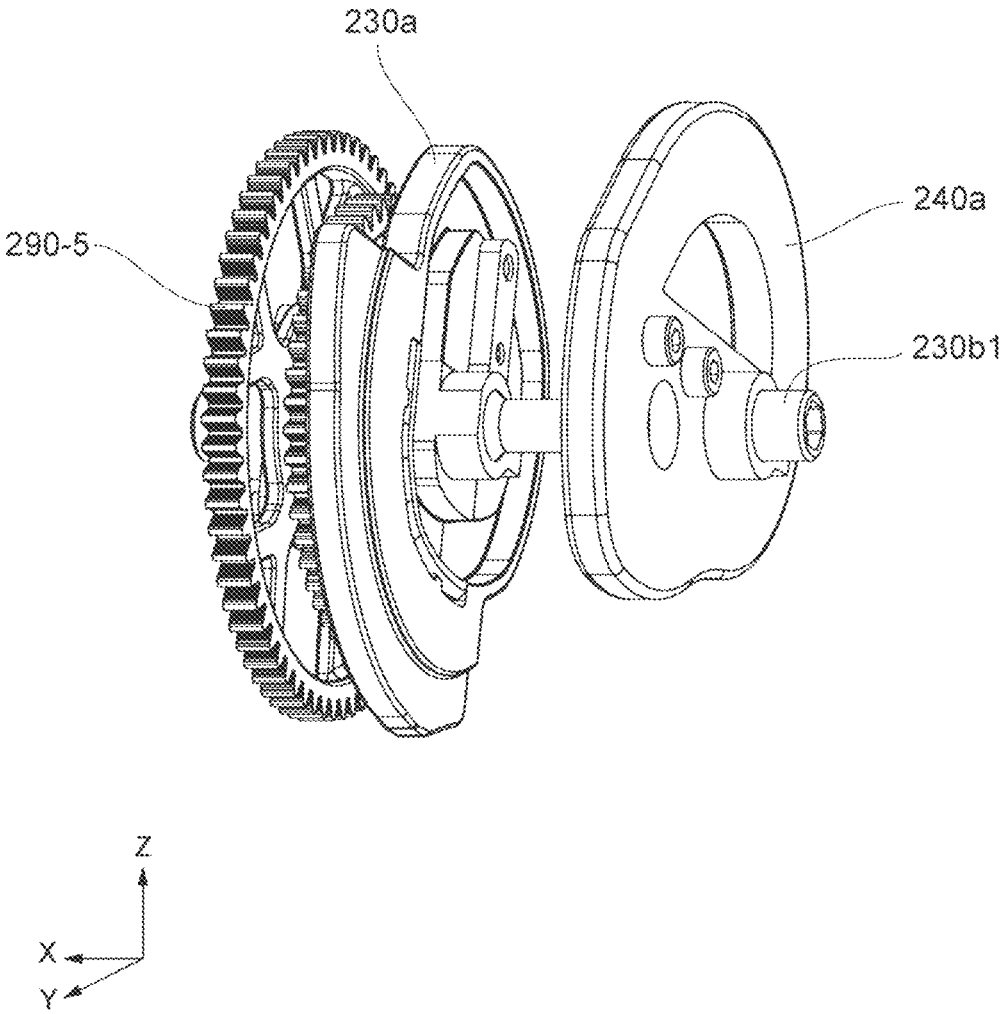
FIG. 5 is a perspective view illustrating a clincher unit drive cam 230*a*, a magazine unit drive cam 240*a*, and a drive camshaft 230*b*1 according to the present embodiment.

A relationship between the clincher unit drive cam 230*a* and the magazine unit drive cam 240*a* will be described with reference to FIG. 5. FIG. 5 is a perspective view illustrating the clincher unit drive cam 230*a*, the magazine unit drive cam 240*a*, and the drive camshaft 230*b*1. FIG. 5 also illustrates the fifth gear 290-5 that is a gear that transmits a driving force to the clincher unit drive cam 230*a* and the magazine unit drive cam 240*a*. As illustrated in FIG. 5, when the drive camshaft 230*b*1 is rotated by the driving force transmitted via the fifth gear 290-5, the clincher unit drive cam 230*a* and the magazine unit drive cam 240*a* are rotated.

Figure 6:
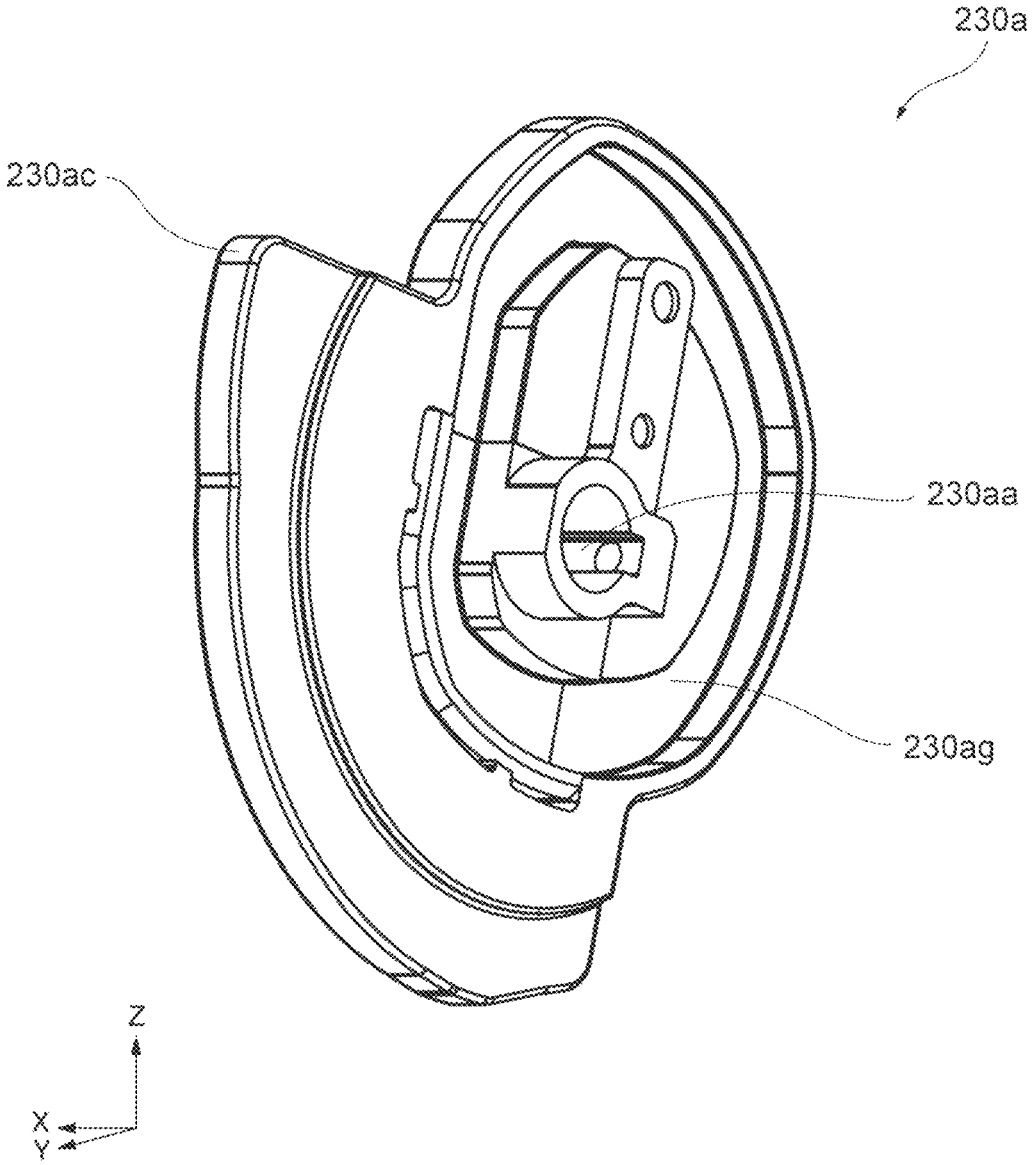
FIG. 6 is a perspective view of the clincher unit drive cam 230*a* according to the present embodiment.

The clincher unit drive cam 230a will be described with reference to FIG. 6. FIG. 6 is a perspective view of the clincher unit drive cam 230a. As illustrated in FIG. 6, the clincher unit drive cam 230*a* has an opening 230*aa* and a clincher unit drive cam groove 230*ag*. The drive camshaft 230*b*1 is inserted into the opening 230*aa*. The clincher unit 230 engages with the clincher unit drive cam groove 230*ag*, and the clincher unit drive cam groove 230*ag* is not concentric with the opening 230*aa*. Accordingly, a distance of the clincher unit drive cam groove 230*ag* from a rotation center shaft corresponding to a shaft in a vicinity of a center of the opening 230*aa* is different depending on a rotation angle. For this reason, a relative distance between the clincher unit 230 and other configurations such as the magazine unit 240 in the binding machine body 200 changes with rotation of the clincher unit drive cam 230*a*. Accordingly, an operation such as fixing the tape 70 is performed and the object to be bound is bound when the clincher unit 230 relatively approaches the magazine unit 240. As will be described later, an outer peripheral surface 230*ac* of the clincher unit drive cam 230*a* can restrict an operation of a tape holding releaser 310 so that the tape 70 can be held by the tape holder 220 and the tape 70 can be released.

Figure 7:
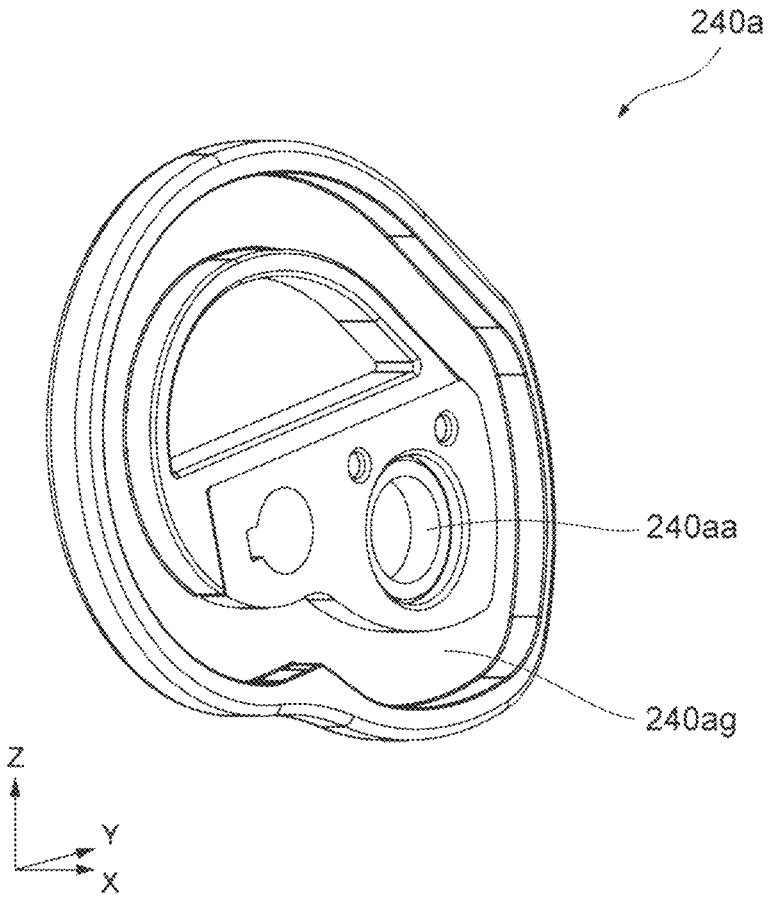
FIG. 7 is a perspective view of the magazine unit drive cam 240*a* according to the present embodiment.

The magazine unit drive cam 240*a* will be described with reference to FIG. 7. FIG. 7 is a perspective view of the magazine unit drive cam 240*a*. As illustrated in FIG. 7, the magazine unit drive cam 240*a* has an opening 240*aa* and a magazine unit drive cam groove 240*ag*. Similar to the clincher unit drive cam 230*a*, the drive camshaft 230*b* 1 is inserted into the opening 240*aa*. The magazine unit 240 is engaged with the magazine unit drive cam groove 240*ag*, a relative distance between the magazine unit 240 and the clincher unit 230 is changed with rotation of the magazine unit drive cam 240*a*, and binding of the object to be bound is performed.

Figure 8:
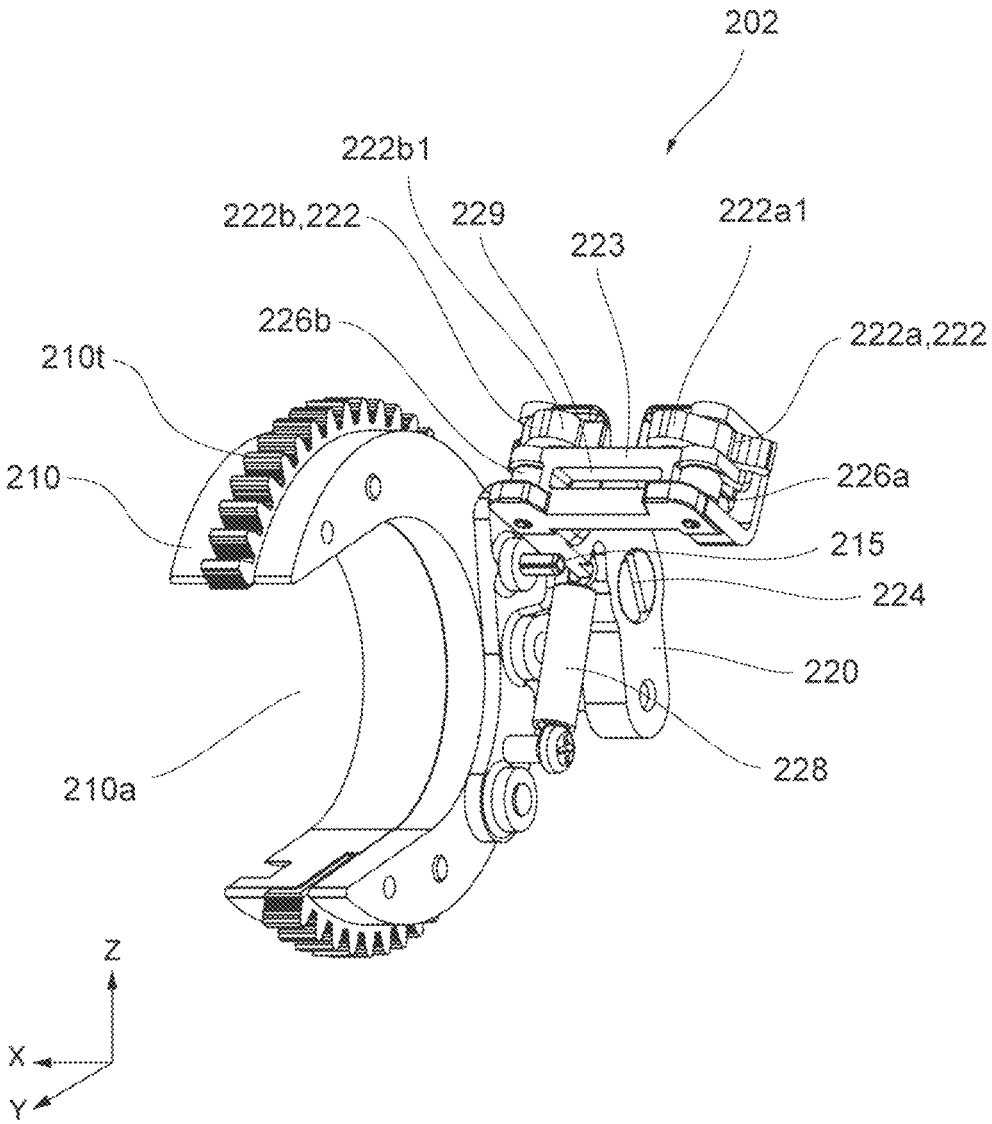
FIG. 8 is a perspective view of a rotator 210 and a tape holder 220 according to the present embodiment.
Figure 9:
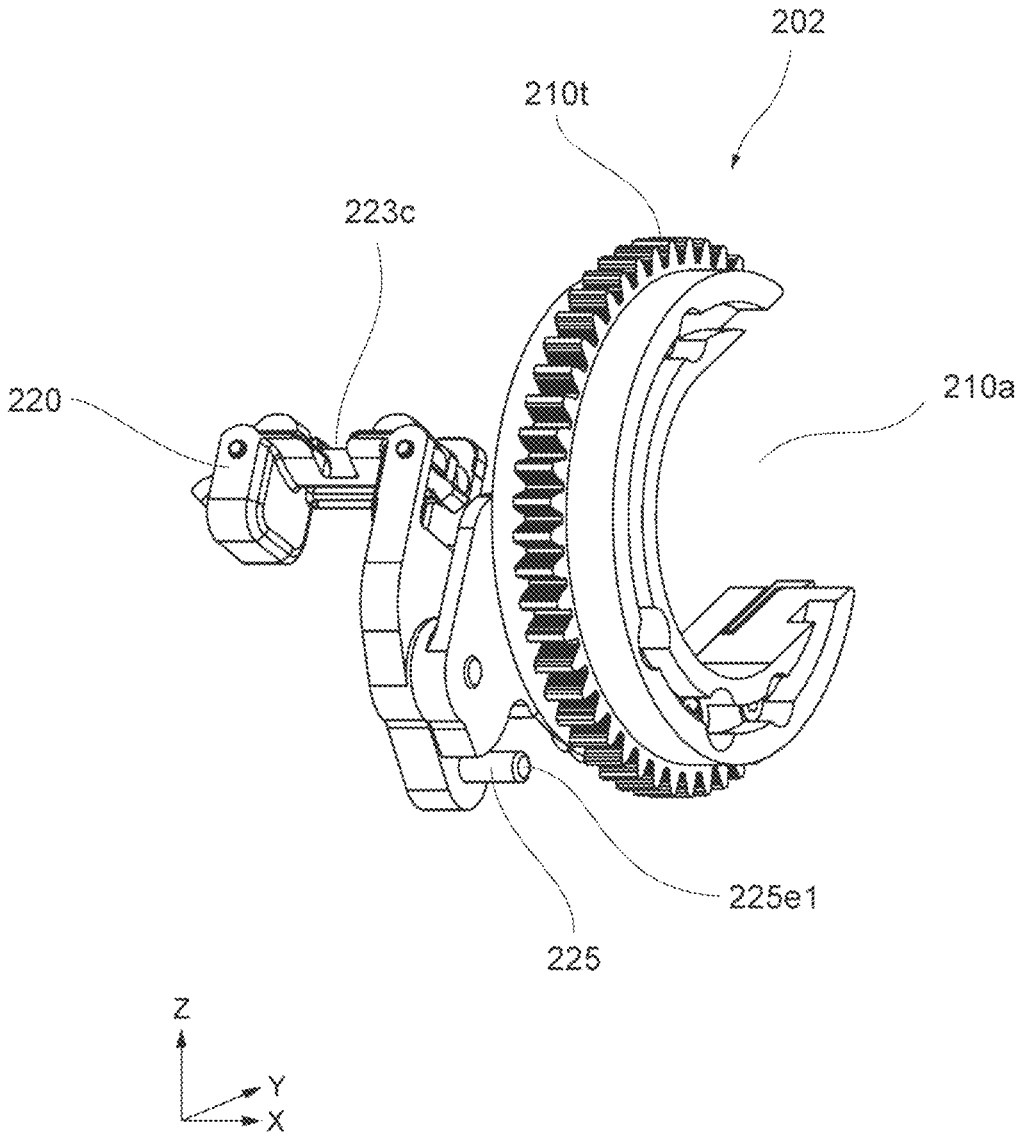
FIG. 9 is a perspective view of the rotator 210 and the tape holder 220 according to the present embodiment.

The binding material feeder 202 including the rotator 210 and the tape holder 220 will be described with reference to FIGS. 8 and 9. FIGS. 8 and 9 are perspective views of the rotator 210 and the tape holder 220. FIG. 8 is a perspective view of the rotator 210 and the tape holder 220 viewed from the front side in the Y direction. FIG. 9 is a perspective view of the rotator 210 and the tape holder 220 viewed from a rear side in the Y direction. As illustrated in FIGS. 8 and 9, the tape holder 220 is disposed at a part of the rotator 210, and is rotatable with rotation of the rotator 210.

As illustrated in FIGS. 8 and 9, the rotator 210 has the opening 210*a* that opens in the Y direction. Accordingly, the rotator 210 has a U-shaped section, and the tape holder 220 is disposed in a vicinity of a part of the rotator 210 that corresponds to a bottom side of a U shape. As will be described later, an object to be bound 60 is inserted into the opening 210*a* of the rotator 210. That is, in the present embodiment, the rotator 210 is rotatable and has the opening 210*a* (first opening 210*a*). The opening 210*a* opens in a part of an outer periphery viewed from a direction parallel to a rotation center axis, and can receive the object to be bound 60 to be described later. The rotator 210 is provided with teeth 210*t* on the outer periphery. The teeth 210*t* are engageable with the sixth gear 290-6 and the seventh gear 290-7. Accordingly, the rotator 210 rotates about the rotation center axis with rotation of the sixth gear 290-6 and the seventh gear 290-7. The rotator 210 includes an abutment 215 that can abut against the tape holder 220.

As illustrated in FIG. 8, the tape holder 220 includes a tape presser 222 including a pair of claws 222*a* and 222*b*, a tape support 223, a tape holder rotation center 224, a pair of torsion coil springs 226*a* and 226*b* respectively corresponding to the pair of claws 222*a* and 222*b*, and a tension spring 228. The tape support 223 has an opening 223*c* (not illustrated in FIG. 8, see FIG. 9). The torsion coil springs 226*a* and 226*b* urge the claws 222*a* and 222*b*, respectively. The claw 222*a* has a top end 222*a*1, and the claw 222*b* has a top end 222*b*1. The claw 222*a* is urged by the torsion coil spring 226*a* in a direction in which the top end 222*a*1 is directed toward the tape support 223. The claw 222*b* is urged by the torsion coil spring 226*b* in a direction in which the top end 222*b*1 is directed toward the tape support 223. The tape holder 220 holds the tape 70 by urging the claws 222*a* and 222*b* against the tape supporter 223 in this manner.

The tape holder 220 is pivotable about the tape holder rotation center 224 relative to the rotator 210. The tension spring 228 restricts movement of the tape holder 220 when the tape holder 220 pivots. According to a rotation angle of the rotator 210, the tape holder 220 abuts against the abutment 215, and a radial position of the tape holder 220 relative to the rotator 210 and a rotation angle of the tape holder 220 are defined by the tension spring 228. As illustrated in FIG. 9, the tape holder 220 includes an engager 225. As will be described later, the engager 225 has one end 225*e*1 engaged with a groove 282*g* of a wall 282 provided on the binding machine body 200. Accordingly, the tape holder 220 moves following a shape of the groove 282*g* via the engager 225. Accordingly, an operation of the tape holder 220 such as movement away from the object to be bound 60 is implemented. Accordingly, in the present embodiment, the binding material holder 220 (tape holder 220) takes a first movement state of following the rotator 210 and moving along a circumference of a first circle having a first radius about the rotation center axis of the rotator 210 and a second movement state of moving radially outward from the first circle. The tape holder 220 further has a cutting blade passage slit 229. A cutting blade 238 (tape cutter in the present embodiment) passes through the cutting blade passage slit 229 when cutting the tape 70 described later.

Figure 10:
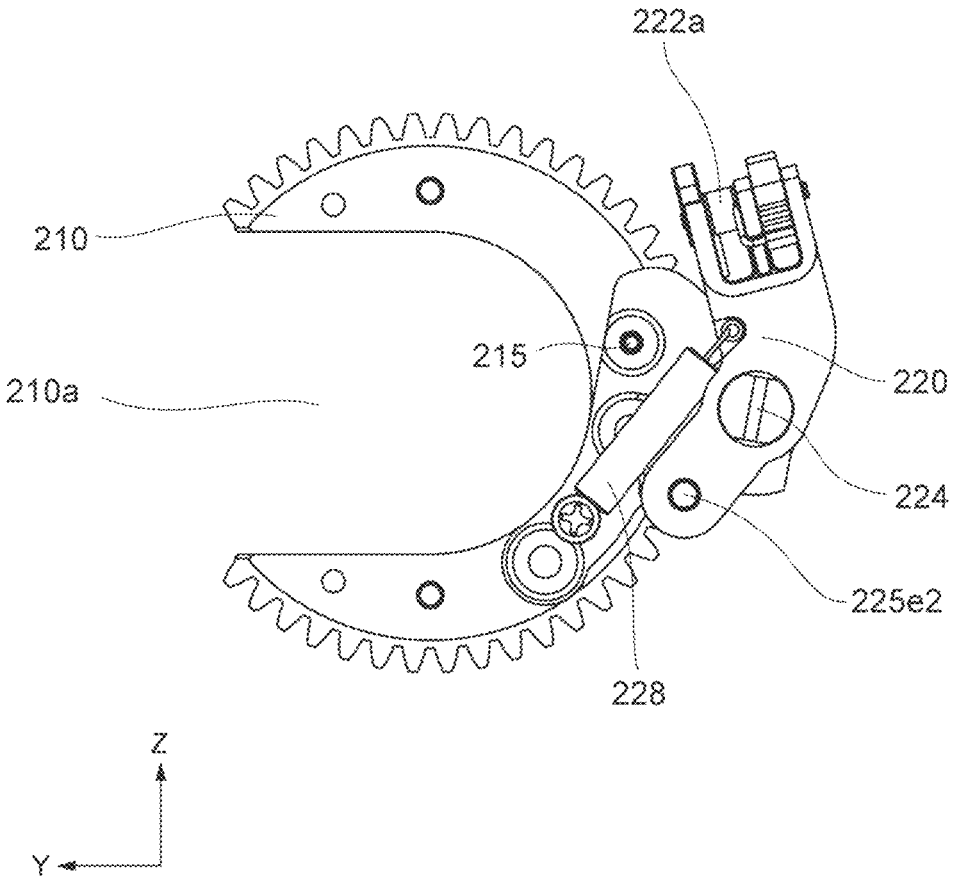
FIG. 10 illustrates the rotator 210 and the tape holder 220 according to the present embodiment viewed from a −X direction.
Figure 11:
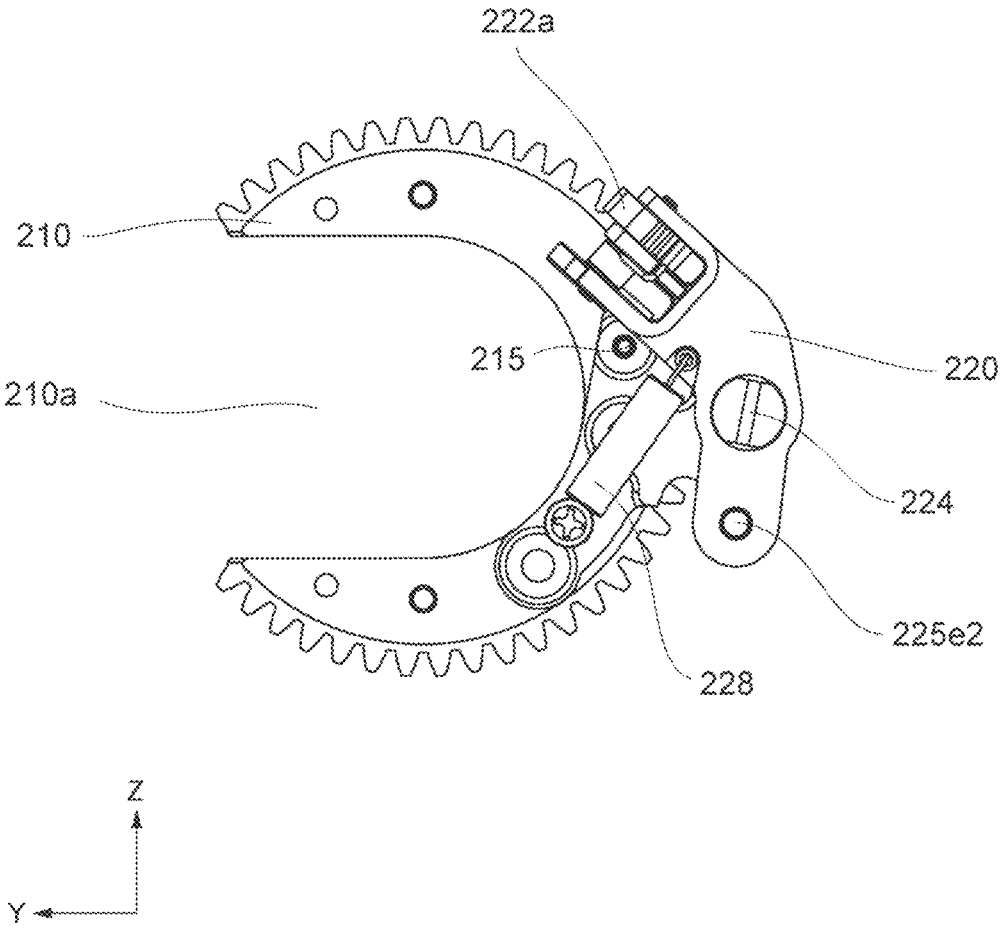
FIG. 11 illustrates the rotator 210 and the tape holder 220 according to the present embodiment viewed from the −X direction.
Figure 12:
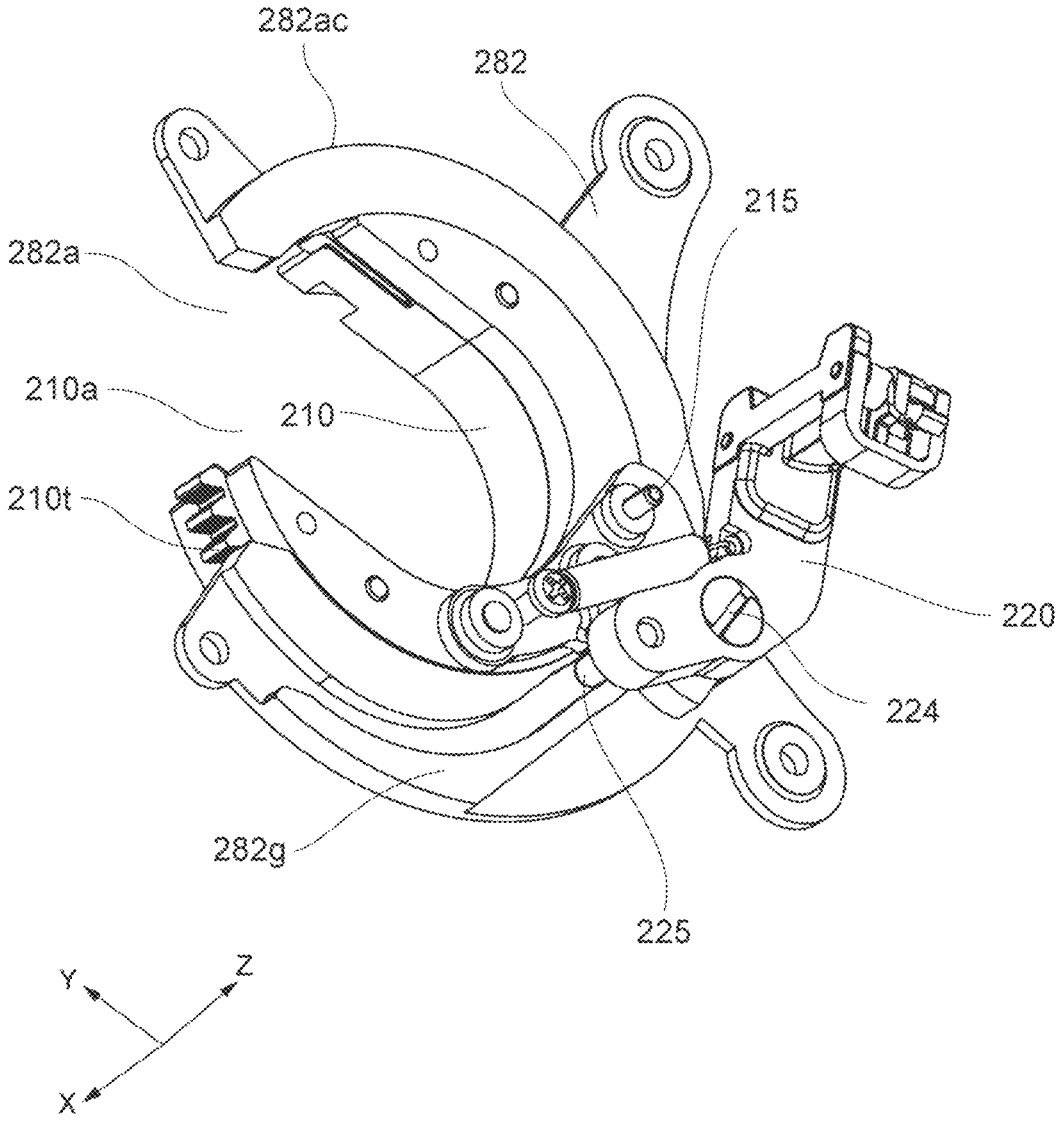
FIG. 12 is a perspective view illustrating the rotator 210, the tape holder 220, and a wall 282 according to the present embodiment.

The operation of the tape holder 220 will be described with reference to FIGS. 10 to 12. FIGS. 10 and 11 illustrate the rotator 210 and the tape holder 220 viewed from the −X direction. FIGS. 10 and 11 illustrate a case in which the tape holder 220 is located in a position relatively close to the rotator 210 and a case in which the tape holder 220 is located in a position relatively distant from the rotator 210 when the rotator 210 stops rotation at a certain time point during binding of an object to be bound. FIG. 12 is a perspective view illustrating the rotator 210, the tape holder 220, and the wall 282 on which the rotator 210 is provided in the binding machine body 200.

As illustrated in FIG. 12, the wall 282 has an opening 282*a* (in the present embodiment, the second opening 282*a*) that opens in the +Y direction. Accordingly, the wall 282 has a U shape. As illustrated in FIG. 12, the wall 282 is located on the outer periphery of the rotator 210. In the present embodiment, the wall 282 is fixed to the binding machine body 200, whereas the rotator 210 is rotatable relative to the wall 282. In the example illustrated in FIG. 12, the opening 282*a* of the wall 282 communicates with the opening 210*a* of the rotator 210. FIG. 12 illustrates a state in which the opening 282*a* communicates with the opening 210*a*, and in FIG. 12, the opening 282*a* and the opening 210*a* are illustrated in the same position. When the rotator 210 rotates along the wall 282, the rotator 210 can take a plurality of states including a state in which the opening 210*a* communicates with the opening 282*a* and a state in which the opening 210*a* is located on a side opposite to the opening 282*a* of the wall 282 and a part of the rotator 210 other than the opening 210*a* is located on an opening 282*a* side. That is, the rotator 210 may take a state in which the opening 210*a* overlaps, for example, one of a pair of legs of the U shape of the wall 282 other than the side opposite to the opening 282*a* of the wall 282.

In the present embodiment, in the state in which the opening 210*a* communicates with the opening 282*a*, an overlapped part of a pair of ends (first end 72, second end 74) of the tape 70 is fixed by the clincher unit 230 and the magazine unit 240 using the staple 50. When fixing the tape 70, for example, the staple 50 may be damaged or jammed, and an operation of the binding portion (clincher unit 230, magazine unit 240) may be stopped. When the operation of the binding portion is stopped, the operation of the rotator 210 coordinating with the binding portion is also stopped. Accordingly, in a case in which the opening 210*a* of the rotator 210 does not communicate with the opening 282*a* of the wall 282 and, for example, the opening 210*a* overlaps a bottom side of the U shape of the wall 282 or one of the pair of legs, the rotator 210 stops when the binding portion stops. Accordingly, the rotator 210 cannot shift to the state in which the opening 210*a* communicates with the opening 282*a*, and the object to be bound 60 cannot be removed. In the present embodiment, the overlapped part of the pair of ends of the tape 70 is fixed in the state in which the opening 210*a* communicates with the opening 282*a*.

Accordingly, defects can be handled even when the staple 50 is damaged or the like, and for example, the object to be bound 60 can be easily removed from the opening 210*a*.

FIGS. 10 and 11 also illustrate an end 225*e*2 of the engager 225 that is opposite to the end (end 225*e*1) engaged with the wall 282. As illustrated in FIG. 12, the tape holder 220 is engaged with the groove 282*g* of the wall 282 via the engager 225, and can take states illustrated in FIGS. 10 and 11 as the engager 225 follows the groove 282*g*. At this time, as the tape holder 220 shifts from the state illustrated in FIG. 10 to the state illustrated in FIG. 11 along the shape of the groove 282*g* provided in the wall 282, the engager 225 moves radially outward viewed from the rotation center axis of the rotator 210. At this time, since the tape holder 220 rotates about the tape holder rotation center 224 as a fulcrum, an end of the tape holder 220 on a side on which the claws 222*a* and 222*b* are formed moves toward a radially inner side of the rotator 210. The groove 282*g* is provided in a part of the wall 282 in a circumferential direction when viewed from a direction of the rotation center axis of the rotator 210. Accordingly, when the tape holder 220 moves about the rotation center axis and the engager 225 does not engage with the groove 282*g* instead of engaging therewith due to the rotation angle of the tape holder 220, the engager 225 follows an outer peripheral surface 282*ac* of the wall 282 and restricts the rotation of the tape holder 220. At this time, as illustrated in FIG. 11, a part of the tape holder 220 abuts against the abutment 215 of the rotator 210.

When moving as illustrated in FIGS. 10 and 11, the tape holder 220 is urged by the tension spring 228, and can maintain a state in which tension is applied to the tape 70 held by the tape holder 220. Accordingly, the tape holder 220 maintains a state of abutting against the abutment 215 while the engager 225 follows the outer peripheral surface 282*ac* of the wall 282 as illustrated in FIG. 11. At this time, the tape holder 220 maintains the rotation angle relative to the rotator 210 illustrated in FIG. 11 by abutting against the abutment 215 while rotating counterclockwise relative to the rotator 210 about the tape holder rotation center 224 with the engager 225 following the outer peripheral surface 282*ac*. FIG. 8 corresponds to a perspective view of the rotator 210 and the tape holder 220 in the state illustrated in FIG. 11. When the tape holder 220 further rotates counterclockwise in FIG. 11 and moves in a vicinity of the opening 282*a* of the wall 282, abutment of the engager 225 against the outer peripheral surface 282*ac* is released. At this time, the position and the rotation angle of the tape holder 220 relative to the rotator 210 are restricted by the tension spring 228.

Figure 13:
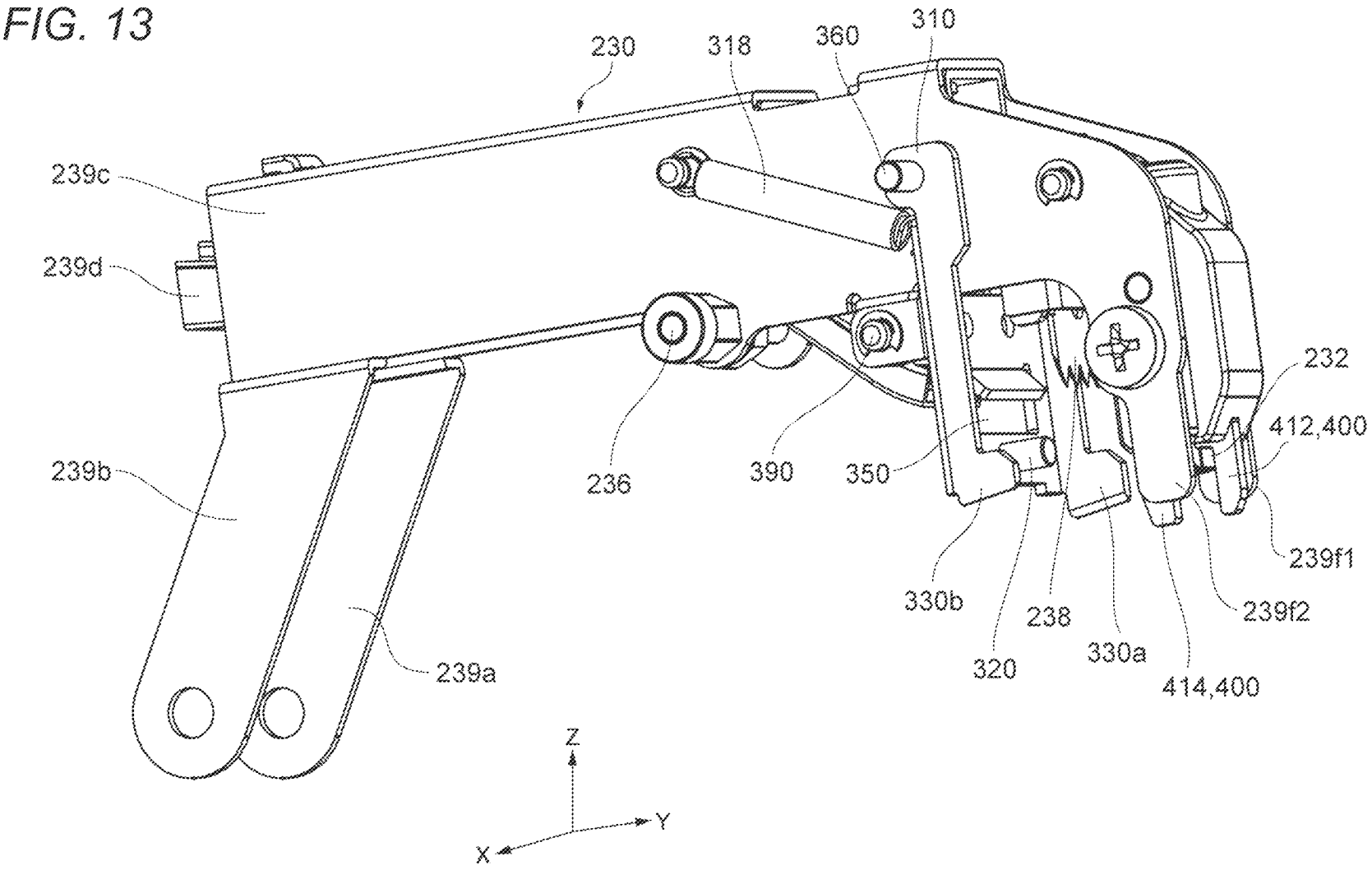
FIG. 13 is a perspective view of a clincher unit 230 according to the present embodiment.
Figure 14:
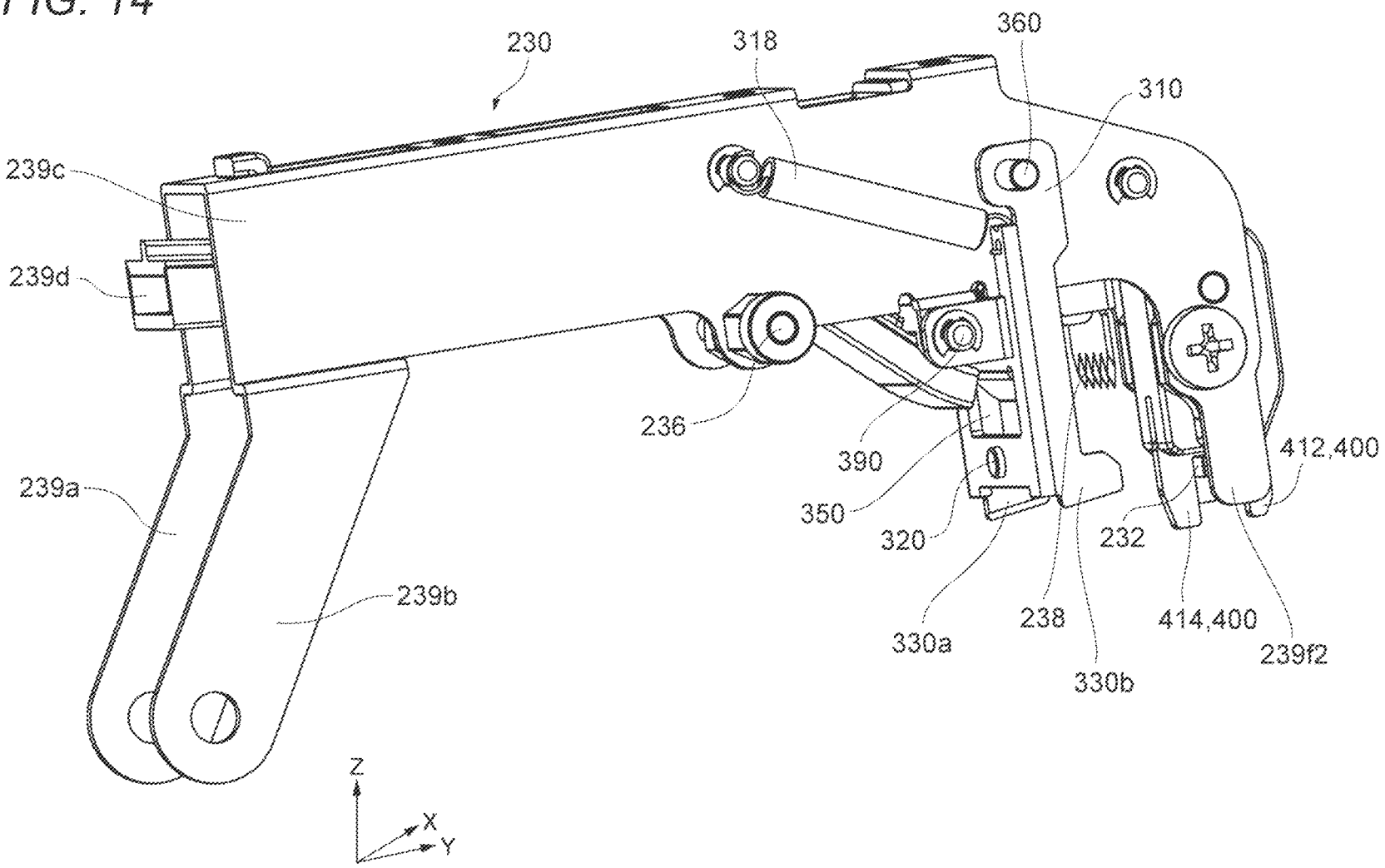
FIG. 14 is a perspective view of the clincher unit 230 according to the present embodiment.

The clincher unit 230 according to the present embodiment will be described with reference to FIGS. 13 and 14. FIG. 13 is a perspective view of the clincher unit 230 when viewed obliquely from the +Y direction (obliquely front side in the Y direction). FIG. 14 is a perspective view of the clincher unit 230 when viewed obliquely from the −Y direction (obliquely rear side in the Y direction).

As illustrated in FIGS. 13 and 14, the clincher unit 230 includes the clincher 232, a clincher unit drive cam roller 236, the cutting blade 238, legs 239*a* and 239*b*, a trunk 239*c*, and a tape passage 239*d*. The clincher unit drive cam roller 236 engages with the clincher unit drive cam groove 230*ag* of the clincher unit drive cam 230*a*. Accordingly, the clincher unit 230 is configured such that the clincher unit drive cam roller 236 follows a shape of the clincher unit drive cam groove 230*ag* with the rotation of the clincher unit drive cam 230*a* and moves upward and downward in the Z direction in the binding machine body 200. The clincher unit 230 further includes, in the −Z direction of the clincher 232, a tape folder 400 that includes a first folder 412 and a second folder 414 and folds the tape before clinching. The tape holding releaser 310 is provided in the +Y direction of the trunk 239*c*.

The tape holding releaser 310 includes a tape remover 320, a first releaser 330*a*, and a second releaser 330*b*. The tape holding releaser 310 is urged against the trunk 239*c* via a tension spring 318. The tape holding releaser 310 is rotatable about a swing fulcrum 390. The tape holding releaser 310 includes a swing control pin 360. The legs 239*a* and 239*b* engage with the arm shaft 280*b*, and the clincher unit 230 operates with the arm shaft 280*b* as a fulcrum. As illustrated in FIG. 13, the clincher unit 230 includes a first clincher leg 239*f*1 and a second clincher leg 239*f*2 provided respectively in the −X direction and the +X direction of the clincher 232. The first clincher leg 239*f*1 and the second clincher leg 239*f*2 correspond to parts extending from the trunk 239*c* in the +Y direction and the −Z direction.

The clincher 232 bends, from the +Z direction, the staple 50 (needle 50) supplied from the magazine unit 240 (not illustrated) from the −Z direction in a state in which one end and the other end (first end 72, second end 74) of the tape 70, which is a binding article surrounding the object to be bound 60, are overlapped. That is, the first end 72 and the second end 74 of the tape 70 to be described later with reference to the drawings are physically fixed by the staple 50 so as not to be separated. In the present embodiment, the state in which the tape 70 is physically fixed may also be a state in which the pair of ends of the tape 70 are clamped between the crown 52 and the legs (for example, the first leg 54*a* and the second leg 54*b* (see FIG. 4)) of the staple 50 and movement of the tape 70 is restricted. The pair of ends of the tape 70 may also be fixed by other methods such as thermal welding and pressure bonding.

In the tape holding releaser 310, the swing control pin 360 abuts against the outer peripheral surface 230*ac* of the clincher unit drive cam 230*a* (not illustrated). Accordingly, with the rotation of the clincher unit drive cam 230*a*, the swing control pin 360 follows the shape of the outer peripheral surface 230*ac* of the clincher unit drive cam 230*a*, and the tape holding releaser 310 rotates about the swing fulcrum 390 while being urged by the tension spring 318. As will be described in detail later, in the present embodiment, the state in which the tape 70 is held by the tape holder 220 can be released by the claws 222*a* and 222*b* of the tape holder 220 coming into contact with the tape holding releaser 310. When the tape holder 220 moves in the +Z direction relative to the tape holding releaser 310, the tape remover 320 removes the ends of the tape 70 that are released from a held state.

The tape holding releaser 310 has a tape passage opening 350. The tape passage 239*d* is provided up to a vicinity of the tape holding releaser 310, and the tape 70 supplied from the tape reel 800 provided outside the binding machine body 200 through the tape passage 239*d* reaches the tape passage opening 350. As will be described later, one binding of the object to be bound 60 is completed, and the ends of the tape used for binding are released from the tape holder 220 by the tape holding releaser 310. Thereafter, since the swing control pin 360 of the tape holding releaser 310 rotates following the outer peripheral surface 230*ac* of the clincher unit drive cam 230*a*, the tape holding releaser 310 is released from abutting against the claws 222*a* and 222*b* of the tape holder 220. Accordingly, the claws 222*a* and 222*b* are respectively urged by the torsion coil springs 226*a* and 226*b* toward the tape support 223, and the tape holder 220 holds an end of the tape 70 supplied from the tape passage opening 350 through the tape passage 239*d* for a next binding. The ends of the tape used for binding are cut by the cutting blade 238. Thereafter, when the tape 70 held by the tape holder 220 starts to move around a binding position of the next object to be bound 60, a binding process for the next binding position is started.

Figure 15:
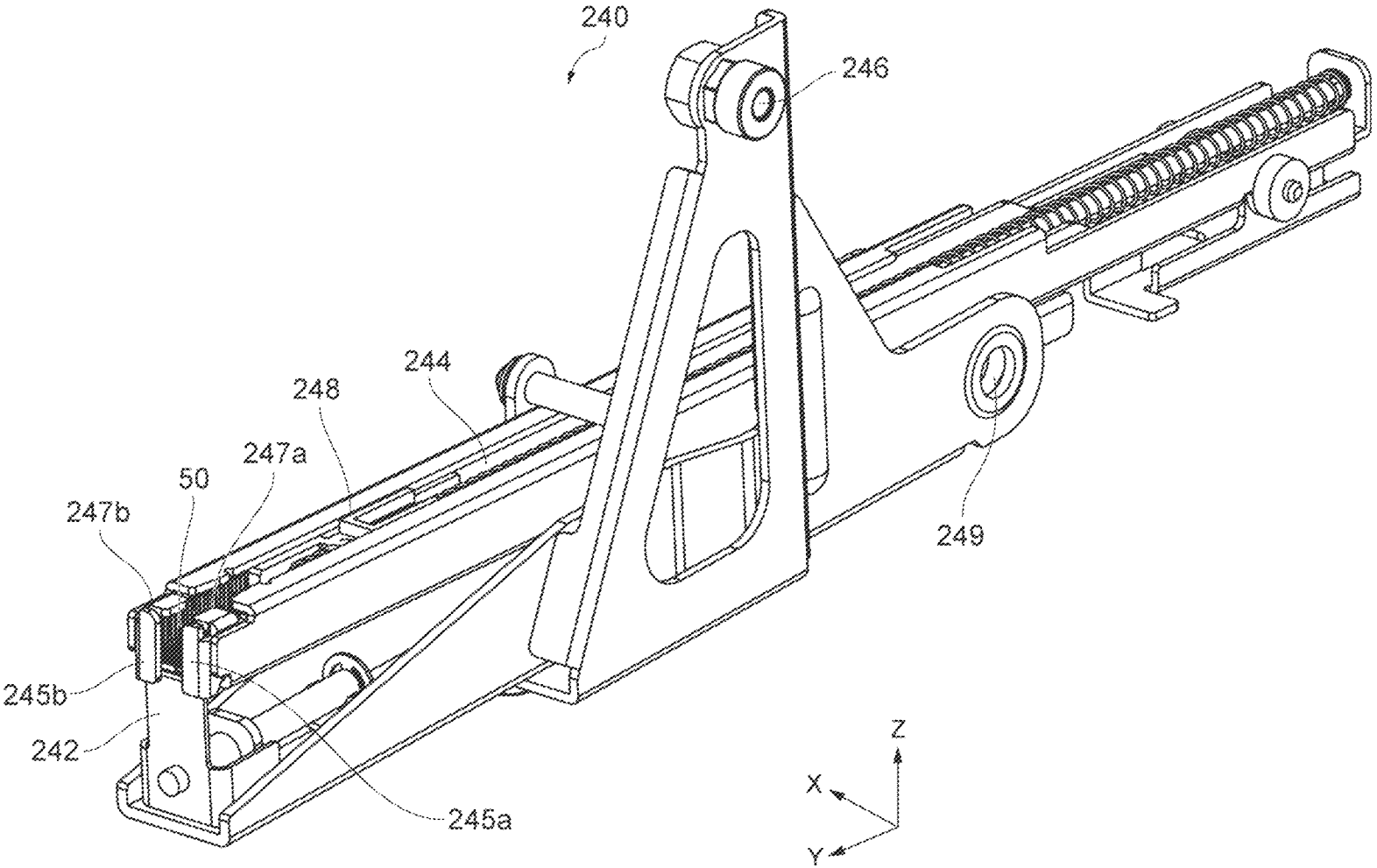
FIG. 15 is a perspective view of a magazine unit 240 according to the present embodiment.
Figure 16:
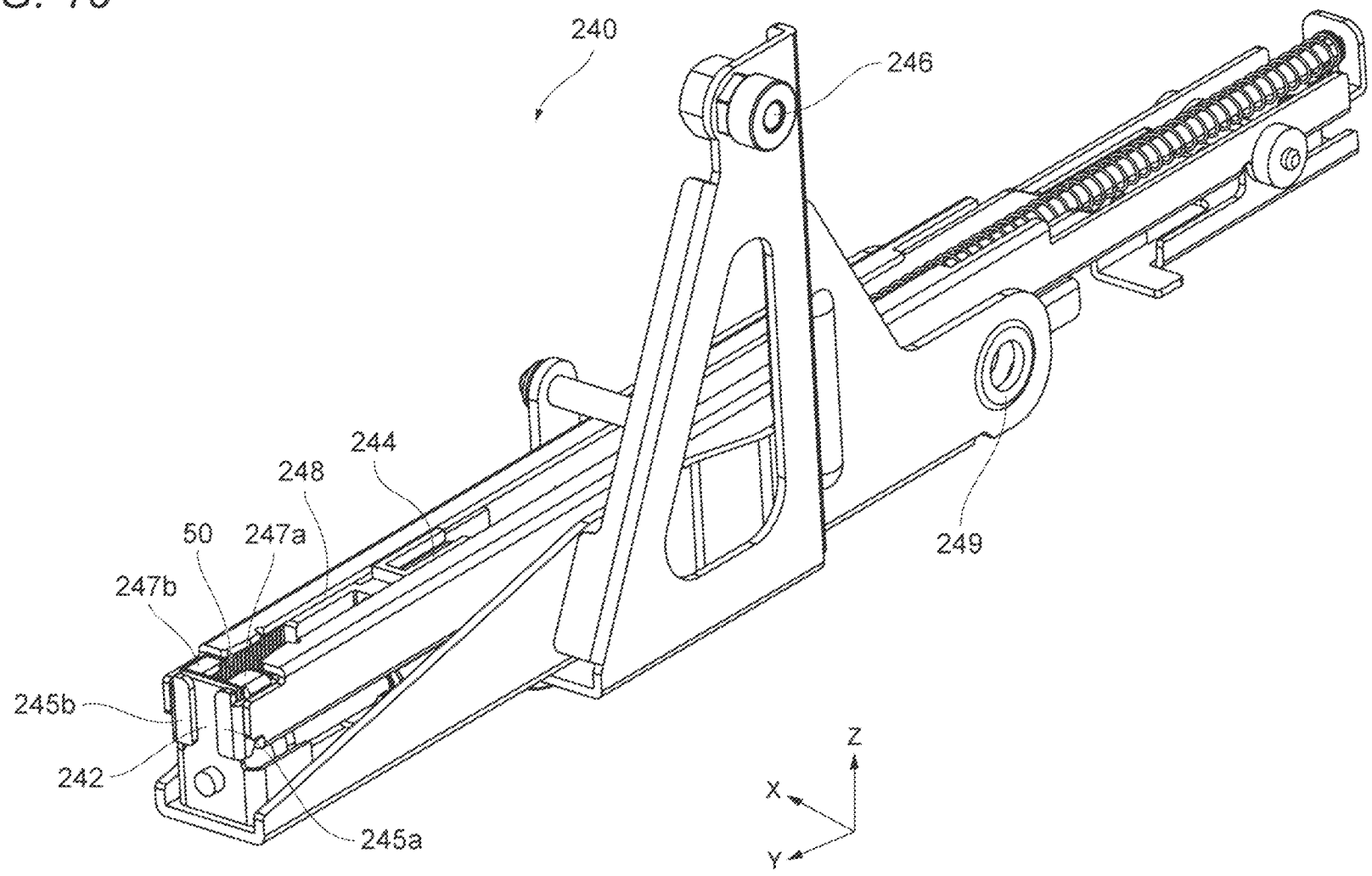
FIG. 16 is a perspective view of the magazine unit 240 according to the present embodiment.

The magazine unit 240 according to the present embodiment will be described with reference to FIGS. 15 and 16. FIG. 15 is a perspective view illustrating a state in which the magazine unit 240 waits without performing a clinching operation. FIG. 16 is a perspective view illustrating a clinching state of the magazine unit 240.

As illustrated in FIG. 15, the magazine unit 240 includes the driver 242, a magazine 244, a magazine unit drive cam roller 246, and a pusher 248. In the magazine unit 240, the staple 50 loaded in the magazine 244 is urged in the +Y direction by the pusher 248. When fixing the tape 70 with the staple 50, the magazine unit 240 is relatively moved in the +Z direction (that is, a direction of the clincher unit 230). As illustrated in FIG. 15, the magazine unit 240 includes a first abutment member 247*a* and a second abutment member 247*b* at parts thereof that abut against the clincher 232 in the Z direction when clinching is performed. The magazine unit 240 further includes, in the +Y direction of the driver 242, a first driver restricting member 245*a* and a second driver restricting member 245*b* that restrict movement of the driver 242 in the Y direction. At this time, the driver 242 relatively moves in the +Z direction as illustrated in FIG. 16. Further, the staple 50 located farthest in the +Y direction in the magazine 244 is projected in the +Z direction by the driver 242, and the pair of legs (first leg 54*a*, second leg 54*b*) of the staple 50 are relatively pressed from the +Z direction by the clincher 232, so that the staple 50 is deformed and clinching is performed.

The magazine unit drive cam roller 246 engages with the magazine unit drive cam groove 240*ag* of the magazine unit drive cam 240*a*. Accordingly, the magazine unit 240 follows the shape of the magazine unit drive cam groove 240*ag* with the rotation of the magazine unit drive cam 240*a* via the magazine unit drive cam roller 246 and moves in the +Z direction and the −Z direction in the binding machine body 200. At this time, the magazine unit 240 moves relative to the binding machine body 200 with a magazine unit swing fulcrum 249 as a fulcrum.

Figure 17:
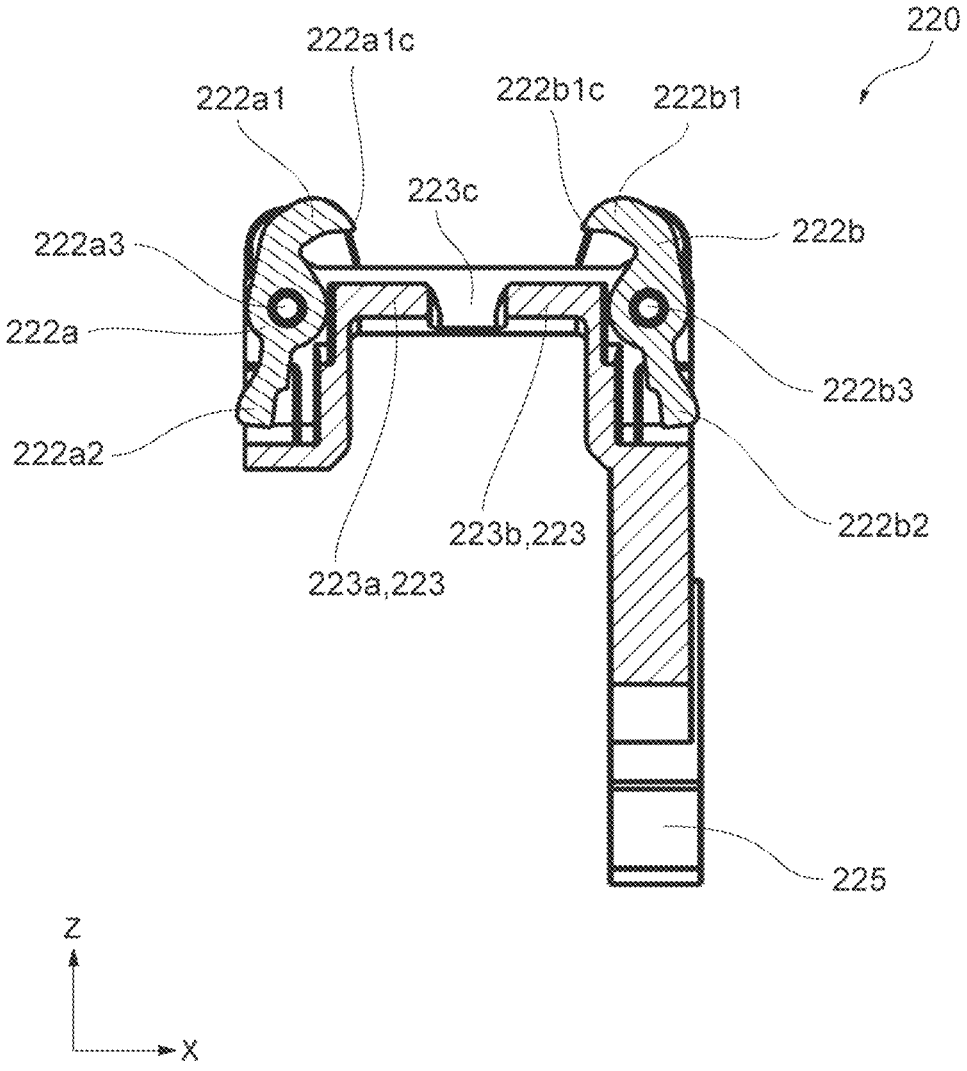
FIG. 17 is a sectional view of the tape holder 220 according to the present embodiment.
Figure 18:
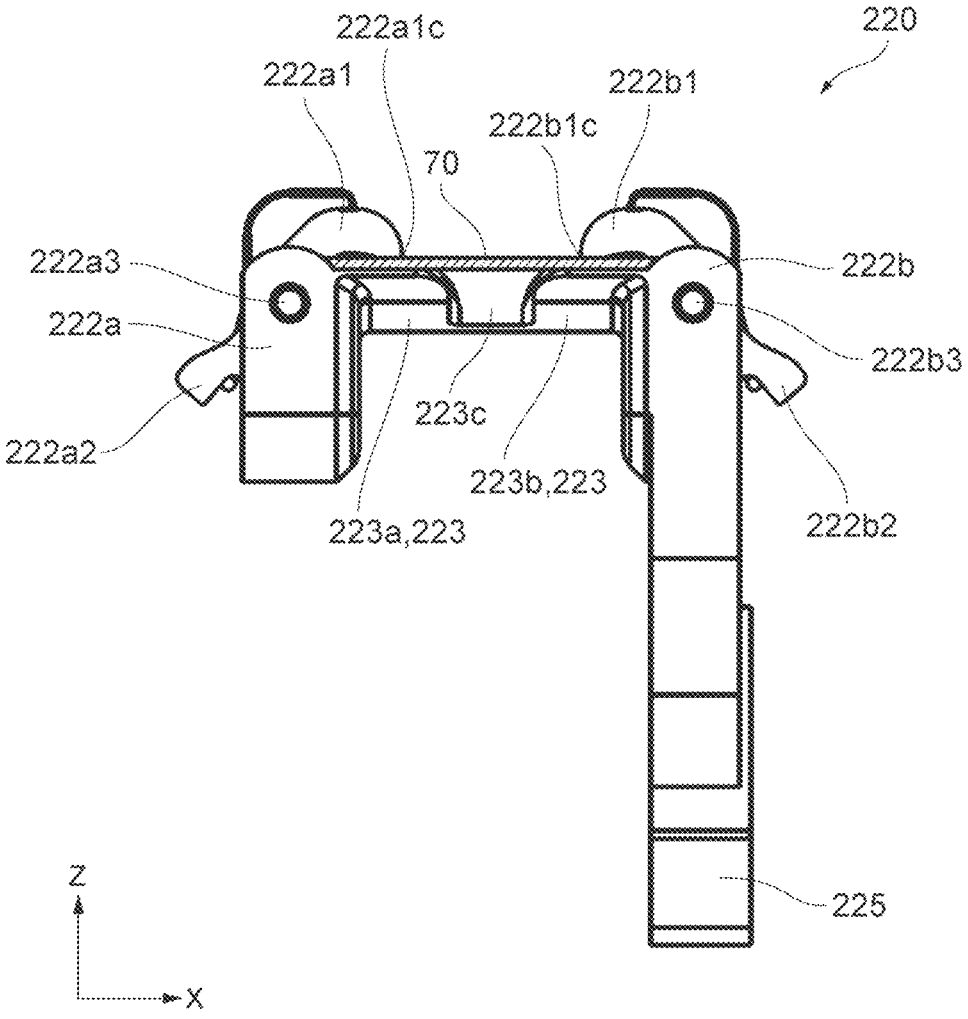
FIG. 18 illustrates the tape holder 220 according to the present embodiment viewed from a −Y direction.
Figure 19:
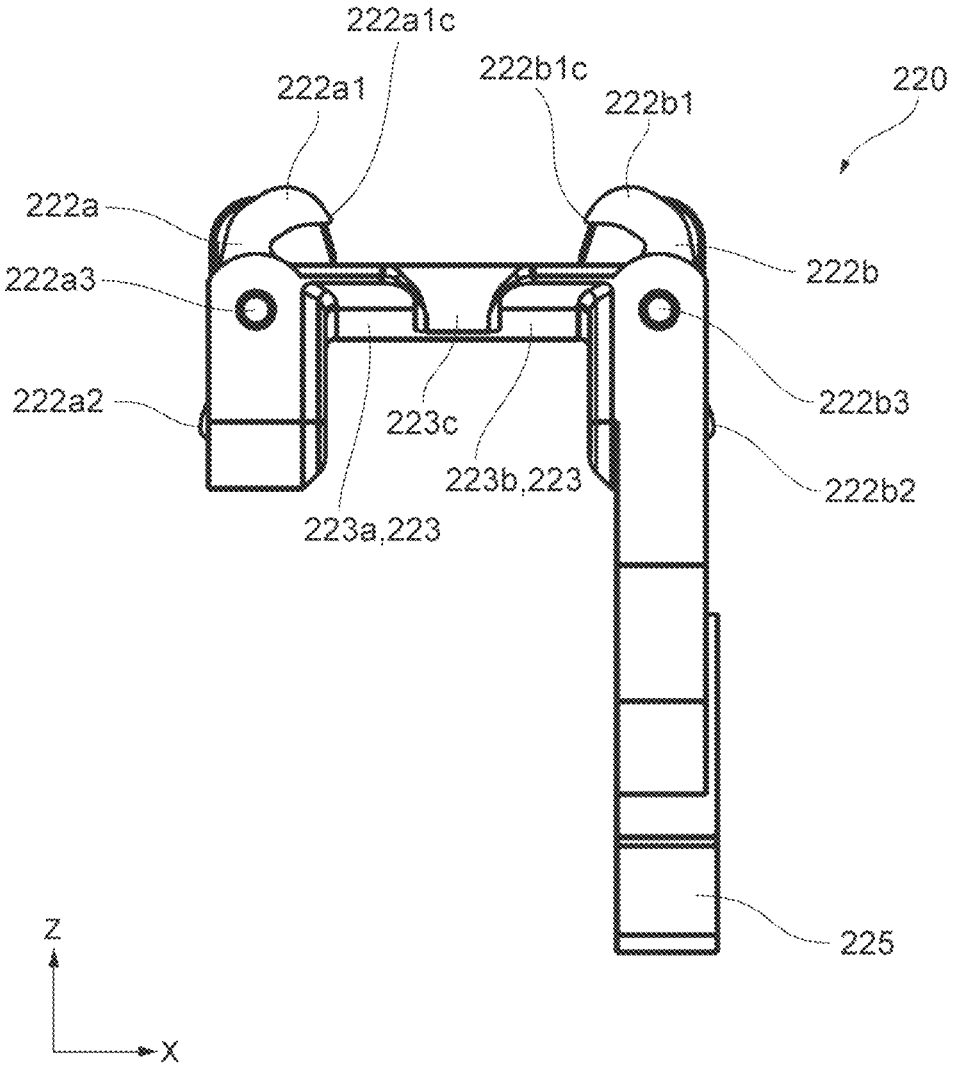
FIG. 19 illustrates the tape holder 220 according to the present embodiment viewed from the −Y direction.

The tape holder 220 will be described with reference to FIGS. 17 to 19. FIG. 17 is a sectional view of the tape holder 220 viewed from the −Y direction. FIG. 18 illustrates a state in which the tape holder 220 holds the tape 70 viewed from the −Y direction. FIG. 19 illustrates a state in which the tape 70 is released from the tape holder 220 viewed from the −Y direction.

As illustrated in FIG. 17, the tape holder 220 includes the pair of claws 222*a* and 222*b* (tape presser 222 in the present embodiment) and the tape support 223. The first claw 222*a*, which is one of the pair of claws, includes the top end 222*a*1, a base end 222*a*2, and a fulcrum 222*a*3. The top end 222*a*1 and the base end 222*a*2 are rotatable about the fulcrum 222*a*3. The first claw 222*a* includes a contact 222*a*1*c* at the top end 222*a*1. The second claw 222*b*, which is the other one of the pair of claws, includes the top end 222*b*1, a base end 222*b*2, and a fulcrum 222*b*3, and the top end 222*b*1 and the base end 222*b*2 are rotatable about the fulcrum 222*b*3. The second claw 222*b* includes a contact 222*b*1*c* at the top end 222*b*1. The tape support 223 includes a first tape support 223*a* and a second tape support 223*b*. The tape support 223 has the opening 223*c* between the first tape support 223*a* and the second tape support 223*b*.

As illustrated in FIG. 18, in the state in which the tape holder 220 holds the tape 70, the tape 70 is supported by the first tape support 223*a* and the second tape support 223*b* of the tape support 223 from below in the −Z direction, and is held by being pressed by the first claw 222*a* and the second claw 222*b* from the +Z direction. More specifically, the contact 222*a*1*c* of the top end 222*a*1 of the first claw 222*a* and the contact 222*b*1*c* of the top end 222*b*1 of the second claw 222*b* are pressed respectively toward the first tape support 223*a* and the second tape support 223*b* by coming into contact with a vicinity of side edges of the tape 70 in the X direction (vicinity of a first side edge which is one side edge of a pair of side edges (two side edges) of the tape 70 and a second side edge which is the other side edge of the pair of side edges in the X direction). That is, the contact 222*a*1*c* of the top end 222*a*1 comes into contact with the tape 70, which is supported by the tape support 223, from a first side edge side on which the first side edge which is one of the pair of side edges of the tape 70 is provided, and the contact 222*b*1*c* of the top end 222*b*1 comes into contact with the tape 70 from a second side edge side on which the second side edge which is the other one of the pair of side edges of the tape 70 is provided, so that the tape holder 220 holds the tape 70 with the first side edge side and the second side edge side of the tape 70 clamped in between. At this time, the base end 222*a*2 of the first claw 222*a* and the base end 222*b*2 of the second claw 222*b* are moved to positions in the +Z direction with rotation of the top end 222*a*1 and the top end 222*b*1 in the −Z direction as compared with the state illustrated in FIG. 17. In FIG. 18, the X direction corresponds to a lateral direction of the tape 70.

As illustrated in FIG. 19, in the state in which the tape 70 is released from the tape holder 220, the first claw 222*a* and the second claw 222*b* are located respectively in positions separated from the first tape support 223*a* and the second tape support 223*b* in the +Z direction.

The tape holder 220 can hold and release the tape 70 by taking the state illustrated in FIG. 18 and the state illustrated in FIG. 19.

As described above with reference to FIGS. 13 and 14, in the present embodiment, the tape holder 220 shifts from the state of holding the tape 70 (FIG. 18) to the state in which the tape 70 is released from being held by the tape holder 220 (FIG. 19) by abutting against the tape holding releaser 310. When not abutting against the tape holding releaser 310, the tape holder 220 holds the tape 70. The tape holder 220 moves, and the base end 222*a*2 of the claw 222*a* abuts against the first releaser 330*a* of the tape holding releaser 310. The base end 222*a*2 rotates in the −Z direction about the fulcrum 222*a*3, and the top end 222*a*1 rotates in the +Z direction accordingly. Accordingly, the top end 222*a*1 is separated from the tape support 223. Similarly, the base end 222*b*2 of the claw 222*b* abuts against the second releaser 330*b* of the tape holding releaser 310, and the base end 222*b*2 rotates in the −Z direction about the fulcrum 222*b*3, so that the top end 222*b*1 rotates in the +Z direction and the top end 222*b*1 separates from the tape support 223. In this way, the tape 70 is released from the state of being held by the tape holder 220.

In this way, in the tape holder 220 according to the present embodiment, the claws 222*a* and 222*b* move in the lateral direction (the +X direction and the −X direction in FIGS. 17 to 19) of the tape 70 to clamp the ends of the tape 70 and hold the tape 70. That is, in the tape holder 220 according to the present embodiment, the top end 222*a*1 of the claw 222*a* moves in the +X direction viewed in the X direction when rotating in the −Z direction about the fulcrum 222*a*3. The top end 222*b*1 of the claw 222*b* moves in the −X direction viewed in the X direction when rotating in the −Z direction about the fulcrum 222*b*3. Accordingly, in the present embodiment, the tape holder 220 holds the tape 70 from two side edges in the lateral direction.

With this configuration, the tape 70 can be held by movement of the claws 222*a* and 222*b* in the X direction (+X direction and −X direction, respectively). When two side edges of the tape 70 in the lateral direction are held, movement amounts of the claws 222*a* and 222*b* can be reduced compared to when a position away from the side edges such as a vicinity of a center of the tape 70 is held. Further, the tape 70 can be stably held by two side edges of the tape 70 in the lateral direction being held.

In the above described example, the tape holder 220 holds both of the pair of side edges of the tape 70. Alternatively, the present disclosure is not limited thereto, and the tape holder 220 may hold, for example, only one side edge of the pair of side edges.

Hereinafter, the clinching operation of the binding machine 100 according to the present embodiment will be described with reference to FIGS. 20A to 20J. FIGS. 20A to 20J are sectional views of the binding machine body 200 viewed in the −X direction. One object to be bound 60 is illustrated in FIGS. 20A to 20J for easy understanding of the description, and the present embodiment is also applicable to a case in which a plurality of objects to be bound 60 are bound together.

Figure 20A:
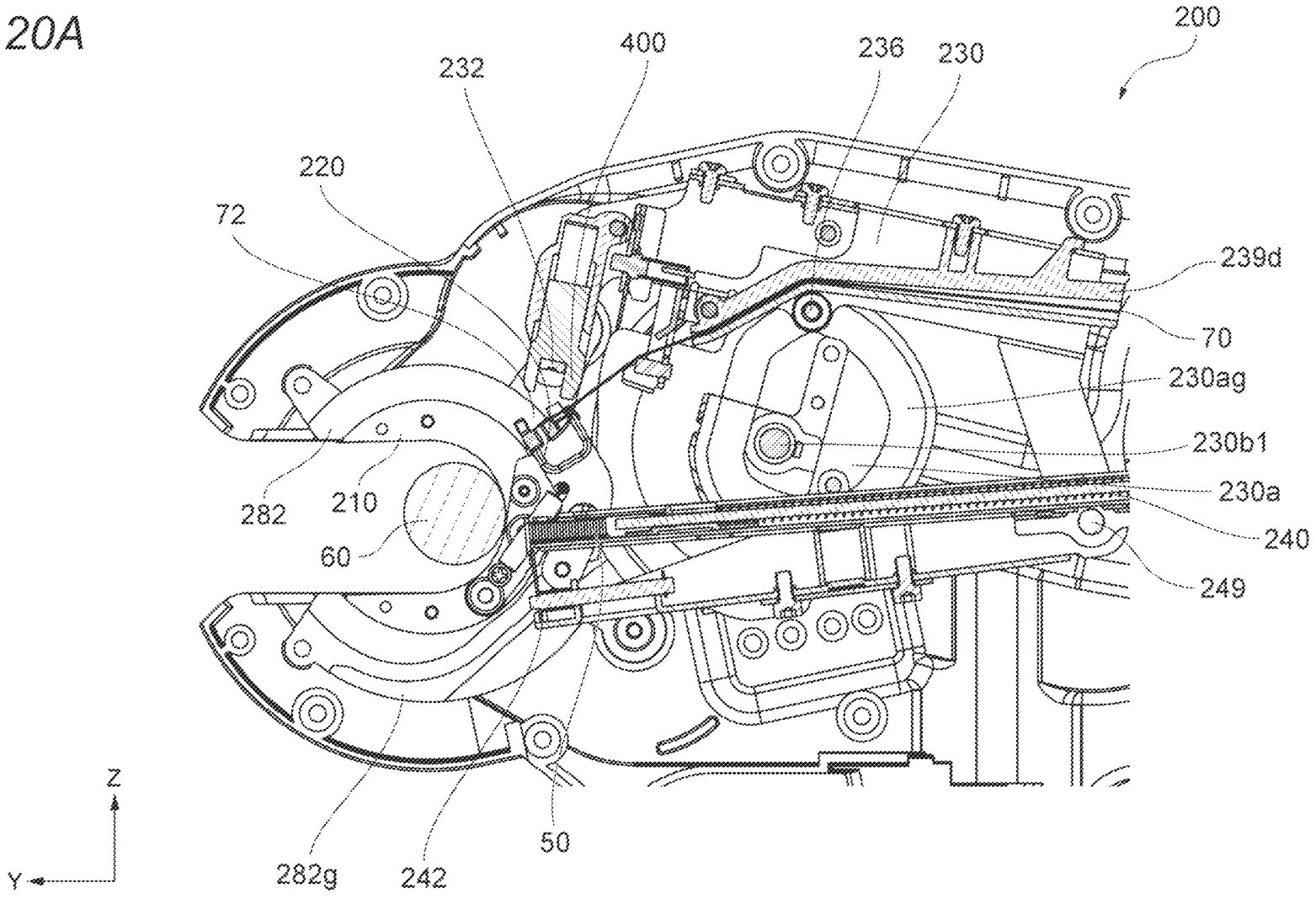
FIG. 20A is a sectional view of the binding machine body 200 according to the present embodiment viewed from the −X direction.

FIG. 20A illustrates a state immediately after the binding process according to the present embodiment is started. As illustrated in FIG. 20A, the object to be bound 60 is inserted from the opening of the rotator 210. At this time, the tape holder 220 holds the end 72 (first end 72) of the tape 70 supplied from the tape reel 800 through the tape passage 239*d* by the tape support 223, the first claw 222*a*, and the second claw 222*b*. Thereafter, the rotator 210 rotates counterclockwise in FIG. 20A. The tape holder 220 also rotates counterclockwise with rotation of the rotator 210. As will be described later, when clinching the staple 50, the clincher unit 230 and the magazine unit 240 relatively approach each other in the Z direction, and at this time, the tape holder 220 is located on a −Y direction side in FIG. 20A (right side in FIG. 20A).

When a next binding process is started after the clinching of the staple 50 ends, the clincher unit 230 is retracted in the +Z direction, and the tape holder 220 passes between the clincher unit 230 and the magazine unit 240. That is, in the present embodiment, when the tape holder 220 corresponding to a part of the binding material feeder 202 moves, the clincher unit 230 corresponding to a part of the binding portion temporarily retracts to a position in which the clincher unit 230 does not interfere with the tape holder 220. As will be described later, the magazine unit 240 also temporarily retracts to a position in which the magazine unit 240 does not interfere with the movement of the tape holder 220. In the example illustrated in FIG. 20A, the clincher unit 230 is retracted upward. The clincher unit 230 can move clinching and retracted positions as the clincher unit drive cam roller 236 engaged with the clincher unit drive cam groove 230*ag* of the clincher unit drive cam 230*a*, which rotates about the drive camshaft 230*b*1, follows the clincher unit drive cam groove 230*ag* along the shape of the clincher unit drive cam groove 230*ag*.

Figure 20B:
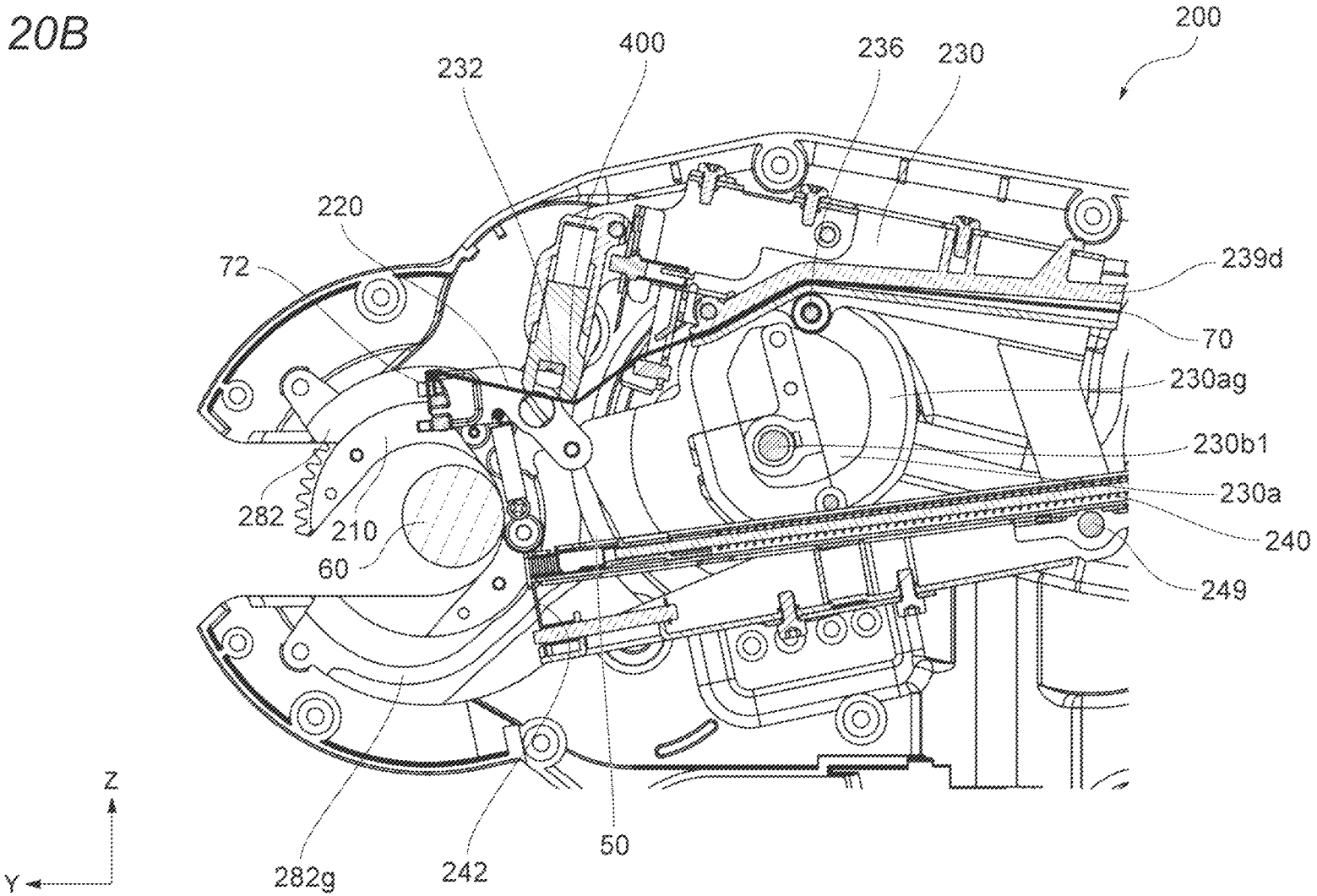
FIG. 20B is a sectional view of the binding machine body 200 according to the present embodiment viewed from the −X direction.

FIG. 20B illustrates a state in which the rotator 210 rotates counterclockwise from the state illustrated in FIG. 20A. As illustrated in FIG. 20B, the tape holder 220 also moves counterclockwise with rotation of the rotator 210. Between the state illustrated in FIG. 20A and the state illustrated in FIG. 20B, the clincher unit drive cam 230*a* also rotates, but the clincher unit drive cam groove 230*ag* of the clincher unit drive cam 230*a* is formed such that the clincher unit 230 does not move. Accordingly, the tape holder 220 passes below the clincher unit 230 in the Z direction without interfering with the clincher unit 230.

Figure 20C:
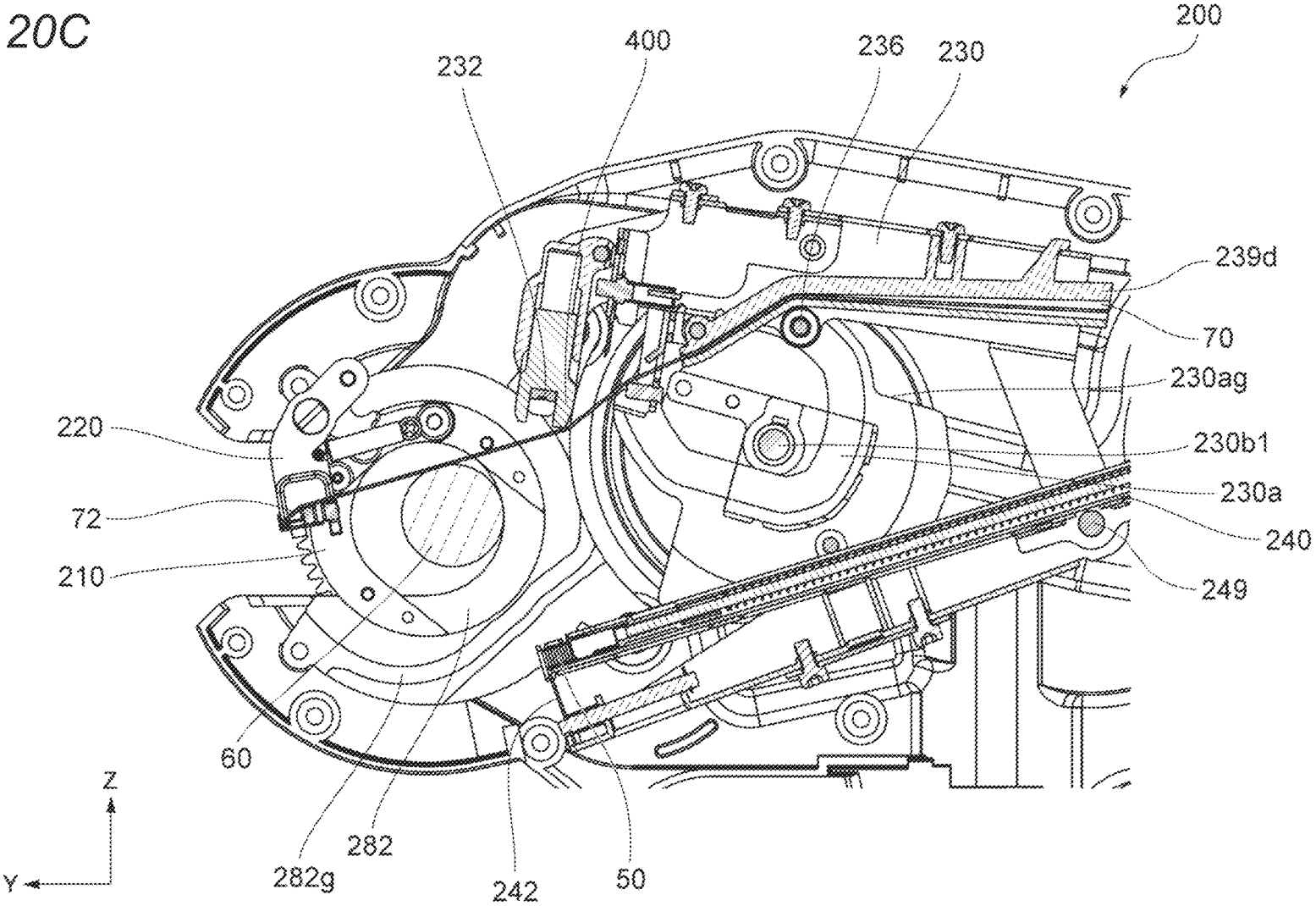
FIG. 20C is a sectional view of the binding machine body 200 according to the present embodiment viewed from the −X direction.

FIG. 20C illustrates a state in which the rotator 210 further rotates counterclockwise from the state illustrated in FIG. 20B. The tape holder 220 further moves in the +Y direction while holding the first end 72 of the tape 70. The clincher unit 230 moves in the −Z direction from the retracted position as compared with the state illustrated in FIG. 20B. The magazine unit 240 is retracted in the −Z direction. In the magazine unit 240, the magazine unit drive cam roller 246 is engaged with the magazine unit drive cam groove 240*ag* of the magazine unit drive cam 240*a* (not illustrated) that rotates about the drive camshaft 230*b*1, and when the magazine unit drive cam roller 246 moves following the magazine unit drive cam groove 240*ag* with the rotation of the magazine unit drive cam 240*a*, the magazine unit 240 moves to the retracted position as illustrated in FIG. 20C. The magazine unit 240 moves in a manner of rotating about the magazine unit swing fulcrum 249. The clincher unit 230 and the magazine unit 240 are retracted by the clincher unit drive cam 230*a* and the magazine unit drive cam 240*a*. In the state illustrated in FIG. 20C, the opening 210*a* of the rotator 210 is closed relative to the wall 282 viewed from the X direction. Accordingly, the object to be bound 60 is present in a space closed by the opening 210*a* of the rotator 210 and the wall 282.

Figure 20D:
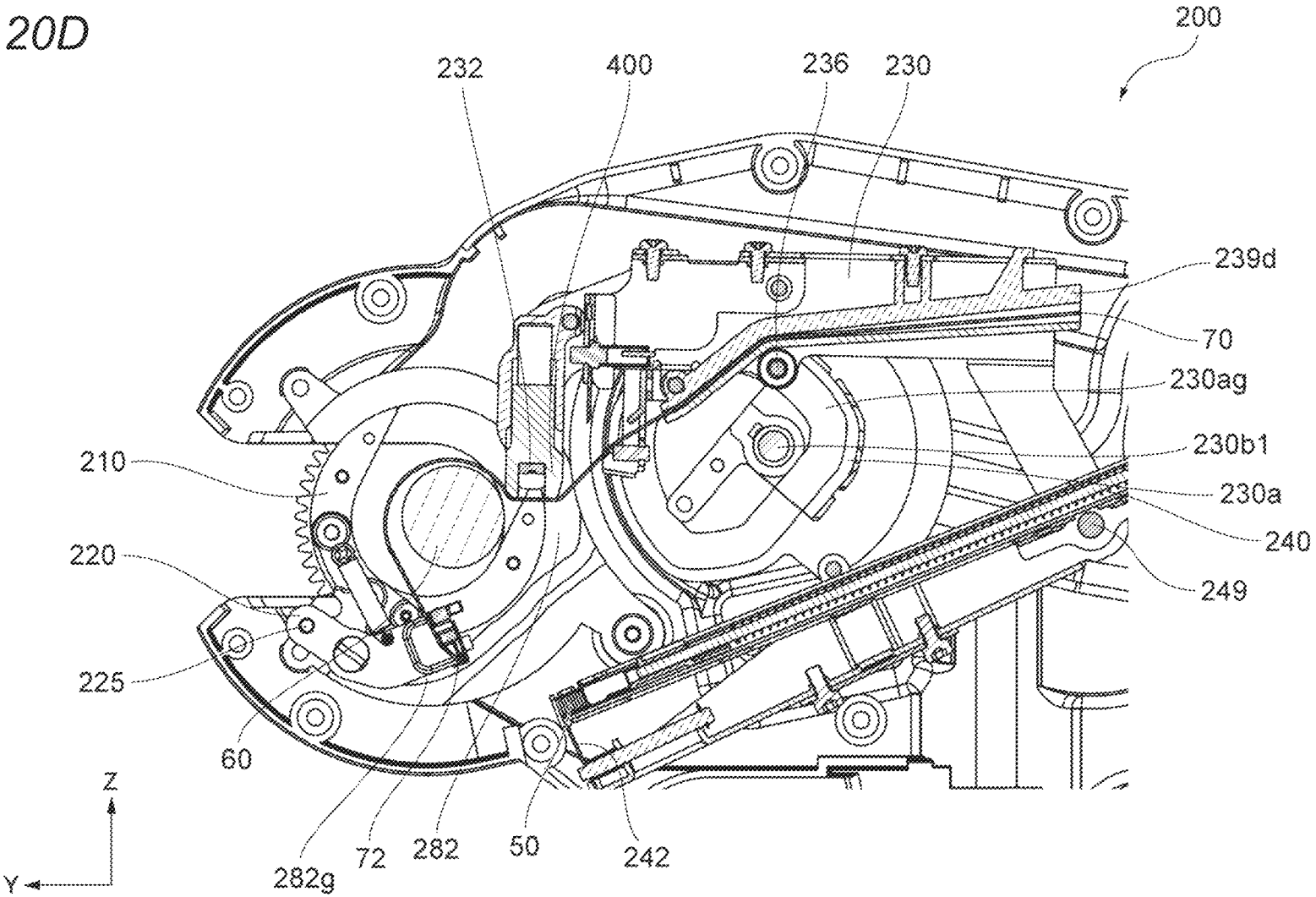
FIG. 20D is a sectional view of the binding machine body 200 according to the present embodiment viewed from the −X direction.

FIG. 20D illustrates a state in which the rotator 210 further rotates counterclockwise from the state illustrated in FIG. 20C. As illustrated in FIG. 20D, the tape holder 220 moves in a circumferential direction around the object to be bound 60 by 180 degrees or more from the state illustrated in FIG. 20A. As illustrated in FIG. 20D, the object to be bound 60 is surrounded by the tape 70 by about a semicircle viewed in a Y-Z section. The engager 225 of the tape holder 220 engages with one end of the groove 282*g* of the wall 282. The clincher unit 230 further moves in the −Z direction from the state illustrated in FIG. 20C and approaches the clinching position in which clinching is performed. In addition, the magazine unit 240 further relatively moves in the −Z direction to approach the retracted position from the state illustrated in FIG. 20C.

Figure 20E:
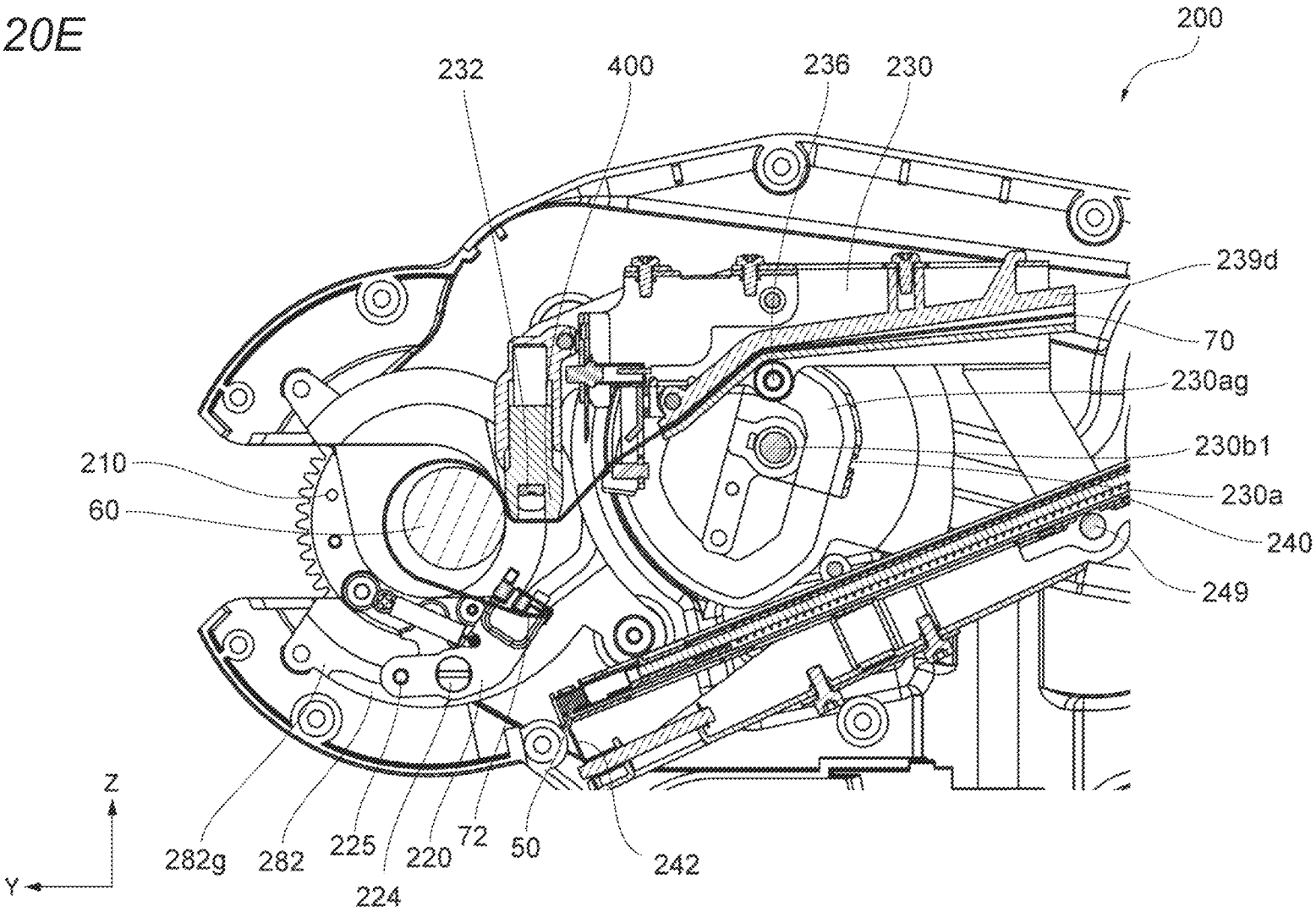
FIG. 20E is a sectional view of the binding machine body 200 according to the present embodiment viewed from the −X direction.

FIG. 20E illustrates a state in which the rotator 210 further rotates counterclockwise from the state illustrated in FIG. 20D. As illustrated in FIG. 20E, the object to be bound 60 is surrounded by the tape 70 by a part corresponding to ¾ of a circle in the Y-Z section. Since the engager 225 of the tape holder 220 engages with one end of the groove 282*g* of the wall 282, the tape holder 220 moves while rotating about the tape holder rotation center 224. The clincher unit 230 further moves relatively in the −Z direction from the state illustrated in FIG. 20D, while the magazine unit 240 hardly moves.

Figure 20F:
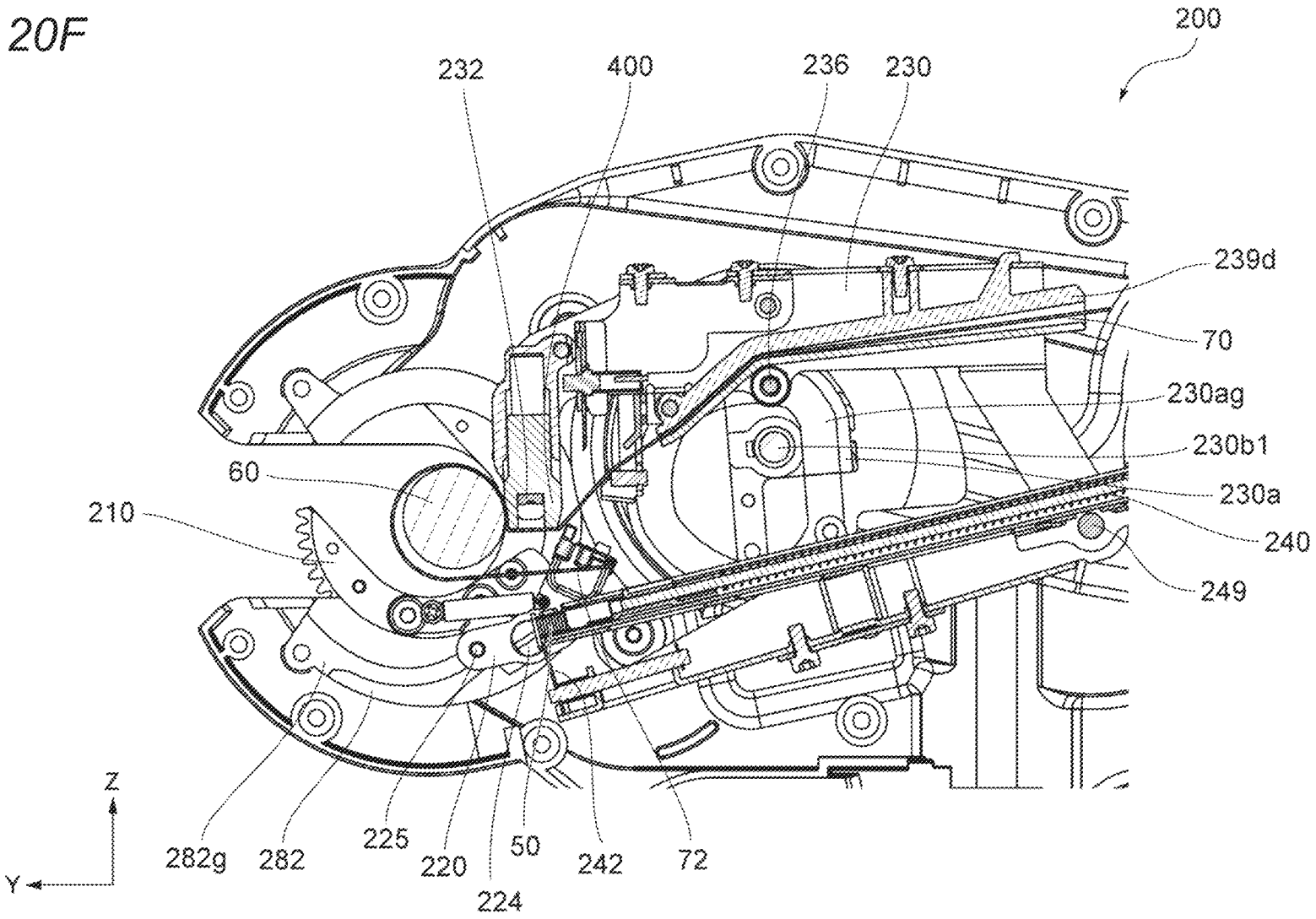
FIG. 20F is a sectional view of the binding machine body 200 according to the present embodiment viewed from the −X direction.

As illustrated in FIG. 20F, as the rotator 210 further rotates and the engager 225 of the tape holder 220 moves along the groove 282*g*, a part (part at which the claws 222*a* and 222*b* and the like are provided) of the tape holder 220 that holds the end of the tape 70 moves radially outward relative to the rotator 210 (corresponding to the second movement state in the present embodiment). Further, a part of the tape holder 220 at which the engager 225 for the tape 70 is provided moves radially inward relative to the rotator 210. As illustrated in FIG. 20F, a part corresponding to ¾ of a circle or more of an outer periphery of the object to be bound 60 is surrounded by the tape 70 viewed from the X direction. The clincher unit 230 further moves relatively in the −Z direction from the state illustrated in FIG. 20E. The magazine unit 240 relatively moves in the +Z direction toward the clinching position.

Figure 20G:
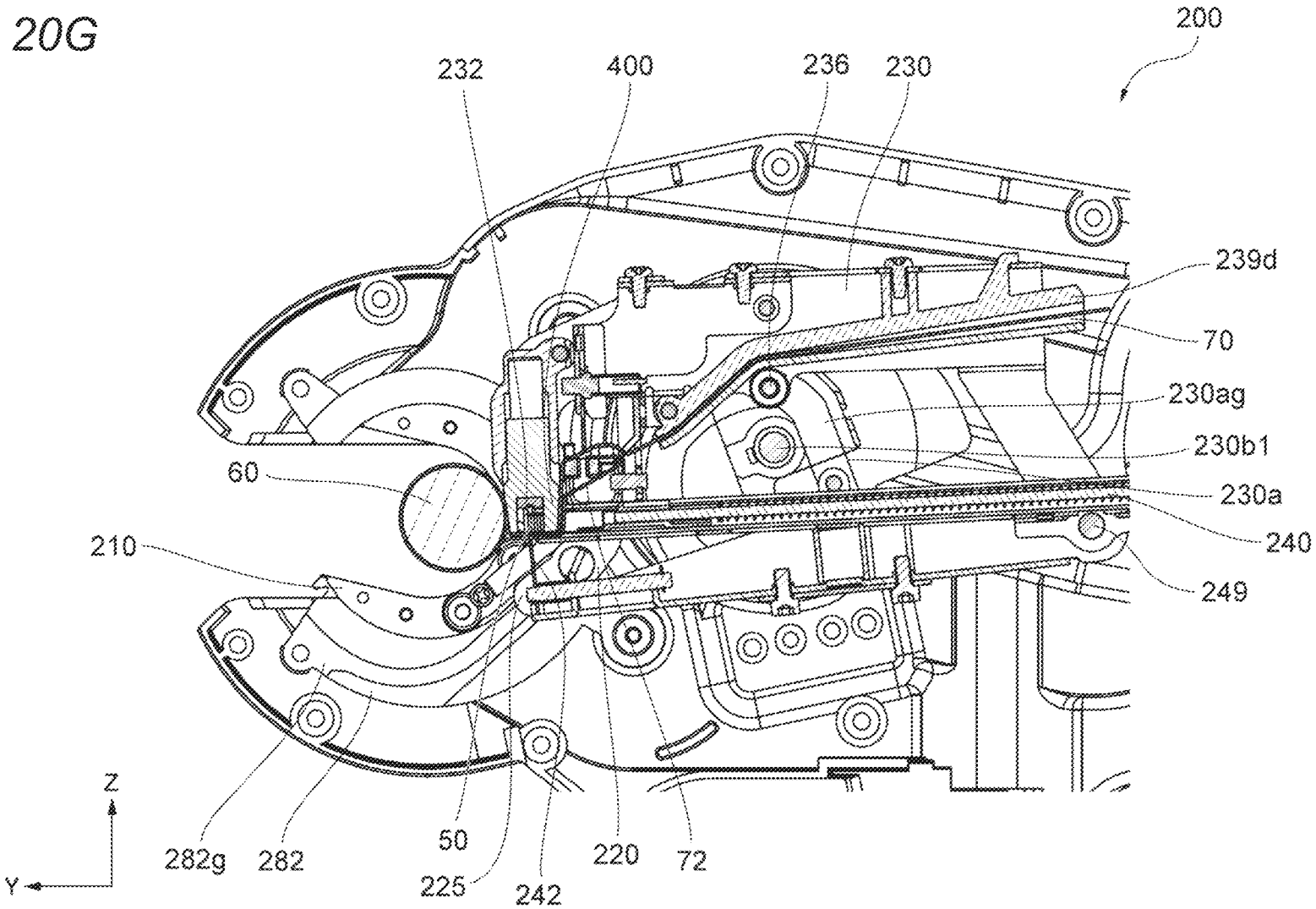
FIG. 20G is a sectional view of the binding machine body 200 according to the present embodiment viewed from the −X direction.

As illustrated in FIG. 20G, the tape holder 220 further moves counterclockwise, and the object to be bound 60 is surrounded by the tape 70. The clincher unit 230 moves relatively in the −Z direction, the magazine unit 240 moves relatively in the +Z direction, and both approach each other via the tape 70. At this time, the tape holder 220 is located on a −Y direction side relative to the clincher 232 of the clincher unit 230. In this way, in the present embodiment, the tape holder 220 moves to the −Y direction side relative to the clincher 232 when the clincher unit 230 and the magazine unit 240 retract in the +Z direction and the −Z direction, respectively (that is, when clinching is not performed). When the clincher unit 230 and the magazine unit 240 move toward the clinching position and clinching is performed, the tape holder 220 is located on the −Y direction side relative to the clincher 232. In this way, it is possible to clinch a vicinity of an end of the tape 70 drawn out to a vicinity of the clinching position and the end of the tape 70 held by the tape holder 220.

At this time, the rotator 210 is located such that the opening 210*a* is on the +Y direction side. The opening 282*a* of the wall 282 is also opened on the +Y direction side, and thus the opening 210*a* of the rotator 210 is not closed. Thereafter, the rotator 210 stops until the clinching is completed. The rotator 210 stops using an intermittent gear to be described later. By stopping the rotator 210, movement of the tape 70 can be prevented, and the clinching can be stably performed. Even after the clinching is performed, the tape holder 220 does not move until the rotator 210 restarts rotation. Accordingly, the clincher unit 230 can start retraction during that time. Accordingly, a movement path of the tape holder 220, which starts movement thereafter, can be prevented from being interfered by the clincher unit 230.

Figure 20H:
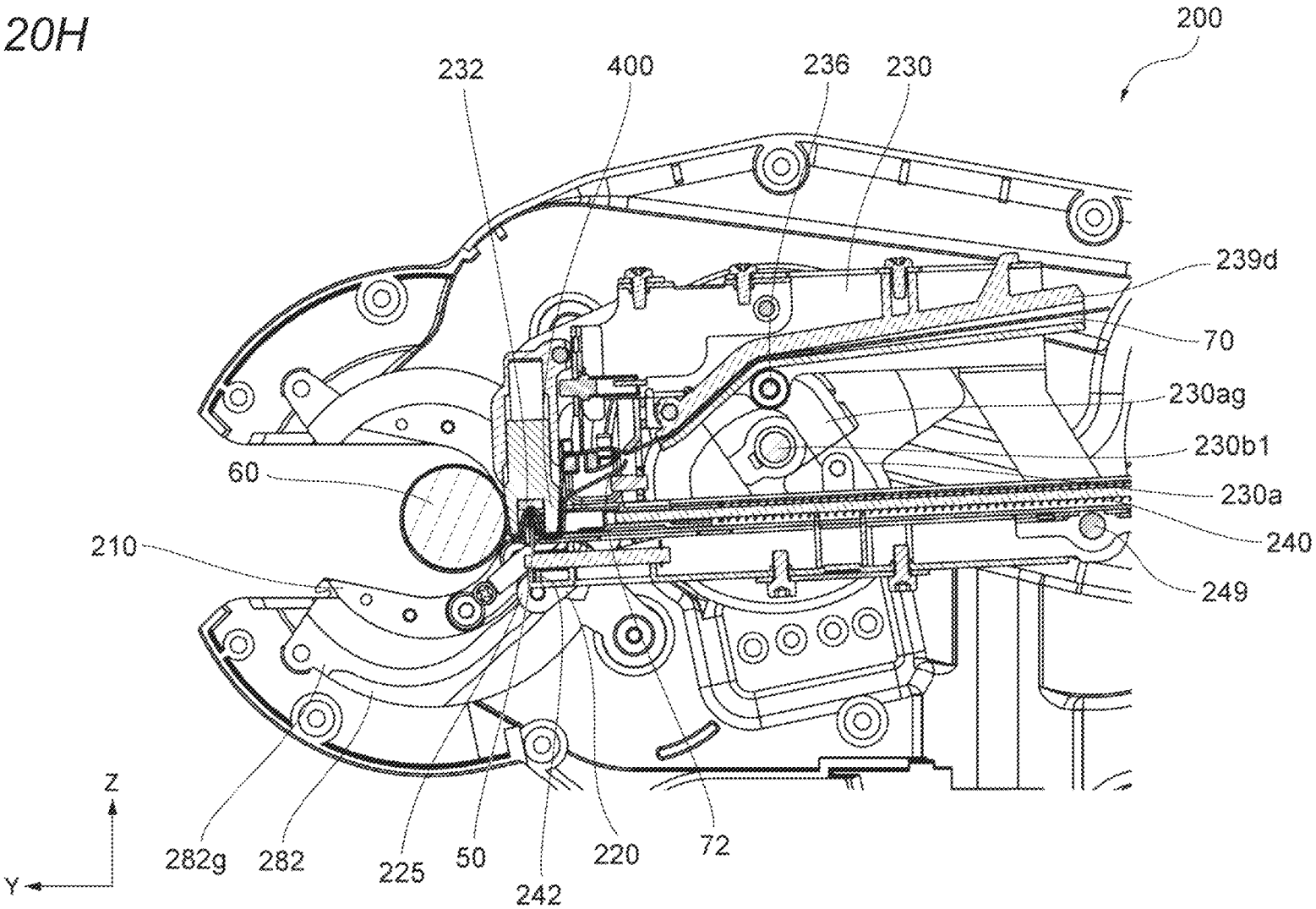
FIG. 20H is a sectional view of the binding machine body 200 according to the present embodiment viewed from the −X direction.
Figure 20I:
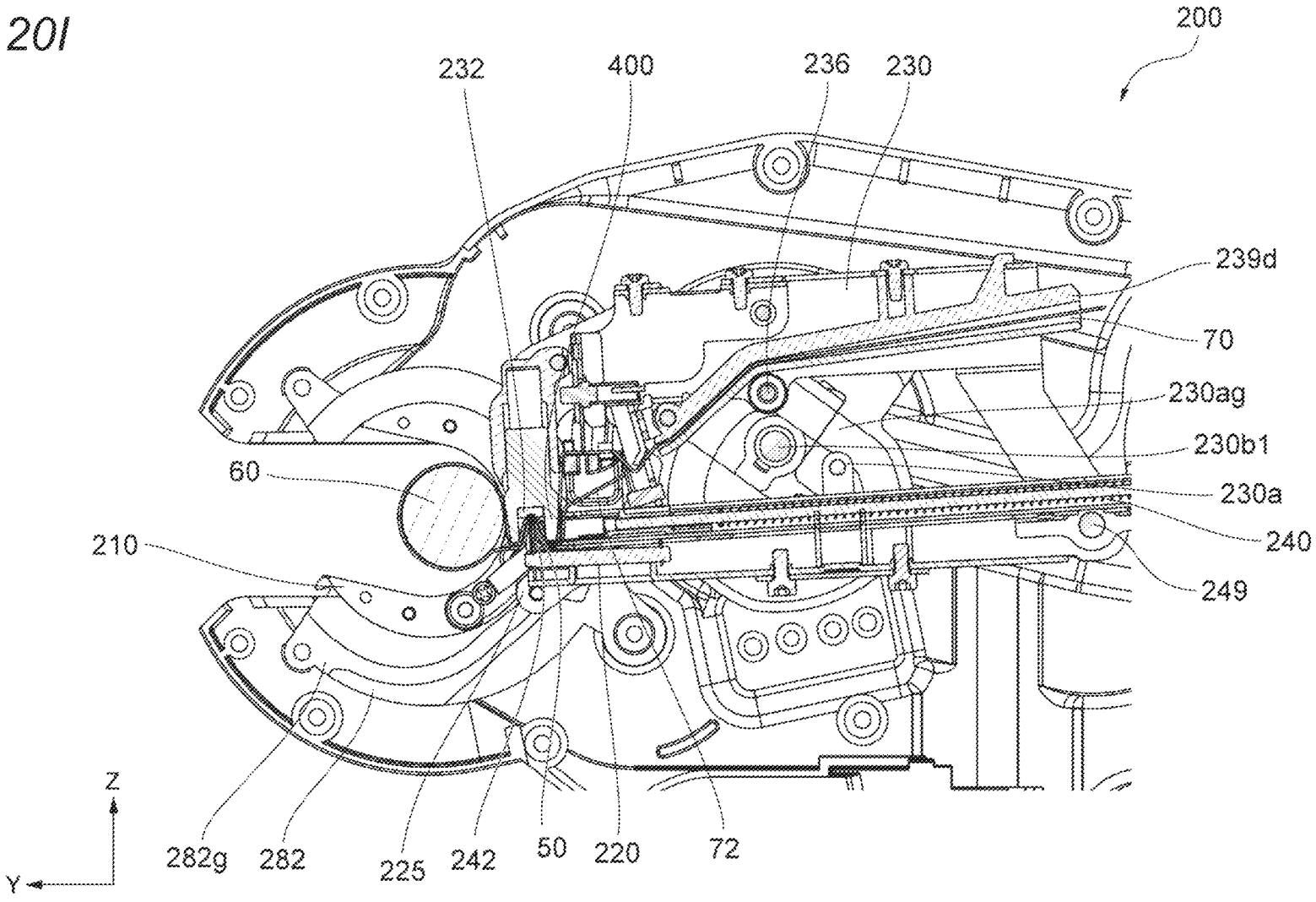
FIG. 20I is a sectional view of the binding machine body 200 according to the present embodiment viewed from the −X direction.

As illustrated in FIG. 20H, subsequently, the rotator 210 slightly moves counterclockwise, and the tape holder 220 further moves in the +Z direction and then stops. Thereafter, clinching is performed in a state in which the rotator 210 and the tape holder 220 are stopped. As illustrated in FIG. 20H, the driver 242 relatively ascends in the +Z direction and approaches the clincher 232 via a part where the tape 70 is overlapped. Here, a position in which the clincher 232 and the driver 242 are close to each other is the clinching position. During the transition from the state illustrated in FIG. 20G to the state illustrated in FIG. 20H, the clincher unit 230 moves in the −Z direction away from the clinching position.

As described above with reference to FIG. 20G and the like, when the clinching is performed, the tape holder 220 is located in the −Y direction relative to the clincher 232 since the ends of the tape 70 are clamped by the clincher 232 and the driver 242. At this time, the object to be bound 60 may also be surrounded by the tape holder 220 circulating with a distance from the rotation center axis of the rotator 210 as a rotation radius of the tape holder 220. However, the rotation radius is relatively large in such a configuration, and thus the entire binding machine 100 is large. As in the present embodiment, a diameter of the movement path of the tape holder 220 can be reduced by making the tape holder 220 that holds the end of the tape 70 to be radially movable in the rotation of the rotator 210. Accordingly, for example, the binding machine 100 can be downsized. In the present embodiment, in this way, the tape holder 220 swings after surrounding the object to be bound 60. Further, with this configuration, the tape 70 that is wound around the object to be bound 60 can be pulled in the −Y direction with the object to be bound 60 as a fulcrum, and thus slack that may occur in the tape 70 can be prevented.

Further, as illustrated in FIG. 201, the clincher 232 descends and the part where the tape 70 is overlapped is pressed via the staple 50 from above and below in the Z direction in the state in which the rotator 210 and the tape holder 220 are stopped, so that the pair of legs of the staple 50 are bent and the part where the tape 70 is overlapped is fixed.

Figure 20J:
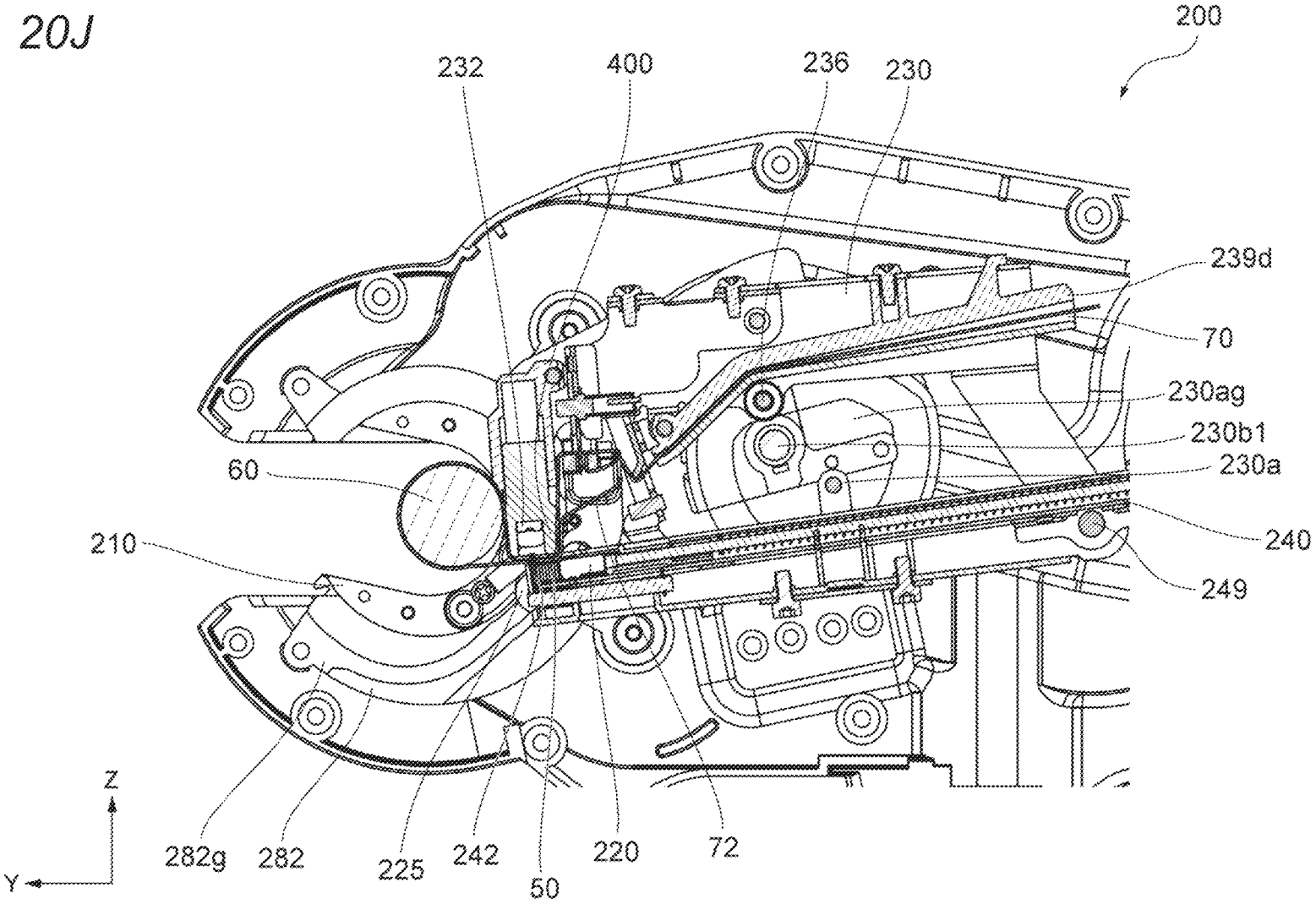
FIG. 20J is a sectional view of the binding machine body 200 according to the present embodiment viewed from the −X direction.

Next, as illustrated in FIG. 20J, when the clincher unit 230 and the magazine unit 240 are relatively lowered in the −Z direction, the cutting blade 238 of the clincher unit 230 descends and cuts the tape 70 held by the tape holder 220. The cutting blade 238 cuts the tape 70 by passing through the cutting blade passage slit 229 provided in the tape holder 220.

By the method described above, the clinching process is performed by the binding machine 100 according to the present embodiment.

In the present embodiment, the tape holder 220 may start holding the tape to be used for the next binding after the held tape 70 is released by the tape holding releaser 310 and before the tape 70 is cut by the cutting blade 238. That is, after a first end holding state, in which the first end that is an end of the tape 70 is held, is released by the tape holding releaser 310, the tape holder 220 may hold an end (third end) that is one end of a second part (that is, a part of the tape 70 used for the next binding) of the tape 70 that is a part adjacent to a first part of the tape 70 where binding is completed along a feeding direction of the tape. In addition, the cutting blade 238 may cut the tape 70 such that the first part (part used for a previous binding) of the tape 70 where the binding is completed is separated from the second part used for the next binding after the tape holder 220 holds the end (third end) of the tape 70 used for the next binding.

For example, when the tape 70 is cut before the third end of the tape 70 is held, a position of the third end may not be determined, or the third end may return toward the tape reel 800. Accordingly, the tape holder 220 may fail to hold the third end. In the present embodiment, the tape 70 is cut after the third end is held, and thus the third end can be reliably held and shift to a binding operation in a next binding position. In the present embodiment, the tape holder 220 holds the tape 70 from the lateral direction of the tape 70 using the claws 222*a* and 222*b*. Accordingly, in the present embodiment, the tape holder 220 can also grasp the tape 70 before cutting.

Figure 21A:
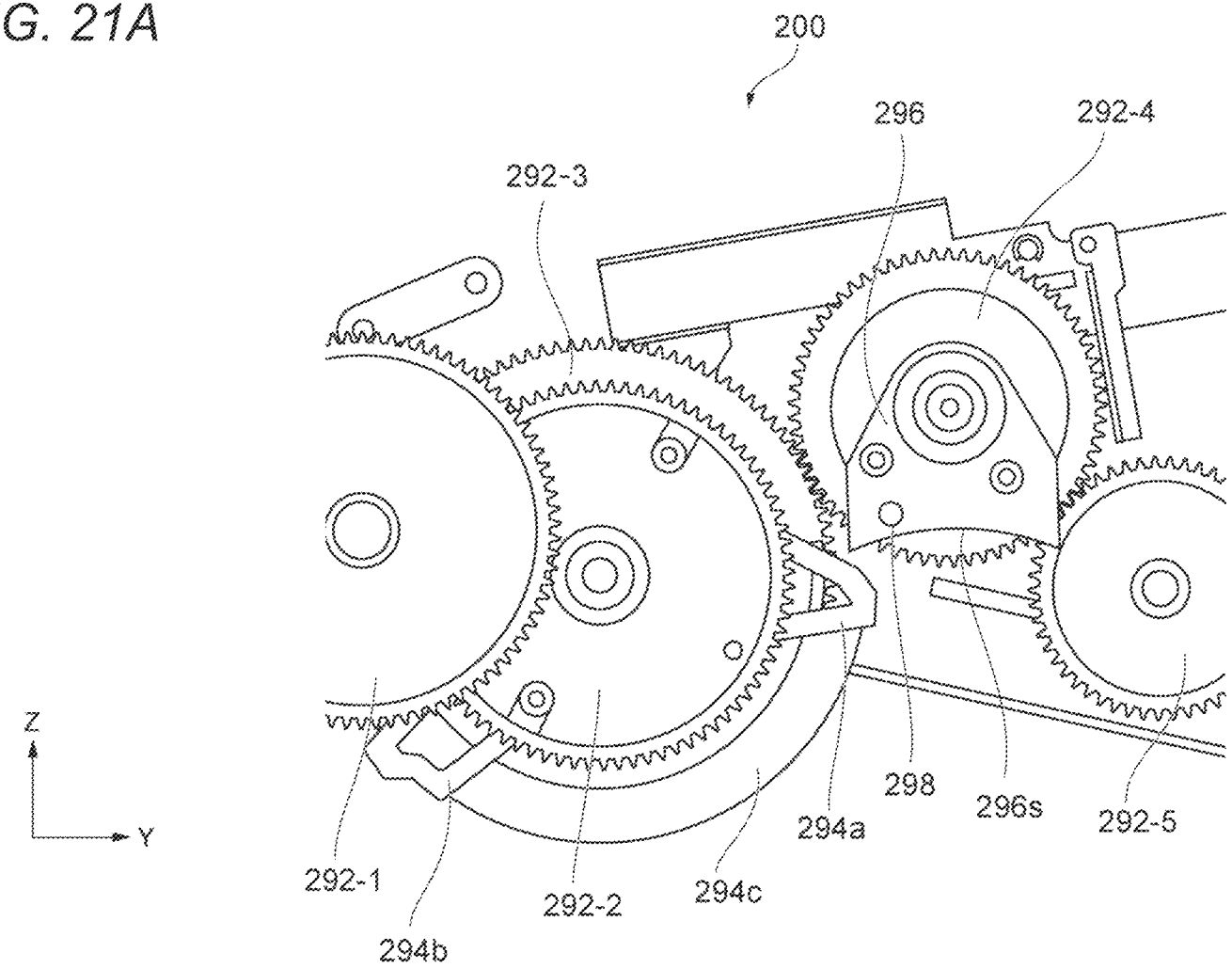
FIG. 21A illustrates the binding machine 100 according to the present embodiment viewed from a +X direction.
Figure 21B:
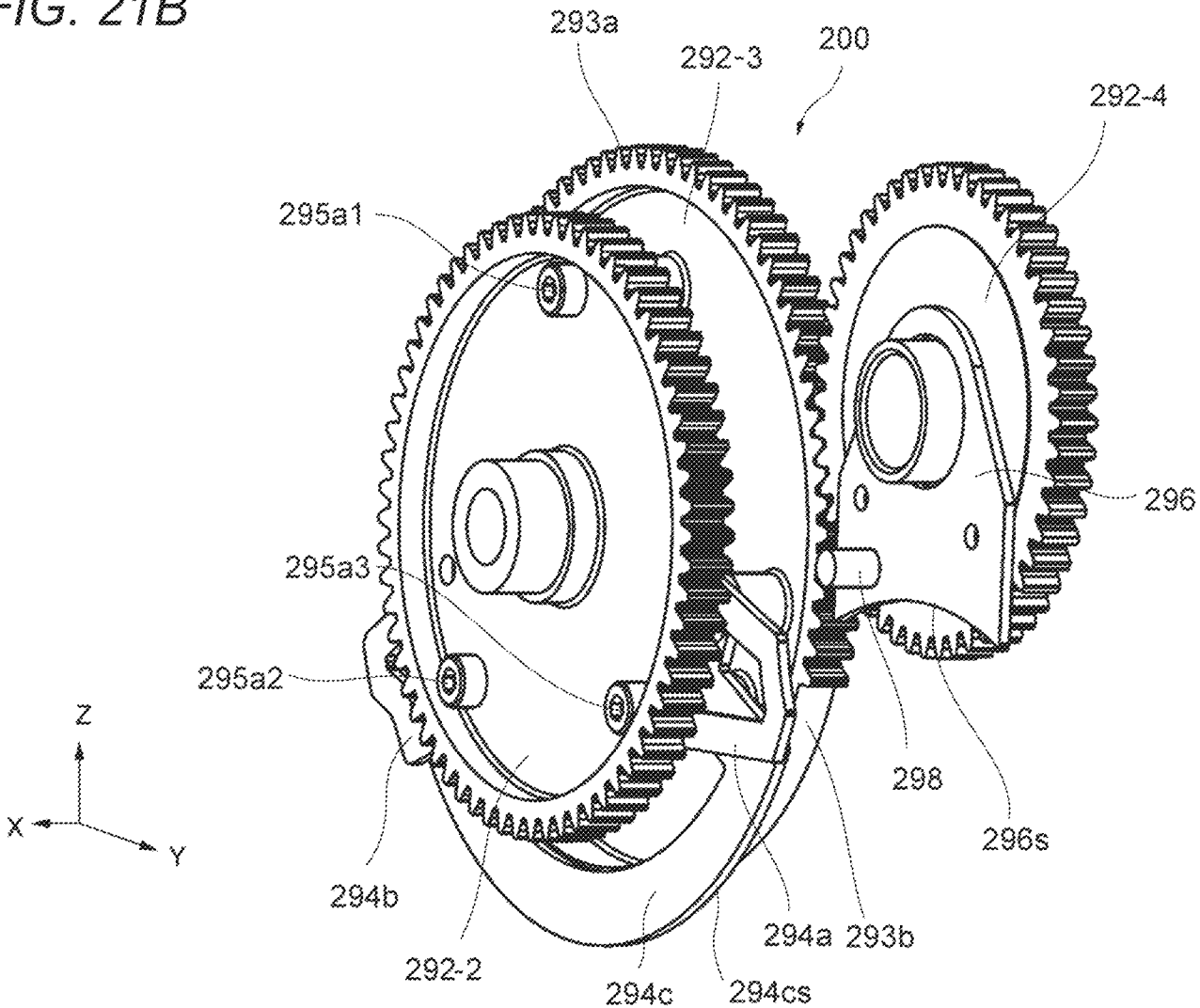
FIG. 21B illustrates a gear train 292 provided in the binding machine 100 according to the present embodiment viewed obliquely from a front side in a +Y direction.

Next, a configuration that restricts rotation and stop of rotation of the rotator 210 by an intermittent gear according to the present embodiment will be described with reference to FIGS. 21A to 21J. First, the configuration of the intermittent gear according to the present embodiment will be described with reference to FIGS. 21A and 21B. FIG. 21A illustrates the binding machine 100 according to the present embodiment viewed from the +X direction. FIG. 21A illustrates the gears 292-1, 292-2, 292-3, 292-4 (corresponding to a first gear in the present embodiment), and 292-5 of the gear train 292 provided in the binding machine 100. FIG. 21B illustrates the gears 292-2, 292-3, and 292-4 of the gear train 292 provided in the binding machine 100 according to the present embodiment viewed obliquely from the front side in the +Y direction. Although not illustrated in FIGS. 21A and 21B, in the present embodiment, the gear 292-1 or another gear upstream of the gear 292-1 is connected to the drive motor 250.

In the present embodiment, the gear 292-5 illustrated in FIG. 21A meshes with the teeth 210*t* of the rotator 210. As illustrated in FIG. 21B, the gears 292-2 and 292-3 are fixed to each other by fixing members 295*a*1, 295*a*2, and 295*a*3. Accordingly, the gears 292-2 and 292-3 rotate integrally about the same rotation center shaft. First, a driving force is transmitted from the gear 292-1 to the gear 292-2. Further, the driving force is transmitted from the gear 292-3 rotating integrally with the gear 292-2 to the gear 292-4, and from the gear 292-4 to the gear 292-5.

As illustrated in FIG. 21B, the gear 292-3 (corresponding to a second gear in the present embodiment) is provided with a tooth part 293*a* provided with teeth and a tooth missing part 293*b* not provided with teeth on an outer peripheral surface thereof. That is, the gear 292-3 is an intermittent gear. A pair of assist plates 294*a* and 294*b* are provided between the gears 292-2 and 292-3. The assist plates 294*a* and 294*b* are provided respectively in a vicinity of one end and the other end of the tooth missing part 293*b*. An arc-shaped restricting member 294*c* is provided between the assist plates 294*a* and 294*b* along a circumferential direction. As illustrated in FIG. 21B, the restricting member 294*c* corresponds to a part of the gear 292-3 where the tooth missing part 293*b* is provided.

In FIG. 21A, the gear 292-3 rotates counterclockwise viewed from the −X direction (that is, viewed in a direction perpendicular to a paper surface from a front side of the paper surface in FIG. 21A). Accordingly, in the gear 292-3, a counterclockwise downstream side is a downstream side in a rotation direction, and a counterclockwise upstream side is an upstream side in the rotation direction. The assist plate 294*a* is located in a vicinity of as well as downstream of the one end of the tooth missing part 293*b* in the rotation direction. That is, in the rotation direction of the gear 292-3, the assist plate 294*a* is provided, in a vicinity of a boundary between the tooth part 293*a* and the tooth missing part 293*b* in which the tooth part 293*a* is on the downstream side in the rotation direction and the tooth missing part 293*b* is on the upstream side in the rotation direction, on the downstream side in the rotation direction of the boundary. In the rotation direction of the gear 292-3, the assist plate 294*b* is provided, in a vicinity of a boundary between the tooth part 293*a* and the tooth missing part 293*b* in which the tooth part 293*a* is on the upstream side in the rotation direction and the tooth missing part 293*b* is on the downstream side in the rotation direction, on the downstream side in the rotation direction of the boundary. The gear 292-4 is provided with a restricting member 296. The restricting member 296 has a restricting peripheral surface 296*s* having an arc-shaped section (section perpendicular to the X direction). The restricting member 296 includes an abutment pin 298 on a +X direction side.

The restricting peripheral surface 296*s* of the restricting member 296 has an arc shape having the same radius as an outer peripheral surface 294*cs* of the restricting member 294*c* provided between the gears 292-2 and 292-3. The restricting member 294*c* rotates integrally with the gears 292-2 and 292-3. Accordingly, when the gears 292-2 and 292-3 rotate, the outer peripheral surface 294*cs* of the restricting member 294*c* abuts against the restricting peripheral surface 296*s* in a part of one rotation. Further, since the restricting member 294*c* is provided at a part of the gear 292-3 at which the tooth missing part 293*b* is provided, when the outer peripheral surface 294*cs* of the restricting member 294*c* abuts against the restricting peripheral surface 296*s*, the part of the gear 292-3 at which the tooth missing part 293*b* is provided approaches the gear 292-4. For this reason, the gear 292-4, which is driven and rotated until the outer peripheral surface 294*cs* abuts against the restricting peripheral surface 296*s*, stops rotation when the outer peripheral surface 294*cs* abuts against the restricting peripheral surface 296*s*. This is because, when the outer peripheral surface 294*cs* does not abut against the restricting peripheral surface 296*s* of the restricting member 296, the restricting member 296 does not abut against other components and the gear 292-4 can rotate without being restricted from moving by the restricting member 296; when the outer peripheral surface 294*cs* abuts against the restricting peripheral surface 296*s* of the restricting member 296, the restricting member 296 is caught by the outer peripheral surface 294*cs* and is stopped from moving since the restricting peripheral surface 296*s* of the restricting member 296 has the same radius as the outer peripheral surface 294*cs*, and accordingly the gear 292-4 stops moving.

When the gear 292-3 continues to rotate and the abutment between the outer peripheral surface 294*cs* and the restricting peripheral surface 296*s* is released, the gear 292-4 restarts rotation. In the present embodiment, the assist plates 294*a* and 294*b* rotate integrally with the gears 292-2 and 292-3 that are driving side gears and the abutment pin 298 is provided on the restricting member 296, so that it is possible to prevent an impact when teeth at one end of the tooth part 293*a* of the gear 292-3 (teeth provided at the one end of the pair of ends of the tooth part 293*a* that is adjacent to the tooth missing part 293*b* on the downstream side in the rotation direction) mesh with teeth of the gear 292-4, which may occur when the gear 292-4 restarts rotation. It is also possible to prevent an impact when teeth of the other end of the tooth part 293*a* of the gear 292-3 (teeth provided at the end of the pair of ends of the tooth part 293*a* that is adjacent to the tooth missing part 293*b* on the upstream side in the rotation direction) is released from meshing with the teeth of the gear 292-4, which may occur when the gear 292-4 stops rotation. It is further possible to prevent an impact when the outer peripheral surface 294*cs* abuts against and is released from abutting against the restricting member 296. Restriction of rotation using the intermittent gear according to the present embodiment will be described below with reference to FIGS. 21C to 21J.

Figure 21C:
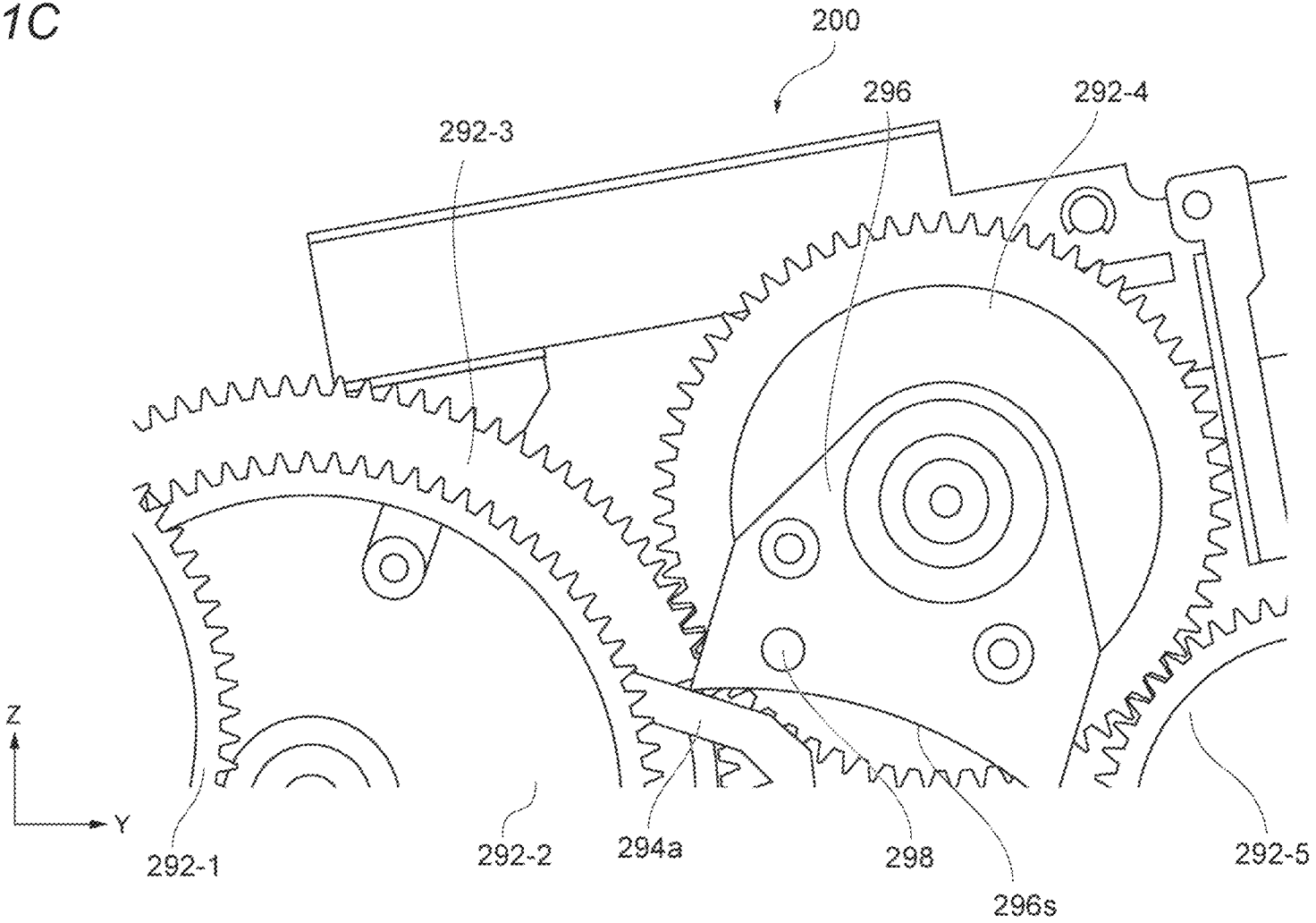
FIG. 21C illustrates the binding machine 100 according to the present embodiment viewed from the +X direction.

Referring to FIG. 21C, the gears 292-2 and 292-3 rotate counterclockwise in FIG. 21C, and the gear 292-4 rotates clockwise. As illustrated in FIG. 21C, the gear 292-3 rotates from the state illustrated in FIG. 21A, and the assist plate 294*a* moves in the +Z direction. Accordingly, thereafter, the outer peripheral surface 294*cs* of the restricting member 294*c* provided between the gears 292-2 and 292-3 engages with the restricting peripheral surface 296*s* immediately. As illustrated in FIG. 21C, the assist plate 294*a* abuts against the abutment pin 298 when the assist plate 294*a* continues to rotate.

Figure 21D:
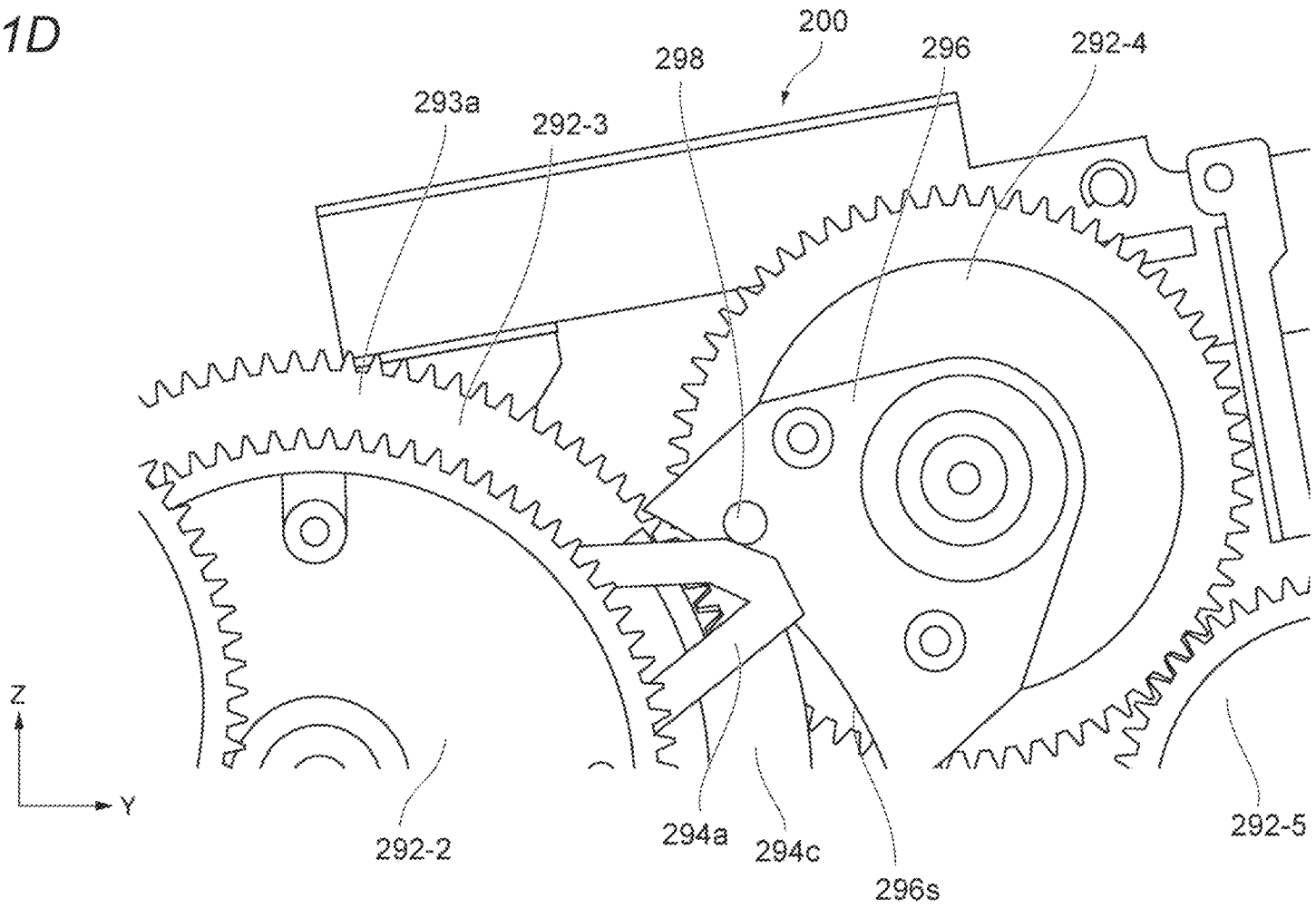
FIG. 21D illustrates the binding machine 100 according to the present embodiment viewed from the +X direction.

Next, as illustrated in FIG. 21D, the gear 292-3 rotates, and the assist plate 294*a* abuts against the abutment pin 298. As illustrated in FIG. 21D, the restricting peripheral surface 296*s* is not abutting against the outer peripheral surface 294*cs*. Accordingly, the assist plate 294*a* abuts against the abutment pin 298 before the restricting peripheral surface 296*s* abuts against the outer peripheral surface 294*cs*.

Figure 21E:
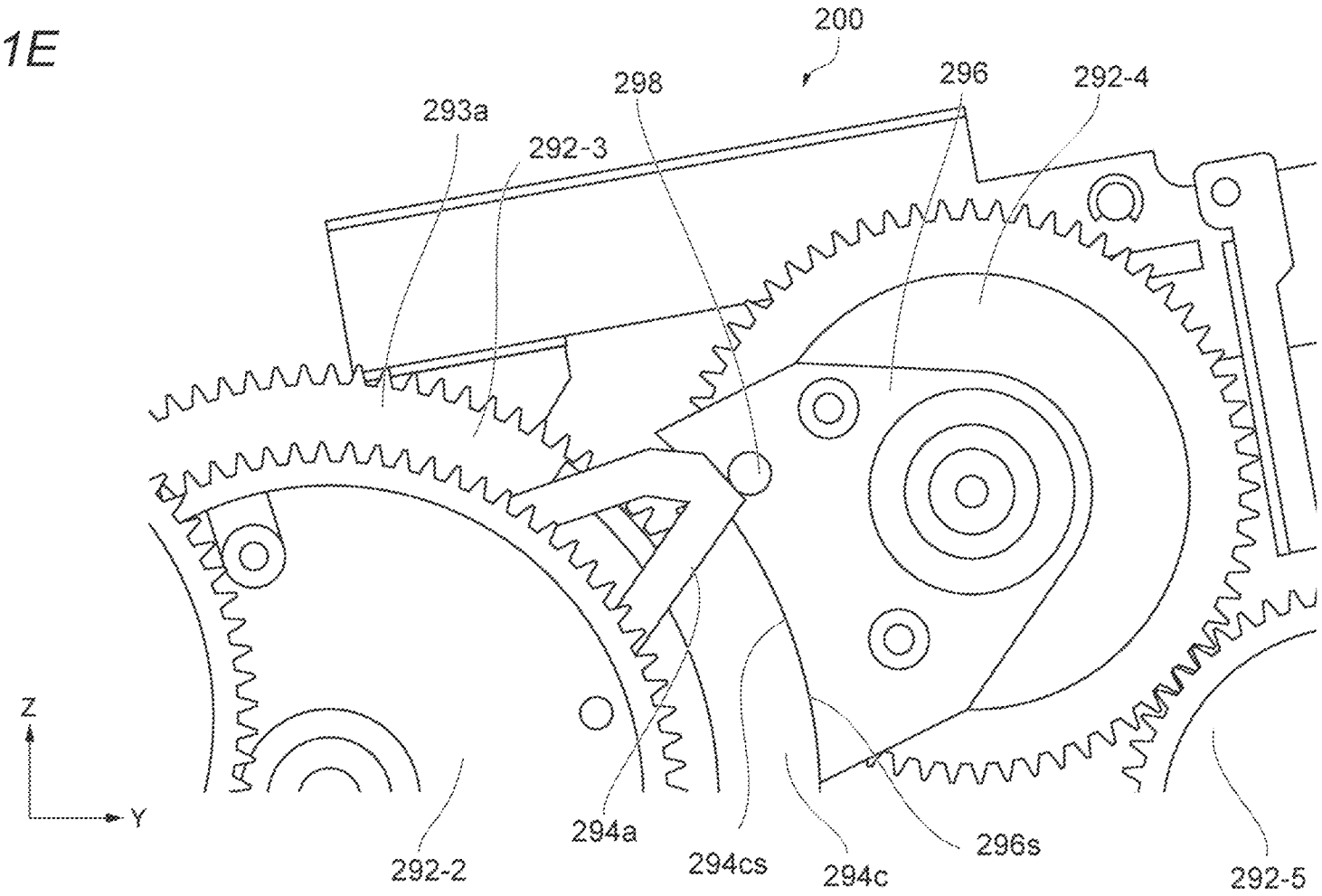
FIG. 21E illustrates the binding machine 100 according to the present embodiment viewed from the +X direction.

Thereafter, when the assist plate 294*a* further rotates, the abutment pin 298 is pressed in the rotation direction by the assist plate 294*a*, so that the restricting member 296 rotates clockwise in FIG. 21D, and the restricting peripheral surface 296*s* abuts against the outer peripheral surface 294*cs* as illustrated in FIG. 21E. As described above, the outer peripheral surface 294*cs* and the restricting peripheral surface 296*s* are formed in arc shapes having the same radius about the same point, and thus as illustrated in FIG. 21E, the restricting member 296 does not move relative to the outer peripheral surface 294*cs*. The restricting member 296 is fixed to the gear 292-4 to move integrally with the gear 292-4. Accordingly, the gear 292-4 is stopped when the restricting member 296 is stopped. Since the gear 292-5 that rotates the rotator 210 is driven by the gear 292-4, the gear 292-5 is stopped when the gear 292-4 is stopped, and the rotator 210 is stopped at the same time.

Figure 21F:
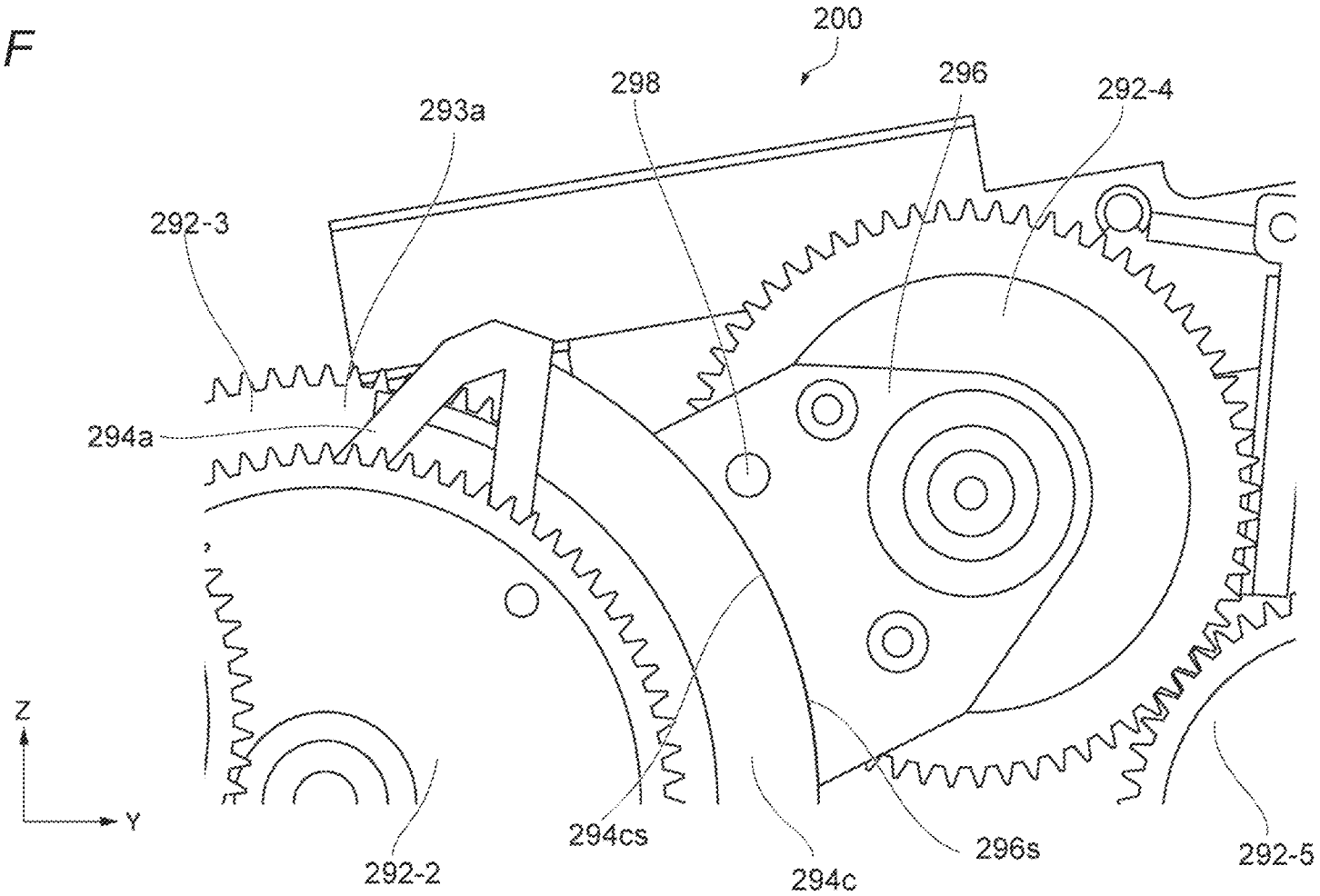
FIG. 21F illustrates the binding machine 100 according to the present embodiment viewed from the +X direction.

As illustrated in FIG. 21F, the gear 292-3 continues to rotate, and the outer peripheral surface 294*cs* and the restricting member 296 remain abutting against each other. During this period, the gear 292-4 stops.

Figure 21G:
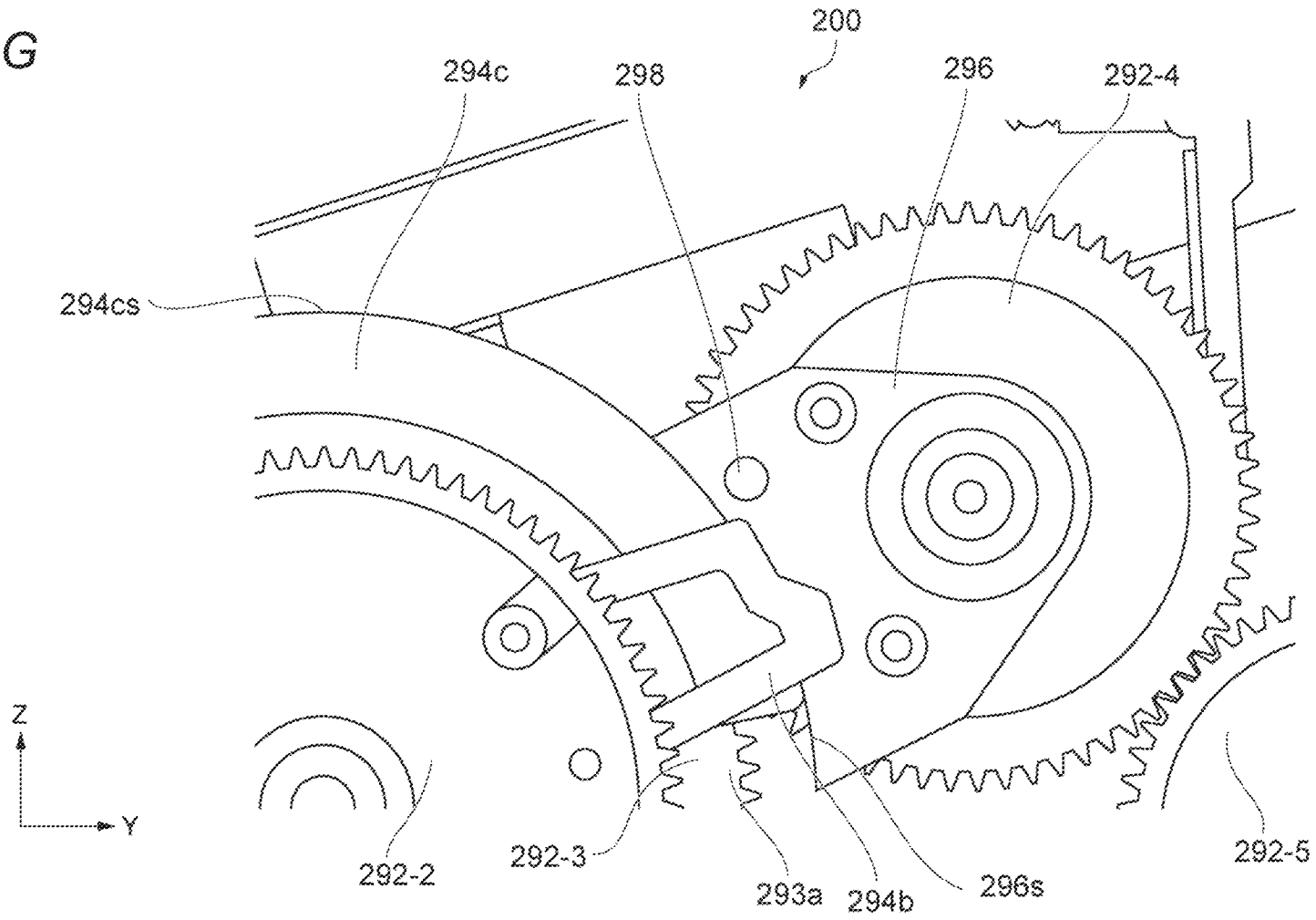
FIG. 21G illustrates the binding machine 100 according to the present embodiment viewed from the +X direction.

When the gear 292-3 further rotates, as illustrated in FIG. 21G, the tooth part 293*a* of the gear 292-3 moves in the +Z direction. The second assist plate 294*b* is provided forward of the tooth part 293*a* in the rotation direction (that is, on the downstream side in the rotation direction), and the second assist plate 294*b* also moves in the +Z direction.

Figure 21H:
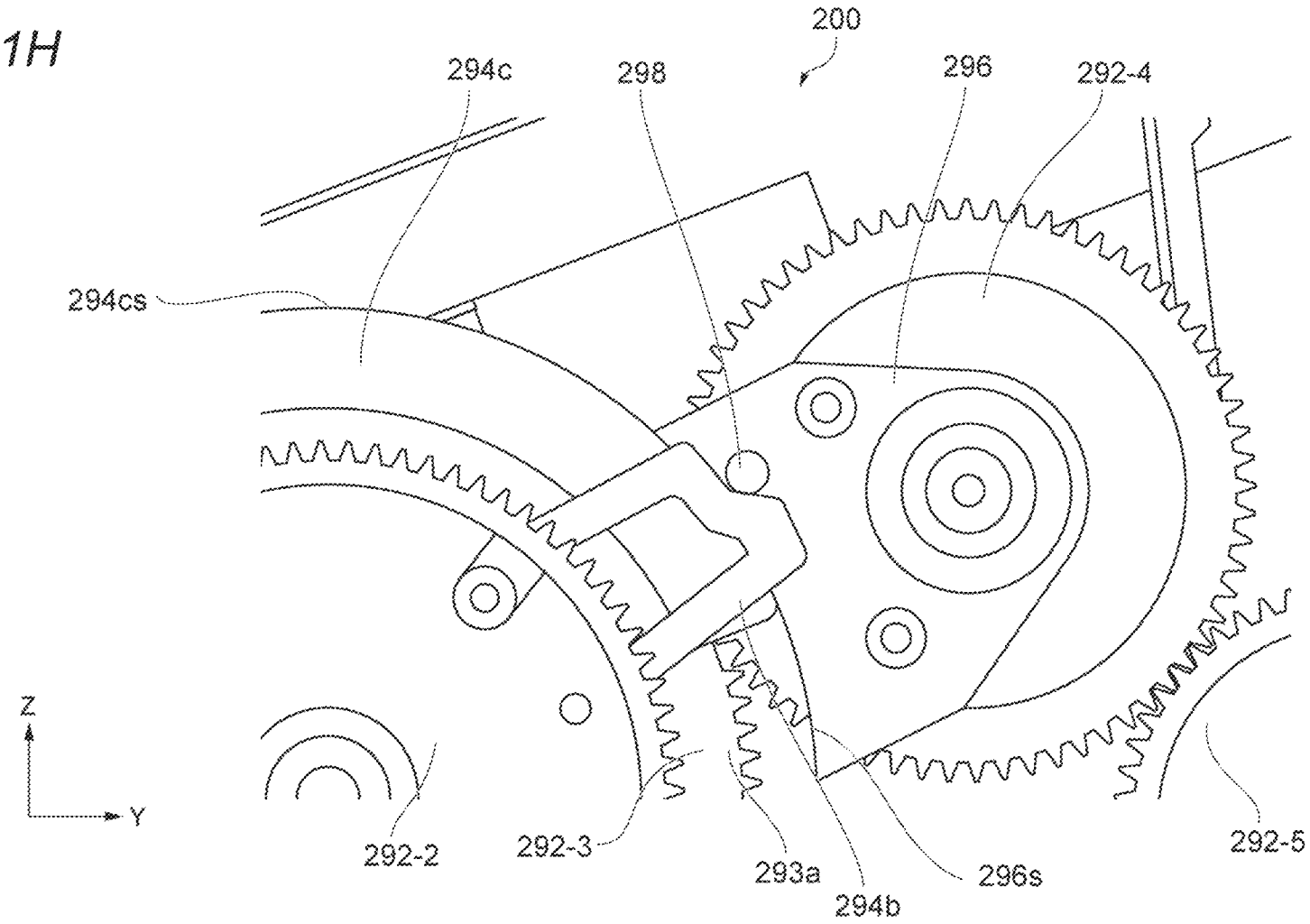
FIG. 21H illustrates the binding machine 100 according to the present embodiment viewed from the +X direction.
Figure 21I:
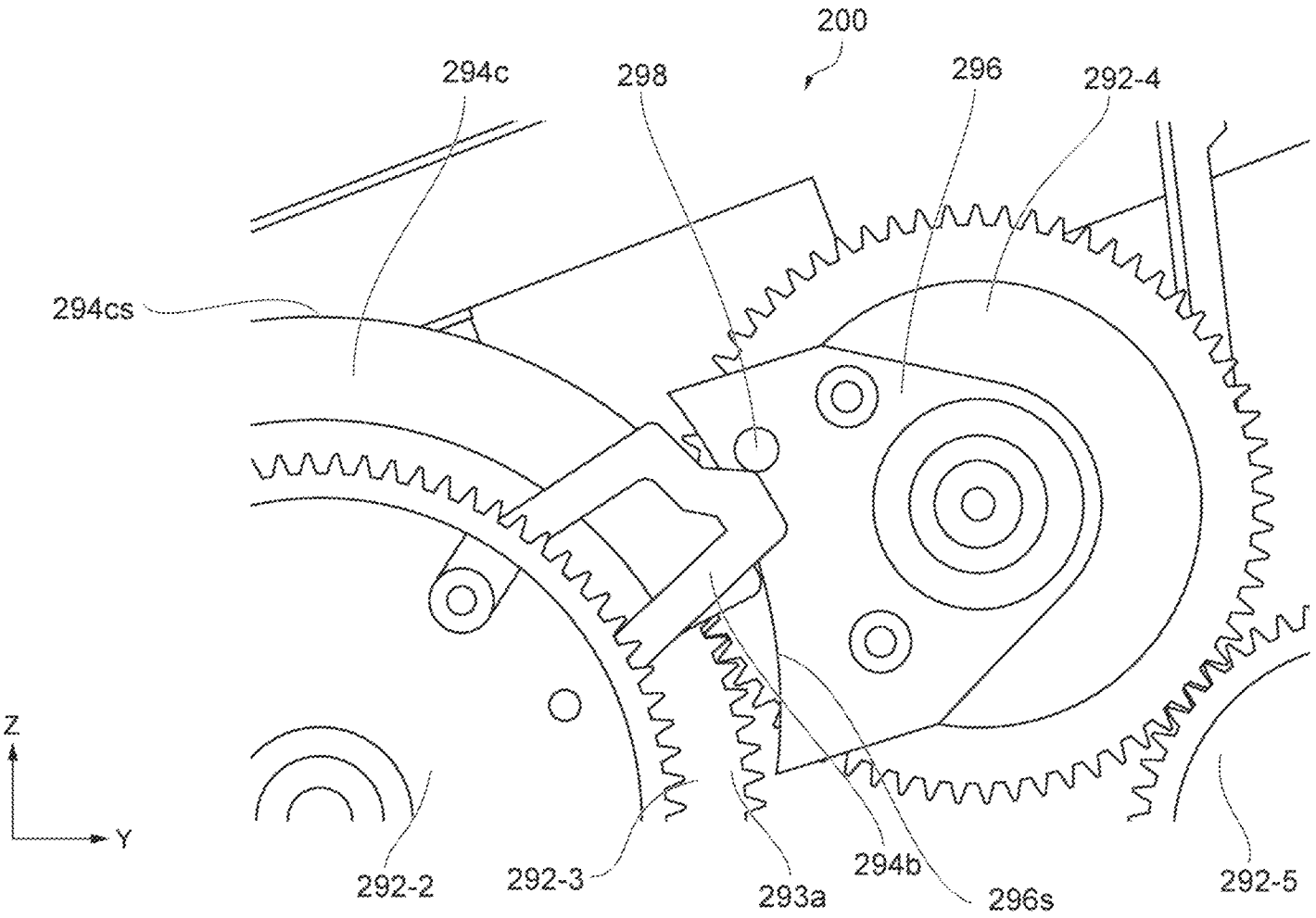
FIG. 21I illustrates the binding machine 100 according to the present embodiment viewed from the +X direction.

Thereafter, as illustrated in FIG. 21H, the gear 292-3 continues to rotate, and the second assist plate 294*b* abuts against the abutment pin 298. At this time, the teeth of the gear 292-4 are not meshed with the tooth part 293*a* of the gear 292-3.

When the gear 292-3 further rotates, as illustrated in FIG. 211, the abutment pin 298 is pressed in the rotation direction by the assist plate 294*b*, so that the restricting member 296 rotates clockwise. The teeth of the gear 292-4 start to mesh with the teeth 293*a* of the gear 292-3.

Figure 21J:
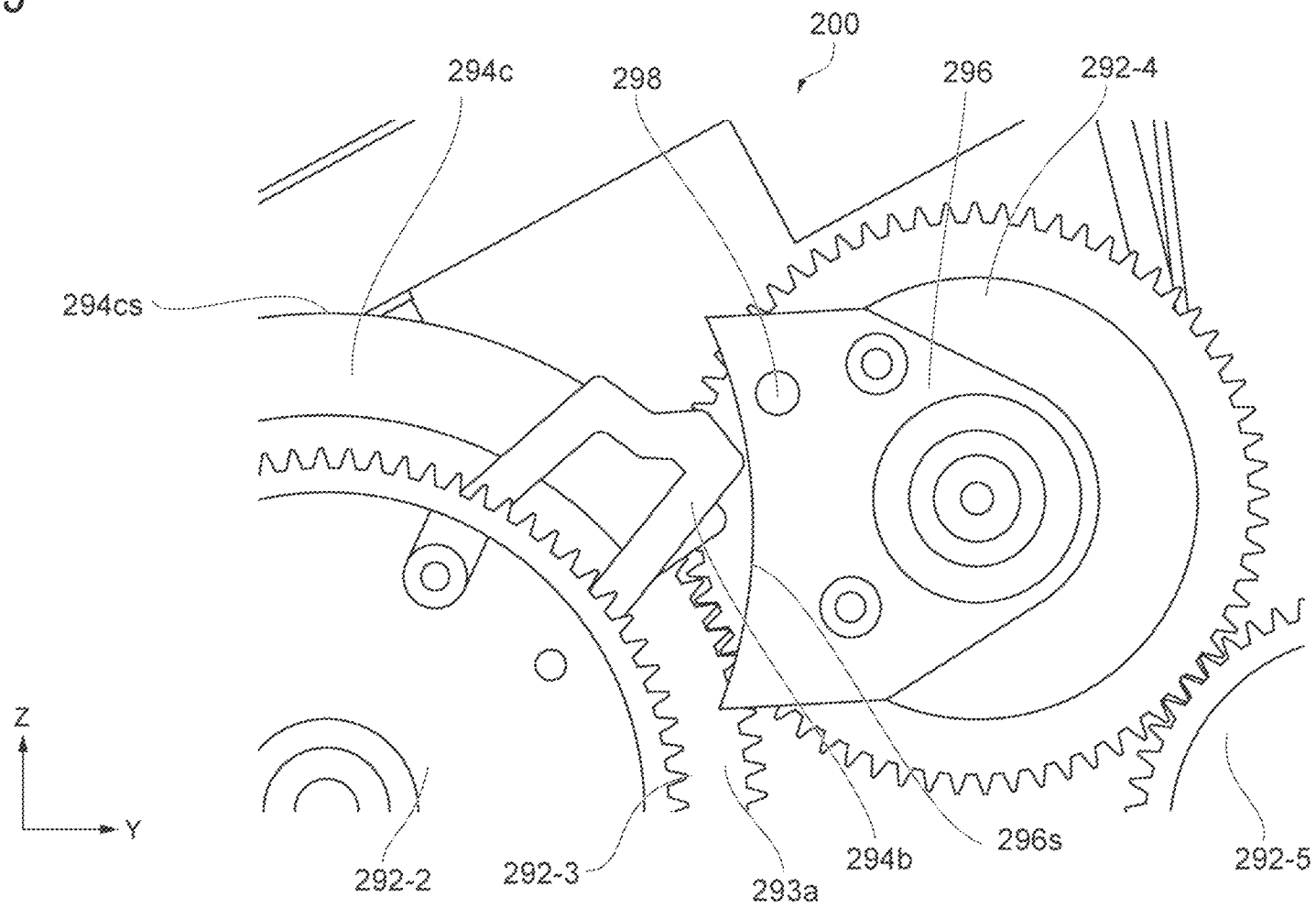
FIG. 21J illustrates the binding machine 100 according to the present embodiment viewed from the +X direction.

Thereafter, as illustrated in FIG. 21J, the assist plate 294*b* is separated from the abutment pin 298, and the gear 292-4 restarts rotation by the tooth part 293*a*. As the gear 292-4 restarts rotation, the gear 292-5 restarts rotation, and the rotator 210 rotates. As described above, in the binding machine 100 according to the present embodiment, the rotator 210 is stopped during clinching or the like and restarts rotation after the clinching operation is completed. In the present embodiment, rotation of the rotator 210 can be stopped and restarted by a mechanism using the intermittent gear described above with reference to FIGS. 21A to 21J.

In the present embodiment, the assist plate 294*a* abuts against the abutment pin 298 before the outer peripheral surface 294*cs* of the restricting member 294*c* provided between the gears 292-2 and 292-3 abuts against the restricting member 296. Further, the second assist plate 294*b* abuts against the abutment pin 298 before the tooth part 293*a* of the gear 292-3 meshes with the teeth of the gear 292-4. The inventors of the present invention found that, when the rotation of the rotator 210 is stopped and restarted by the intermittent gear and teeth of the two gears are disengaged, an impact load is applied to the gears, which may cause damage to the teeth of the gears. It is also found that when the teeth of two gears are meshed again, an impact load may be applied to the gears. In the present embodiment, since the first assist plate 294*a* and the abutment pin 298 are provided and abut against each other before the teeth of the two gears are disengaged, the impact load applied to the teeth can be reduced. In addition, since the second assist plate 294*b* abuts against the abutment pin 298 before the teeth of two gears are meshed again, the impact load when the teeth are meshed can also be reduced.

According to studies of the present inventors, it is considered that an impact generated when the teeth of two gears (gears 292-3 and 292-4) are meshed again is particularly large. Accordingly, it is considered that an impact prevention effect by the assist plate 294*b* abutting against the abutment pin 298 before the teeth of gears are meshed again is particularly large. Since the impact when the meshing of the teeth is released and the teeth are meshed again can be reduced, the teeth of the gears 292-3 and 292-4 can be made relatively small. Accordingly, the binding machine 100 can be downsized since relatively small gears can be used.

Figure 22A:
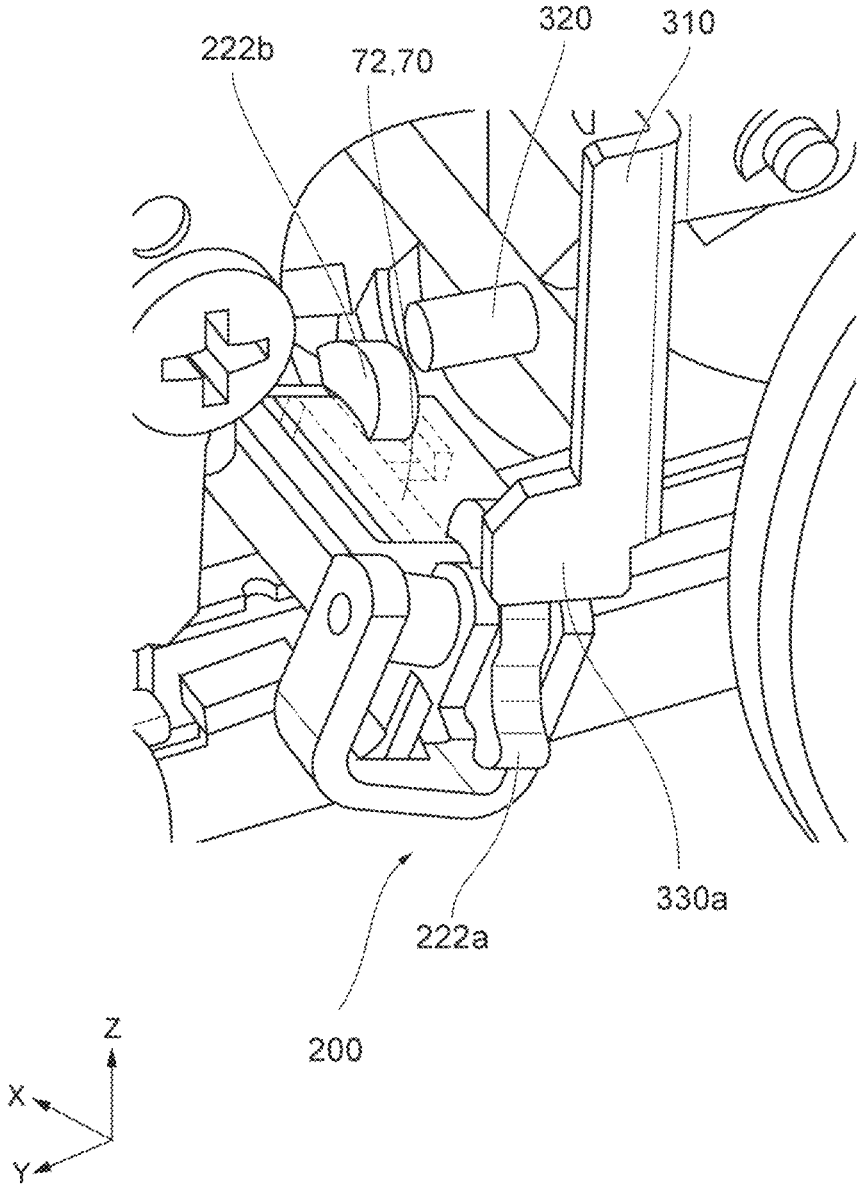
FIG. 22A is a perspective view of the tape holder 220 according to the present embodiment.
Figure 22B:
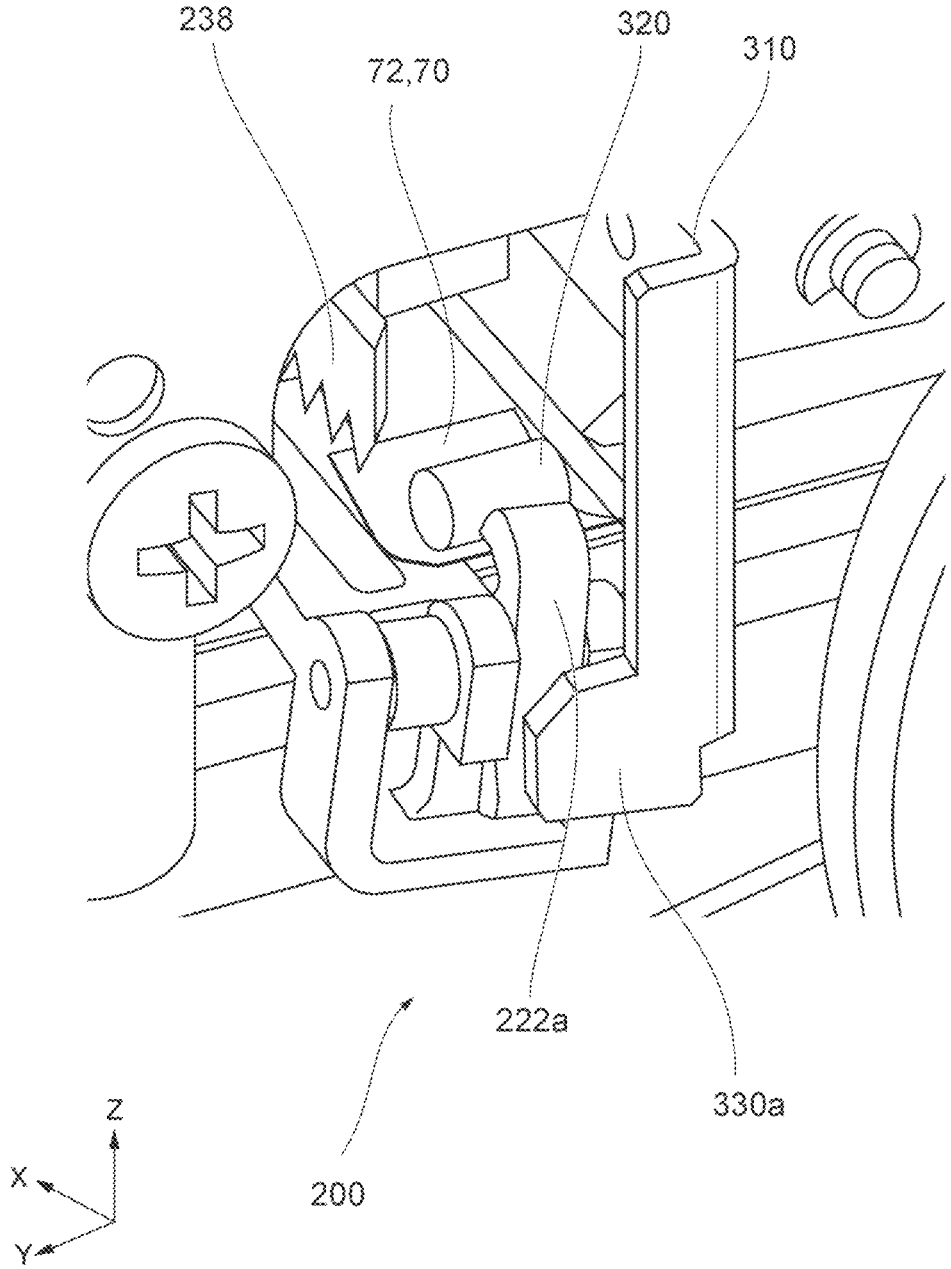
FIG. 22B is a perspective view of the tape holder 220 according to the present embodiment.
Figure 22C:
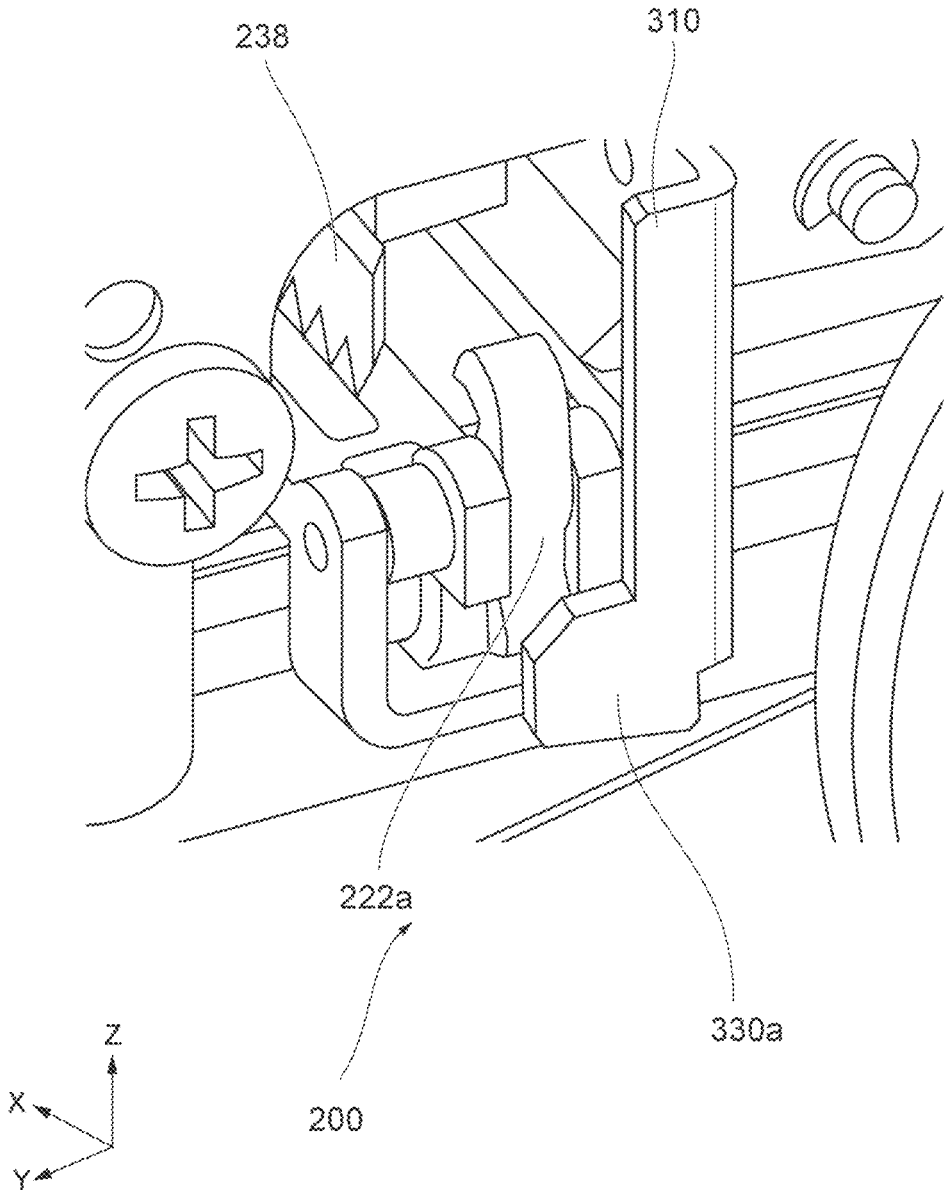
FIG. 22C is a perspective view of the tape holder 220 according to the present embodiment.

Next, a configuration in which the tape 70 is removed from the tape holder 220 when the tape 70 held by the tape holder 220 according to the present embodiment is released will be described with reference to FIGS. 22A to 22C. FIG. 22A is an enlarged perspective view illustrating a vicinity of the tape holder 220. As illustrated in FIG. 22A, the tape remover 320 is provided in the tape holding releaser 310. Accordingly, the tape remover 320 operates integrally with the tape holding releaser 310. As will be described later, the tape remover 320 also relatively descends in the −Z direction as the tape holding releaser 310 relatively descends in the −Z direction. In the present embodiment, the tape remover 320 has a cylindrical shape. In a state illustrated in FIG. 22A, the tape 70 is held by the tape holder 220. In the binding machine 100 according to the present embodiment, the first end 72 of the tape 70 is held by the tape holder 220 and removed by the tape remover 320. FIGS. 22A to 22C only illustrate the first end 72 of the tape 70, and the second end 74 of the tape 70 and the third end that is the end of the tape 70 used for the next binding operation are not illustrated.

Next, as illustrated in FIG. 22B, the tape holding releaser 310 relatively descends in the −Z direction, and the first releaser 330*a* and the second releaser 330*b* respectively abut against the base ends 222*a*2 and 222*b*2 of the first claw 222*a* and the second claw 222*b* of the tape holder 220 in the −Z direction (the second releaser 330*b* is not illustrated in FIG. 22B). When the first releaser 330*a* and the second releaser 330*b* abut against the base ends 222*a*2 and 222*b*2, the first claw 222*a* and the second claw 222*b* respectively rotate about the fulcrums 222*a*3 and 222*b*3, and the tape 70 held by the tape holder 220 is released. At this time, the tape remover 320 provided in the tape holding releaser 310 relatively descends in the −Z direction together with the tape holding releaser 310. The tape holder 220 has the opening 223*c* into which the tape remover 320 is inserted into.

Although FIG. 22B illustrates an example in which the tape holding releaser 310 descends in the −Z direction, the binding machine 100 according to the present embodiment may be configured such that the tape holder 220 ascends in the +Z direction relative to the tape holding releaser 310. As described above, the tape holder 220 operates integrally with the rotator 210, and the tape holder 220 moves with the rotation of the rotator 210. In a state in which the tape holding releaser 310 is on standby, the tape holder 220 moves in the +Z direction to a position in which the tape holding releaser 310 is on standby with the rotation of the rotator 210. In this way, the base end 222*a*2 of the first claw 222*a* and the base end 222*b*2 of the second claw 222*b* of the tape holder 220 respectively abut against the first releaser 330*a* and the second releaser 330*b*, the top ends 222*a*1 and 222*b*1 are separated from the tape support 223, and the tape 70 held by the tape holder 220 is released.

Accordingly, in the present embodiment, by rotating the claws 222*a* and 222*b* of the tape holder 220 with rotation of the rotator 210, the tape 70 can be held and released from being held by the tape holder 220. An operation of cutting the tape 70 used for binding and holding the tape 70 used for the next binding operation may be similarly implemented by operating the claws 222*a* and 222*b* of the tape holder 220 with rotation of the rotator 210.

FIG. 22B illustrates a state in which the tape 70 released from the state of being held by the tape holder 220 starts bending in the −Z direction by the tape remover 320. That is, in the present embodiment as illustrated in FIG. 22B, the tape remover 320, which descends in the −Z direction as the tape holding releaser 310 descends in the −Z direction, abuts against the tape 70 released from the state of being held by the tape holder 220 from the +Z direction. As the tape remover 320 relatively descends in the −Z direction, the tape 70 starts bending in the −Z direction from a vicinity of a center thereof (vicinity of the center in the lateral direction (X direction in FIG. 22B)).

With reference to FIG. 22C, when the tape holding releaser 310 further descends, the tape remover 320 descends to a position that is not seen in FIG. 22C. From a state illustrated in FIG. 22B to a state illustrated in FIG. 22C, the tape 70 is removed in the −Z direction as the tape remover 320 relatively descends in the −Z direction. In this way, when the tape 70 held by the tape holder 220 is released by the tape holding releaser 310, the tape remover 320 can remove the released tape 70 in the −Z direction.

Figure 23A:
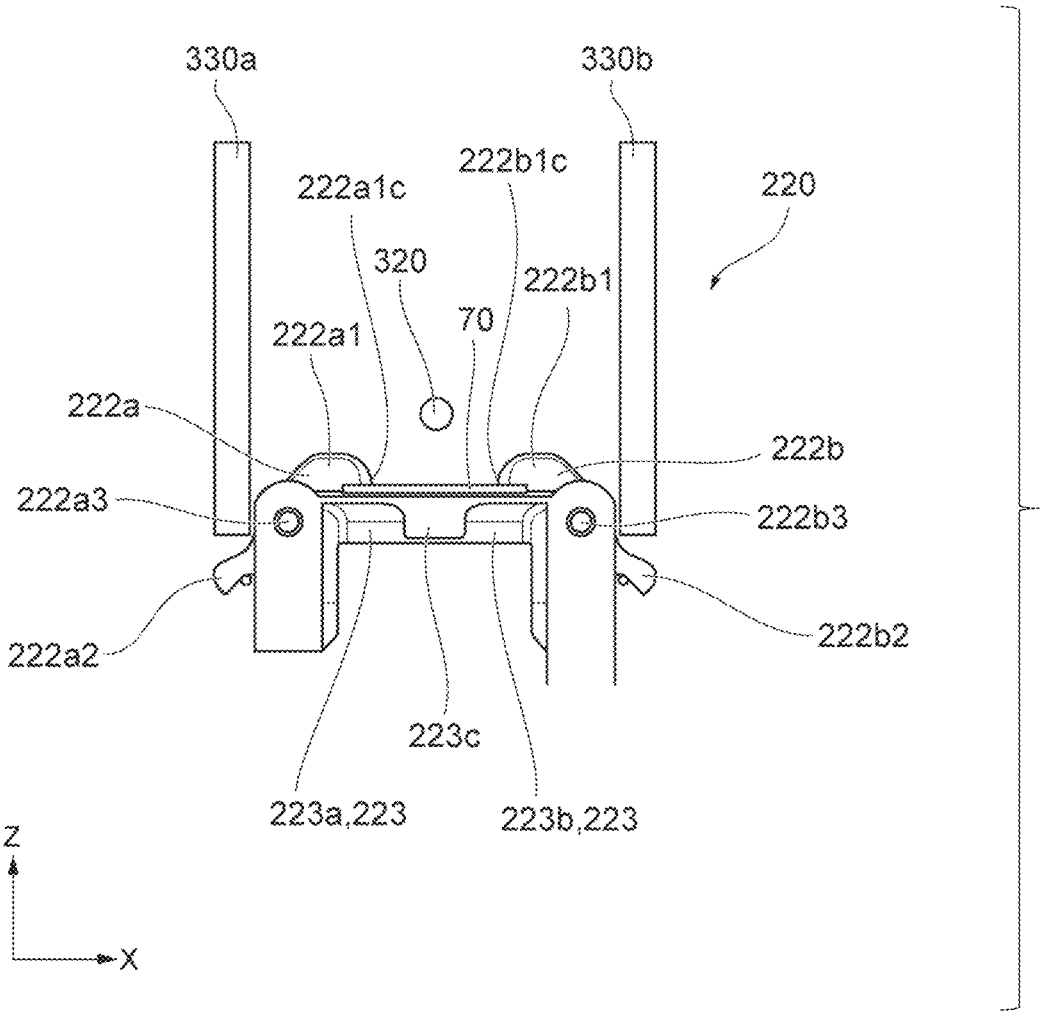
FIG. 23A illustrates a tape remover 320 according to the present embodiment.
Figure 23B:
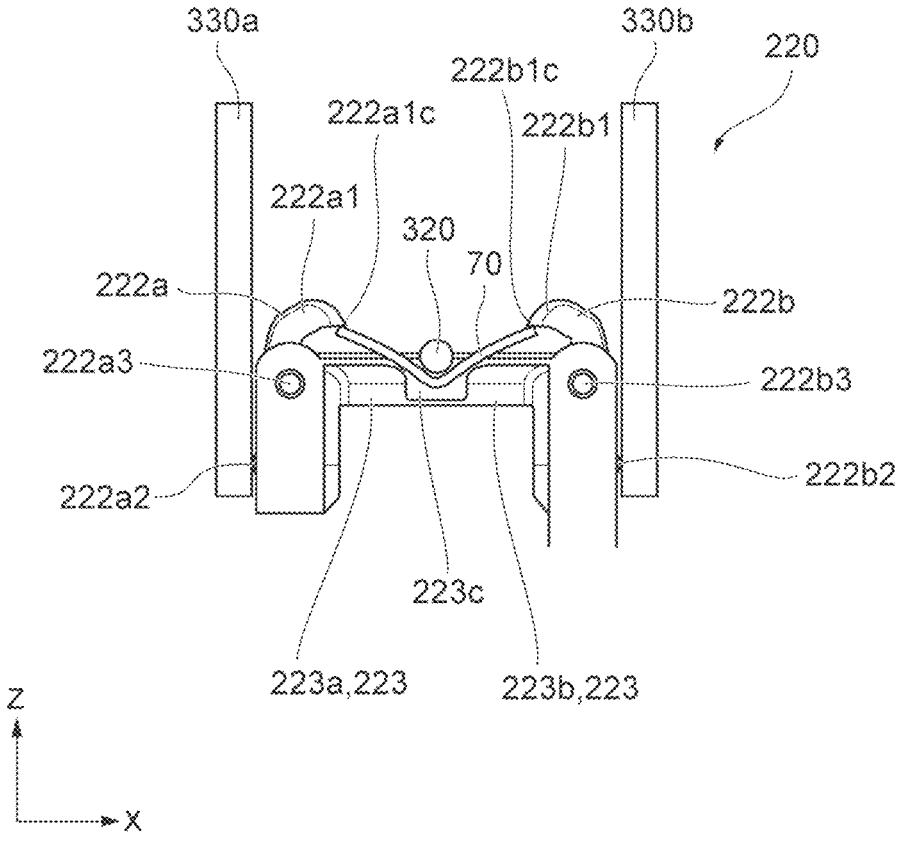
FIG. 23B illustrates the tape remover 320 according to the present embodiment.
Figure 23C:
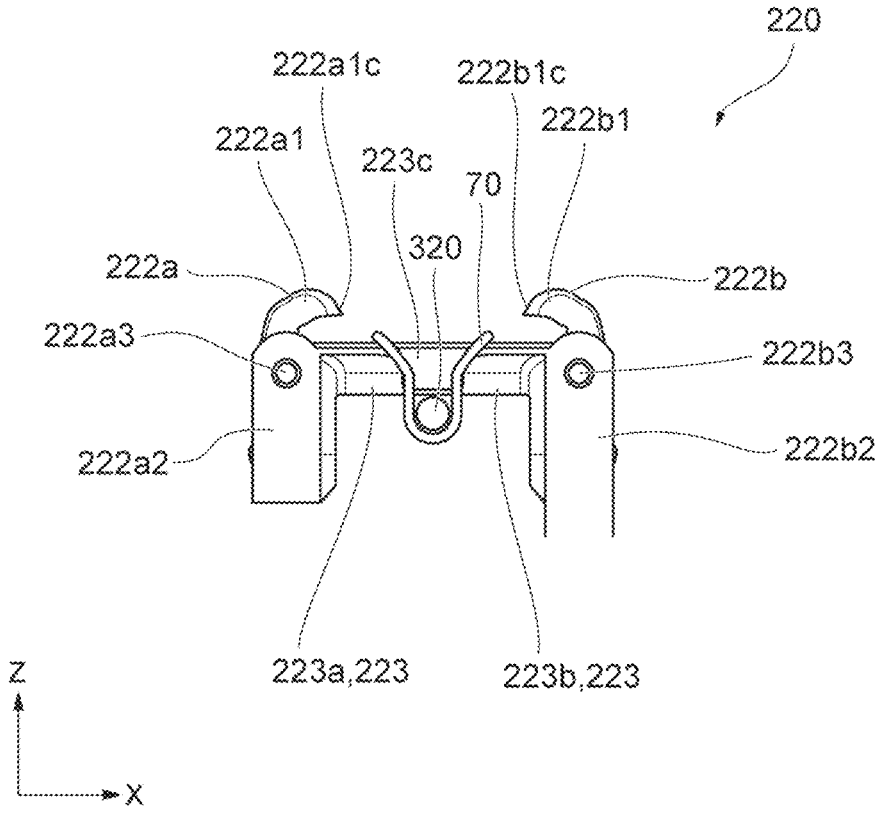
FIG. 23C illustrates the tape remover 320 according to the present embodiment.

FIGS. 23A to 23C illustrate removal of the tape 70 from the tape holder 220 by the tape remover 320. As illustrated in FIG. 23A, before the held tape starts to be released by the tape holding releaser 310, the tape remover 320 is located above the tape 70. As illustrated in FIG. 23A, at this time, the tape holder 220 is not abutting against the first releaser 330*a* and the second releaser 330*b* of the tape holding releaser 310.

As illustrated in FIG. 23B, after the first claw 222*a* and the second claw 222*b* of the tape holder 220 are rotated by the tape holding releaser 310 and the tape 70 held by the tape holder 220 is released, the tape remover 320 relatively descends in the −Z direction and abuts against the tape 70 on the tape support 223. At this time, the tape remover 320 abuts against the first end that is one end of the tape 70. At this time, the tape remover 320 abuts against the tape 70 from above (+Z direction) to be inserted into the opening 223*c* of the tape support 223. As illustrated in FIG. 23B, at this time, the tape holder 220 relatively ascends in the +Z direction until the tape holder 220 abuts against the first releaser 330*a* and the second releaser 330*b* of the tape holding releaser 310. Accordingly, the first releaser 330*a* abuts against the base end 222*a*2 of the claw 222*a*, and the second releaser 330*b* abuts against the base end 222*b*2 of the claw 222*b*. Accordingly, the top end 222*a*1 of the claw 222*a* rotates counterclockwise in FIG. 23B about the fulcrum 222*a*3, and the top end 222*b*1 of the claw 222*b* rotates clockwise in FIG. 23B about the fulcrum 222*b*3. The top end 222*a*1 and the top end 222*b*1 are separated from the tape support 223 by the rotation of the top end 222*a*1 and the top end 222*b*1. Accordingly, the contact 222*a*1*c* of the top end 222*a*1 and the contact 222*b*1*c* of the top end 222*b*1 are not abutting against the tape 70.

As illustrated in FIG. 23C, the tape remover 320 further descends relatively in the −Z direction, and the tape 70 is removed in the −Z direction through the opening 223*c*.

When the end of the tape 70 remains in the tape holder 220 after the held tape 70 is released by the tape holding releaser 310, it is considered that the tape holder 220 may hold an end of the remaining tape at the same time as when holding the end of the tape 70 to be used for the next binding. When the end of the remaining tape 70 is held again, the tape holder 220 tends to move the tape 70 that completes binding, which may cause a failure of the binding machine 100. Accordingly, the binding operation cannot be performed, and the operation efficiency decreases. In the present embodiment, the tape remover 320 can remove the remaining tape, and thus a decrease in efficiency of the binding operation due to the remaining tape can be prevented. The binding machine 100 according to the present embodiment can also be used, for example, when the object to be bound 60 is bound with the tape 70 made of a stretchable material. It is considered that the tape 70 made of a stretchable material is likely to remain in a vicinity of a position in which the cutting is performed in the binding machine 100 even after the tape 70 is cut, since the tape has relatively small tension. The remaining tape can be effectively removed by providing the tape remover 320 as in the binding machine 100 according to the present embodiment, and thus the binding machine 100 according to the present embodiment is also effective in the case of binding with a tape made of a stretchable material. For example, when a stem of a plant is bound, it is assumed that the stem of the plant grows to have a large diameter, and thus a binding is preferably maintained from immediately after the binding to a subsequent growth process of the plant. For this reason, a tape made of a stretchable material is preferable when binding the stem of a plant. By using the binding machine 100 according to the present embodiment, the binding operation using the tape made of a stretchable material can also be efficiently performed. Accordingly, the binding machine 100 according to the present embodiment can also be effectively used for binding the stem of a plant.

A direction in which the tape remover 320 removes the tape 70 may be a direction intersecting a longitudinal direction of the tape 70, such as the −Z direction. The tape 70 may be removed in a direction intersecting the longitudinal direction of the tape 70, for example, a direction perpendicular to both the longitudinal direction and the lateral direction of the tape 70. At this time, the tape 70 may be removed by the tape remover 320 in a direction from one surface to the other surface of the tape 70. For example, the tape remover 320 may remove the tape 70 in a direction from a front surface to a back surface of the tape 70.

The direction in which the tape 70 is removed may be a direction perpendicular to a main surface of the tape 70. At this time, the direction in which the tape 70 is removed may not be a direction completely perpendicular to the main surface of the tape 70, but be, for example, a substantially perpendicular direction. The direction may not be a completely perpendicular direction as long as the same function and effect can be obtained even in a substantially perpendicular direction.

In the present embodiment, the main surface of the tape 70 is defined by a direction in which the tape 70 extends. For example, when the tape 70 is parallel to the XY plane, the main surface of the tape 70 is a surface of the tape 70 parallel to the XY plane. In the present embodiment, the front surface and the back surface of the tape 70 may respectively be, for example, the surface on the +Z direction side and the surface on the −Z direction side of the tape 70 when the tape 70 is disposed such that the main surface of the tape 70 is parallel to a plane (XY plane) perpendicular to the Z direction. Alternatively, when the tape 70 is disposed such that the main surface of the tape 70 is parallel to the Z direction, the front surface and the back surface of the tape 70 may be, for example, a surface on the +X direction side and a surface on the −X direction side, respectively, or may be, for example, a surface on the +Y direction side and a surface on the −Y direction side, respectively.

The tape remover 320 may abut against the tape 70 (the end of the tape 70) in the longitudinal direction of the tape 70 and remove the tape 70. At this time, for example, the tape remover 320 may be movable along the Y direction relative to the tape 70 whose longitudinal direction is parallel to the Y direction, and the tape remover 320 may abut against the ends of the tape 70 by pressing or pulling the tape 70 in the Y direction and remove the tape 70.

FIGS. 22A to 23C describe an example in which the tape remover 320 is formed integrally with the tape holding releaser 310. Alternatively, the tape remover 320 and the tape holding releaser 310 may be provided as separate members, and also in this case, the tape remover 320 and the tape holding releaser 310 may coordinate with each other. For example, the tape remover 320 may remove the tape 70 after the tape holding releaser 310 releases the tape 70 held by the tape holder 220.

Figure 24A:
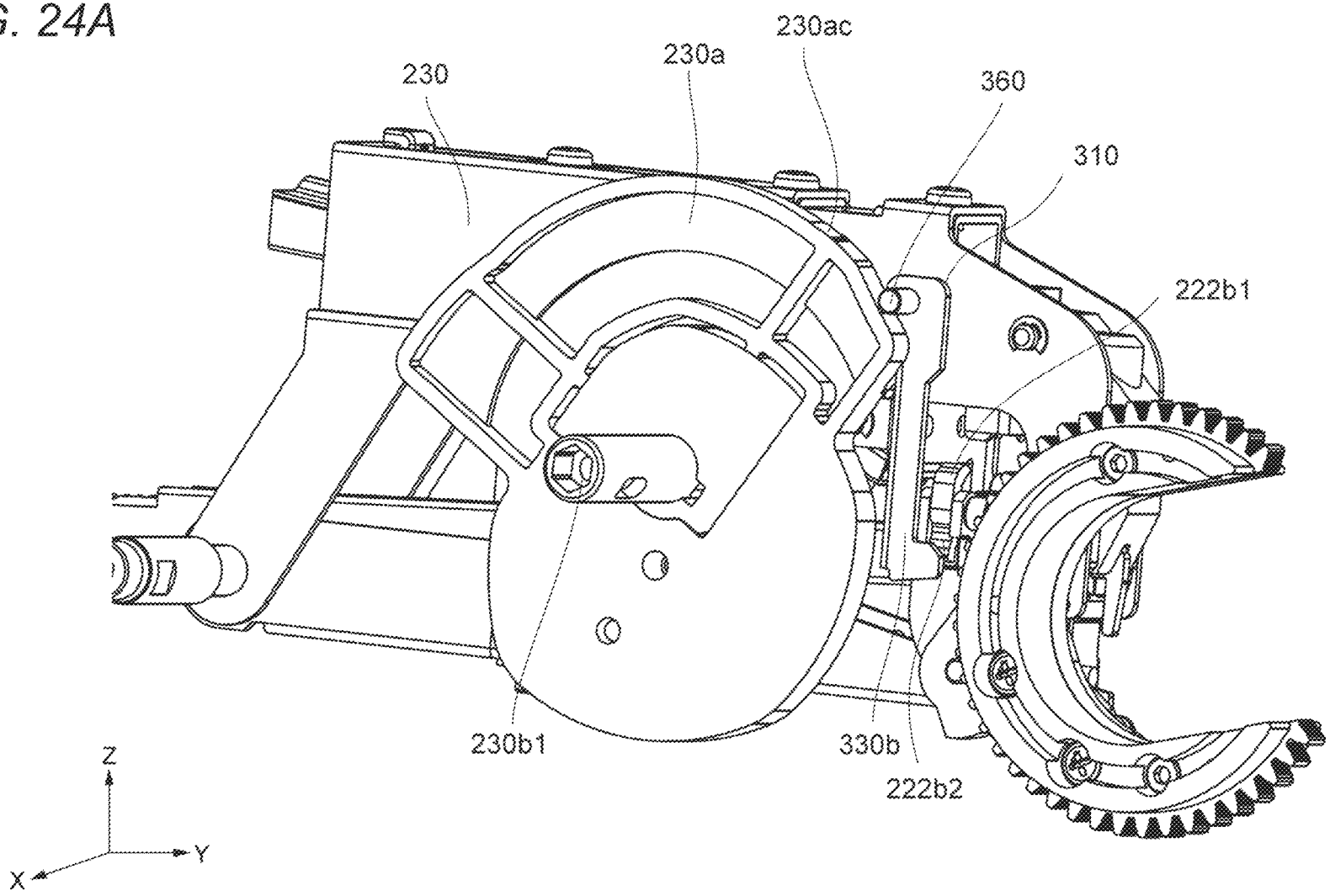
FIG. 24A is a perspective view illustrating the binding machine body 200 according to the present embodiment.
Figure 24B:
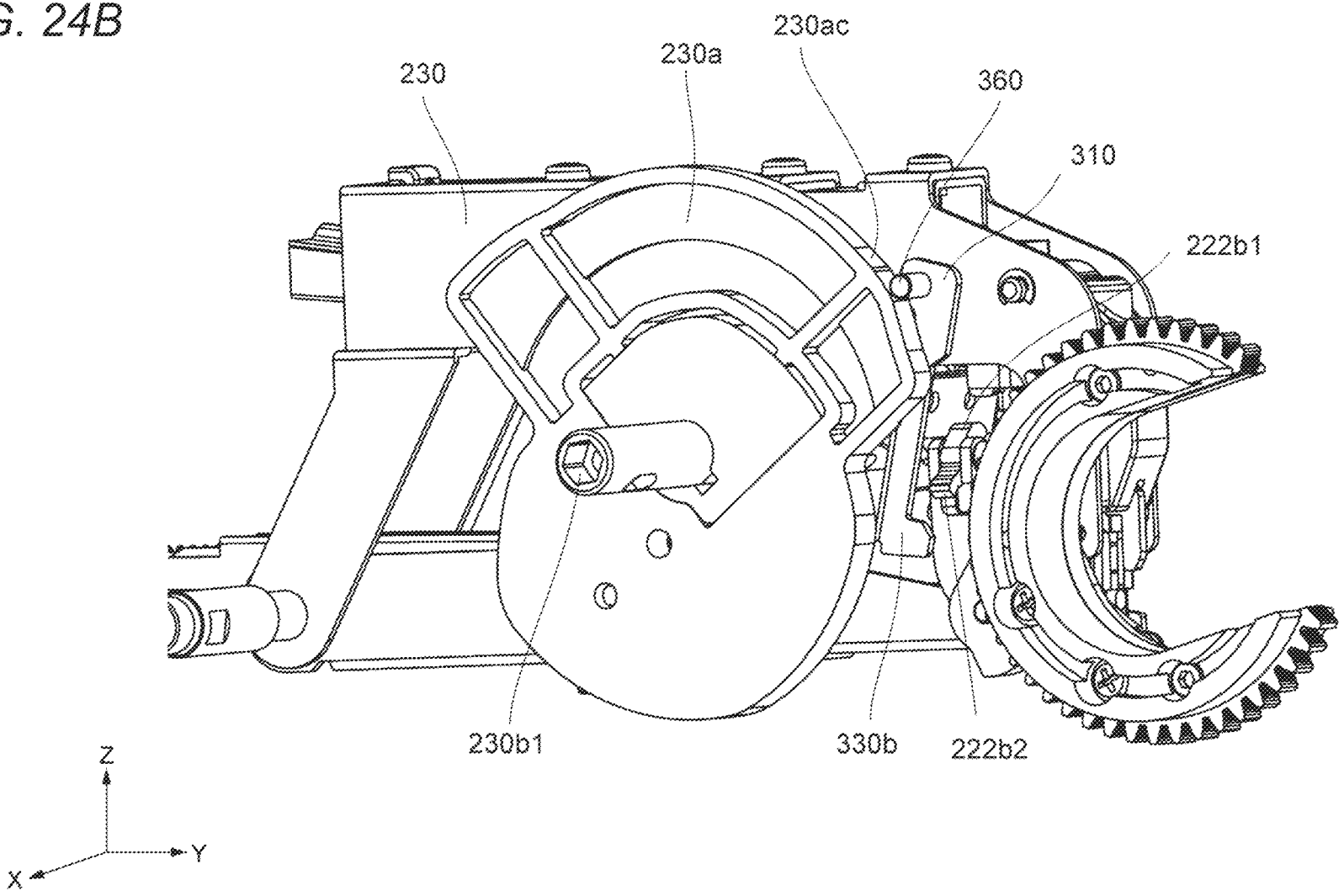
FIG. 24B is a perspective view illustrating the binding machine body 200 according to the present embodiment.

With reference to FIGS. 24A and 24B, a mechanism of the tape holding releaser 310 according to the present embodiment that releases, using the clincher unit drive cam 230*a*, the tape 70 held by the tape holder 220 will be described. FIGS. 24A and 24B are perspective views of the binding machine body 200 viewed from the +X direction, in which FIG. 24A illustrates a state in which the tape 70 held by the tape holder 220 is released by the tape holding releaser 310, and FIG. 24B illustrates a state in which the tape 70 is held again by the tape holder 220.

As illustrated in FIGS. 24A and 24B, the swing control pin 360 of the tape holding releaser 310 abuts against the outer peripheral surface 230*ac* of the clincher unit drive cam 230*a*. With the rotation of the clincher unit drive cam 230*a*, the swing control pin 360 moves the tape holding releaser 310 along the outer peripheral surface 230*ac* of the clincher unit drive cam 230*a*. The shape of the outer peripheral surface 230*ac* of the clincher unit drive cam 230*a* is not circular relative to the drive camshaft 230*b*1 that is the rotation center axis. Accordingly, with the movement of the swing control pin 360 on the outer peripheral surface 230*ac*, the tape holding releaser 310 can take a plurality of postures. During a transition from the state illustrated in FIG. 24A to the state illustrated in FIG. 24B, the tape holding releaser 310 transitions from a posture of being substantially parallel to the Z direction as illustrated in FIG. 24A to a swung state as illustrated in FIG. 24B. As illustrated in FIG. 24A, when the tape holding releaser 310 takes the posture of being substantially parallel to the Z direction, the first releaser 330*a* and the second releaser 330*b* of the tape holding releaser 310 respectively abut against the claws 222*a* and 222*b* of the tape holder 220, and the tape holder 220 releases the held tape 70. As illustrated in FIG. 24B, in the state in which the tape holding releaser 310 is swung, the tape holding releaser 310 is retracted from the tape holder 220, and the tape holder 220 is in a state of being available to hold the tape 70. Specifically, the claws 222*a* and 222*b* are respectively urged by the torsion coil springs 226*a* and 226*b* in the direction toward the tape support 223, and the tape 70 can be held by the claws 222*a* and 222*b* and the tape support 223. Accordingly, the movement of the clincher unit 230 and the movement of the tape holding releaser 310 can be relatively easily coordinated. The single motor 250 that is a drive source can drive a plurality of configurations at the same timing.

The above-described embodiment describes an example in which one drive motor 250 is used in the binding machine 100. By driving a plurality of configurations in the binding machine 100, the binding portion, the binding material feeder 202, the tape remover 320, and the like using one drive motor 250 as a drive source, movements of the plurality of configurations in the binding machine 100 can be relatively easily coordinated.

In another embodiment, two or more motors may be used in the binding machine 100. For example, the clincher unit 230 and the magazine unit 240 may be driven by different motors. Alternatively, a motor that drives the rotator 210 and a motor that drives the clincher unit 230 and the magazine unit 240 may be different motors. Even when two or more motors are used, the binding material feeder 202 including the tape holder 220 and the rotator 210 coordinates with the binding portion including the clincher unit 230 and the magazine unit 240, so that the same effects as those of the above-described binding machine 100 can be achieved. The above embodiment describes an example in which configurations of the binding machine 100 are coordinated and driven by the drive motor 250 and cam mechanisms such as the clincher unit drive cam 230*a* and the magazine unit drive cam 240*a*. Alternatively, the present disclosure is not limited thereto, and elements may be controlled to be driven by different drive sources using, for example, a plurality of motors and coordinated with each other.

A tape clamping method according to the present embodiment will be described with reference to FIGS. 25 to 30B.

Figure 25:
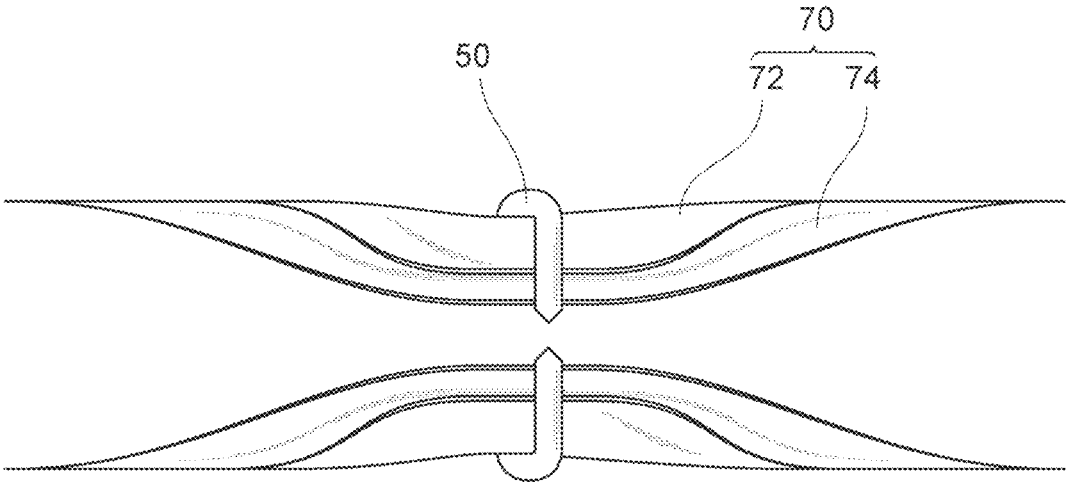
FIG. 25 is a schematic view of a tape 70 according to the present embodiment.

As will be described later, according to studies of the present inventors, it is found that a binding strength can be improved by bending and fixing a tape with a staple in a manner of enclosing overlapped parts of the tape. FIG. 25 is a schematic view of the tape 70 that is overlapped to be enclosed by a following method. As a result of the binding as illustrated in FIG. 25, a strength of the binding article (including the staple 50 and the tape 70 in the present embodiment) that binds the object to be bound is improved as compared with a case in which the binding is performed by piercing the staple 50 into the tape 70 and fixing the ends (first end 72, second end 74) of the tape 70, which is performed in the related art as described above. By fixing the ends of tape 70 by the method described below, the binding strength is improved compared with a binding article that binds the overlapped two ends of the tape 70 without enclosing.

Figure 26A:
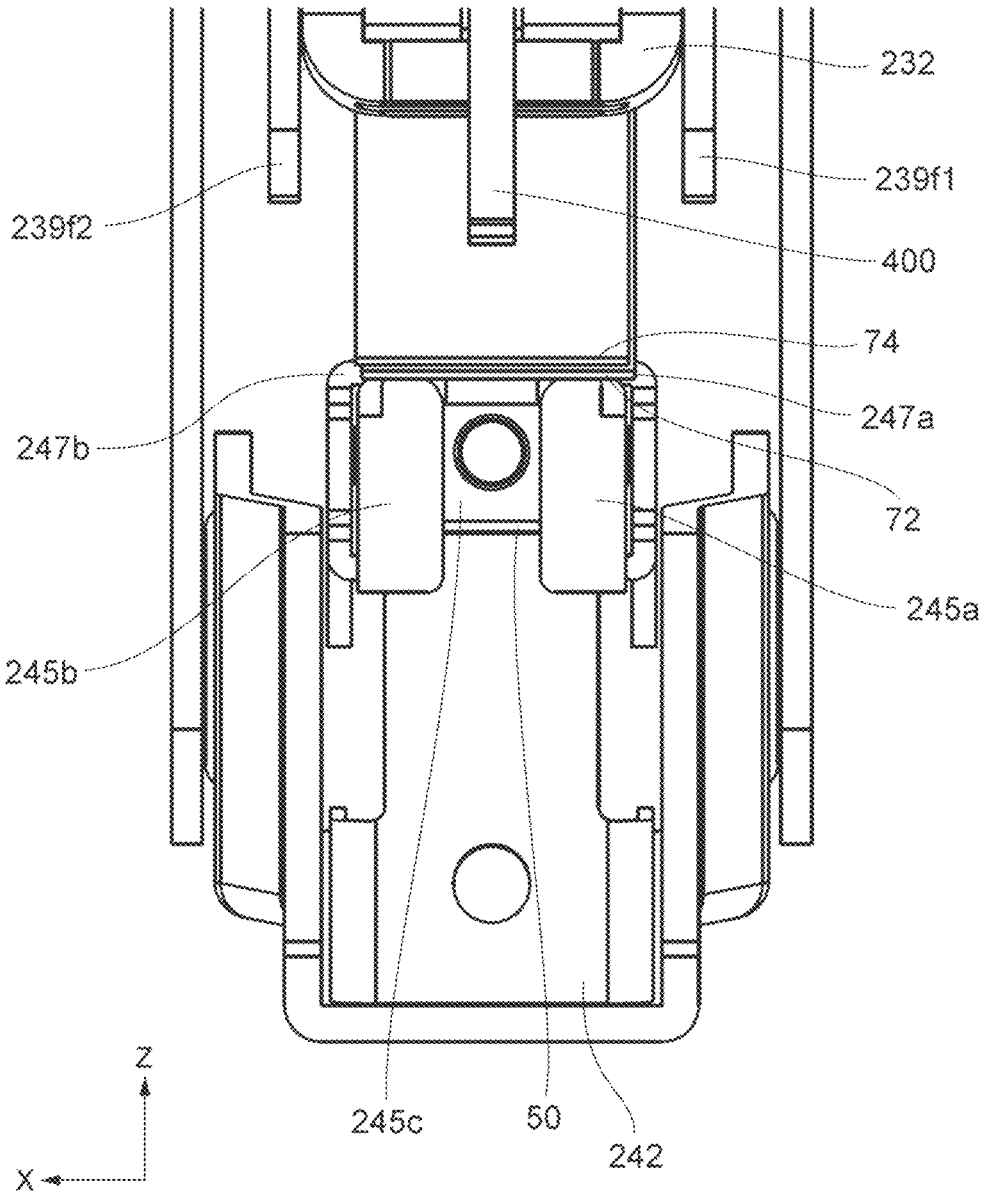
FIG. 26A illustrates a part of the clincher unit 230 and the magazine unit 240 according to the present embodiment viewed from the front side in the Y direction.
Figure 26B:
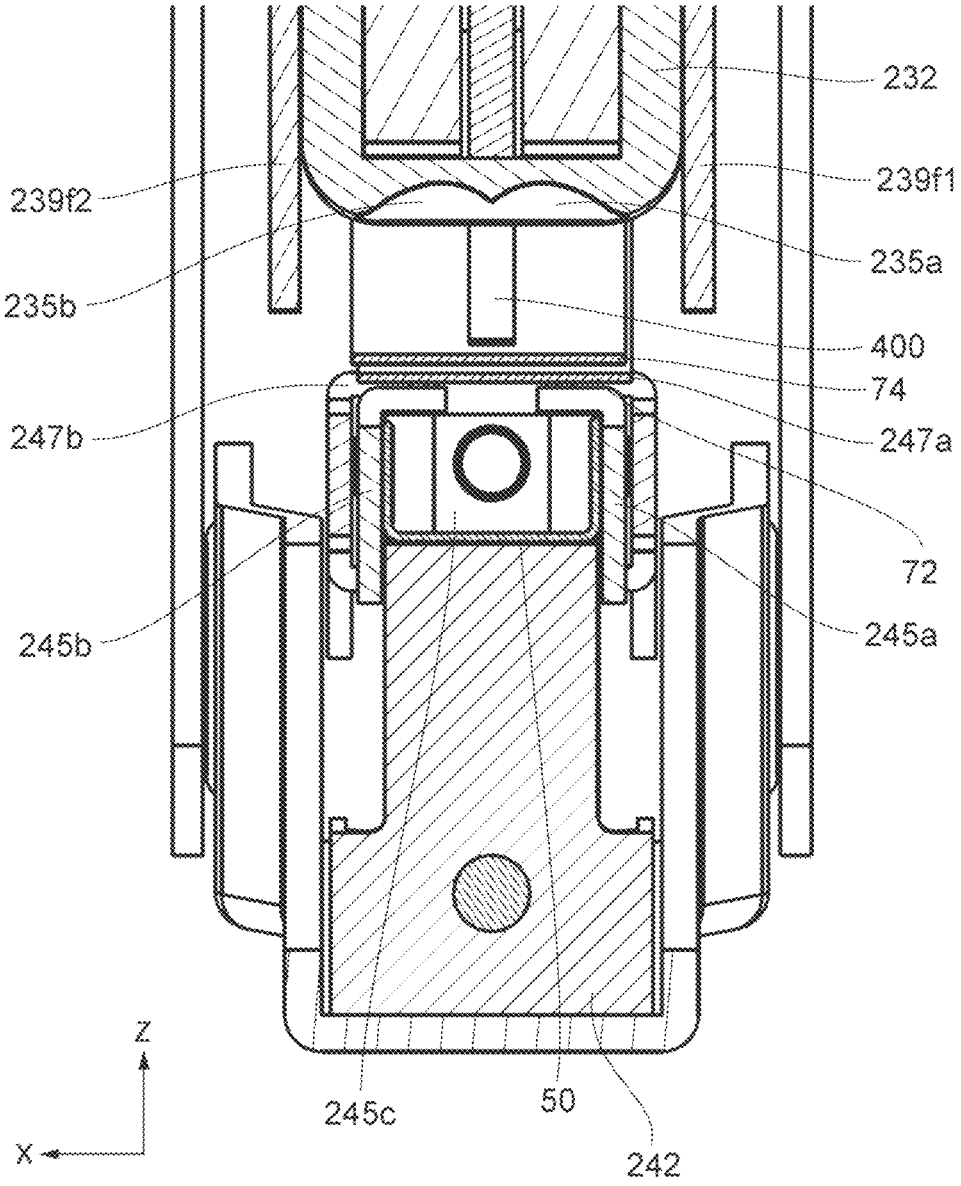
FIG. 26B is a sectional view illustrating a part of the clincher unit 230 and the magazine unit 240 according to the present embodiment viewed from the front side in the Y direction.
Figure 26C:
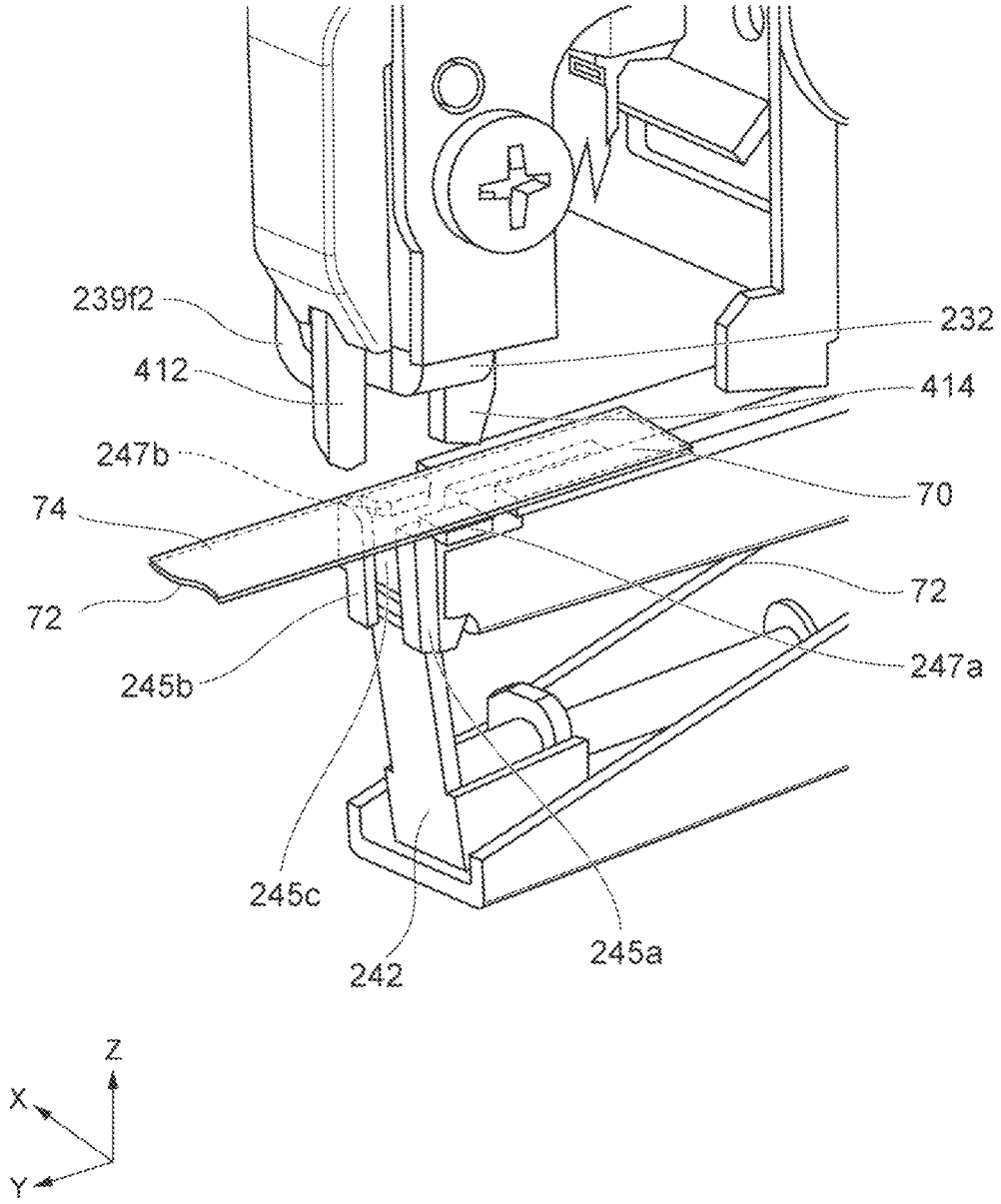
FIG. 26C is a perspective view of a part of the clincher unit 230 and the magazine unit 240 according to the present embodiment.

FIG. 26A illustrates the vicinity of the clinching position viewed from the +Y direction, in which the clincher 232 (staple bender 232 or bender 232 in the present embodiment) and the driver 242 (staple driver 242 in the present embodiment) approaching each other are located in a state before the part where the tape 70 is overlapped is fixed by the staple 50. That is, FIG. 26A illustrates a standby state before the clinching is started. FIG. 26B is a sectional view of the clincher unit 230 and the magazine unit 240 that is parallel to the XZ plane in the state illustrated in FIG. 26A. FIG. 26B corresponds to a sectional view of a part on the −Y direction side of the clincher unit 230 and the magazine unit 240 illustrated in FIG. 26A. FIG. 26C is a perspective view of the vicinity of the clinching position in the standby state before the start of the clinching viewed obliquely from the +Y direction. In FIG. 26C, a part of the first clincher leg 239*f*1 is omitted to illustrate the tape folder 400.

As illustrated in FIGS. 26A to 26C, in this state, the first end 72 and the second end 74 to be clinched of the tape 70 are located on the first abutment member 247*a* and the second abutment member 247*b* in a state of being overlapped in the Z direction. As described above, in a state in which the first end 72 of the tape 70 is held by the tape holder 220 of the binding material feeder 202 (tape feeder 202), the first end 72 is moved around the object to be bound 60 with the rotation of the rotator 210 and then moved to a position overlapping the second end 74 of the tape 70 in the Z direction before clinching. Accordingly, in the present embodiment, the binding material feeder 202 including the rotator 210 and the tape holder 220 corresponds to a tape overlapping portion. In this state, the first clincher leg 239*f*1 and the second clincher leg 239*f*2 of the clincher unit 230 are respectively located on the −X direction side and the +X direction side of the first abutment member 247*a* and the second abutment member 247*b* of the magazine unit 240. The first folder 412 and the second folder 414 of the tape folder 400 both stand by on the +Z direction side of the magazine unit 240. As illustrated in FIGS. 26A to 26C, in the standby state, the tape folder 400 is not yet inserted into an opening 245*c* between the first driver restricting member 245*a* and the second driver restricting member 245*b*.

As can be seen in FIGS. 26A and 26B, the opening 245*c* opens in the Y direction and the Z direction. More specifically, as illustrated in FIG. 26A, the opening 245*c* opens in the −Z direction from an upper surface of the first abutment member 247*a* and an upper surface of the second abutment member 247*b* between the first driver restricting member 245*a* and the second driver restricting member 245*b* corresponding to members disposed at an end of the magazine unit 240 in the +Y direction. Since the opening 245*c* is also provided in the section of FIG. 26B, it can be seen that the opening 245*c* also extends in the −Y direction from the first driver restricting member 245*a* and the second driver restricting member 245*b*. A fact that the opening 245*c* opens in the Y direction and the Z direction can also be seen from FIG. 26C.

Figure 27A:
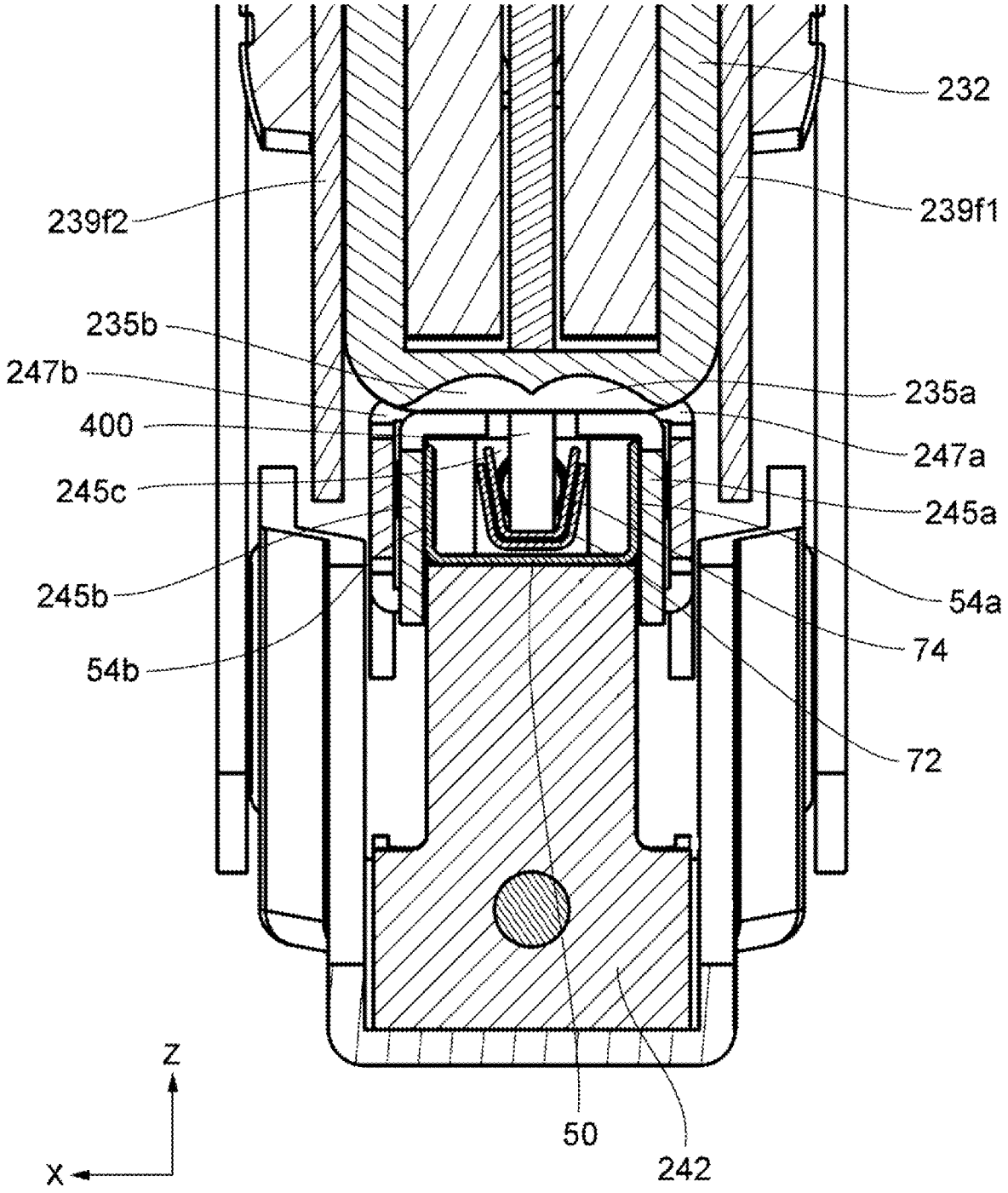
FIG. 27A illustrates a part of the clincher unit 230 and the magazine unit 240 according to the present embodiment viewed from the front side in the Y direction.

Before the clinching is started, as illustrated in FIG. 27A, the tape folder 400 descends relative to the magazine unit 240 in the-Z direction, and the first end 72 and the second end 74 of the tape 70 are folded in a state of being overlapped with each other in the Z direction and are pressed into the opening 245*c*. As illustrated in FIG. 27A, at this time, the first end 72 and the second end 74 of the tape 70 are substantially U-shaped in the section perpendicular to the Y direction. At this time, a pair of side edges of the first end 72 and the second end 74 in the lateral direction (X direction) of the tape 70 are folded in a direction of facing each other so that the first end 72 and the second end 74 of the tape 70 are located between the first leg 54*a* and the second leg 54*b* of the staple 50. That is, at this time, the tape 70 is folded such that the first end 72 and the second end 74 are located between the first leg 54*a* and the second leg 54*b* while being folded in a direction in which the pair of side edges (the first side edge and the second side edge described above) in the lateral direction (the X direction in FIG. 27A) of the tape face each other.

Figure 27B:
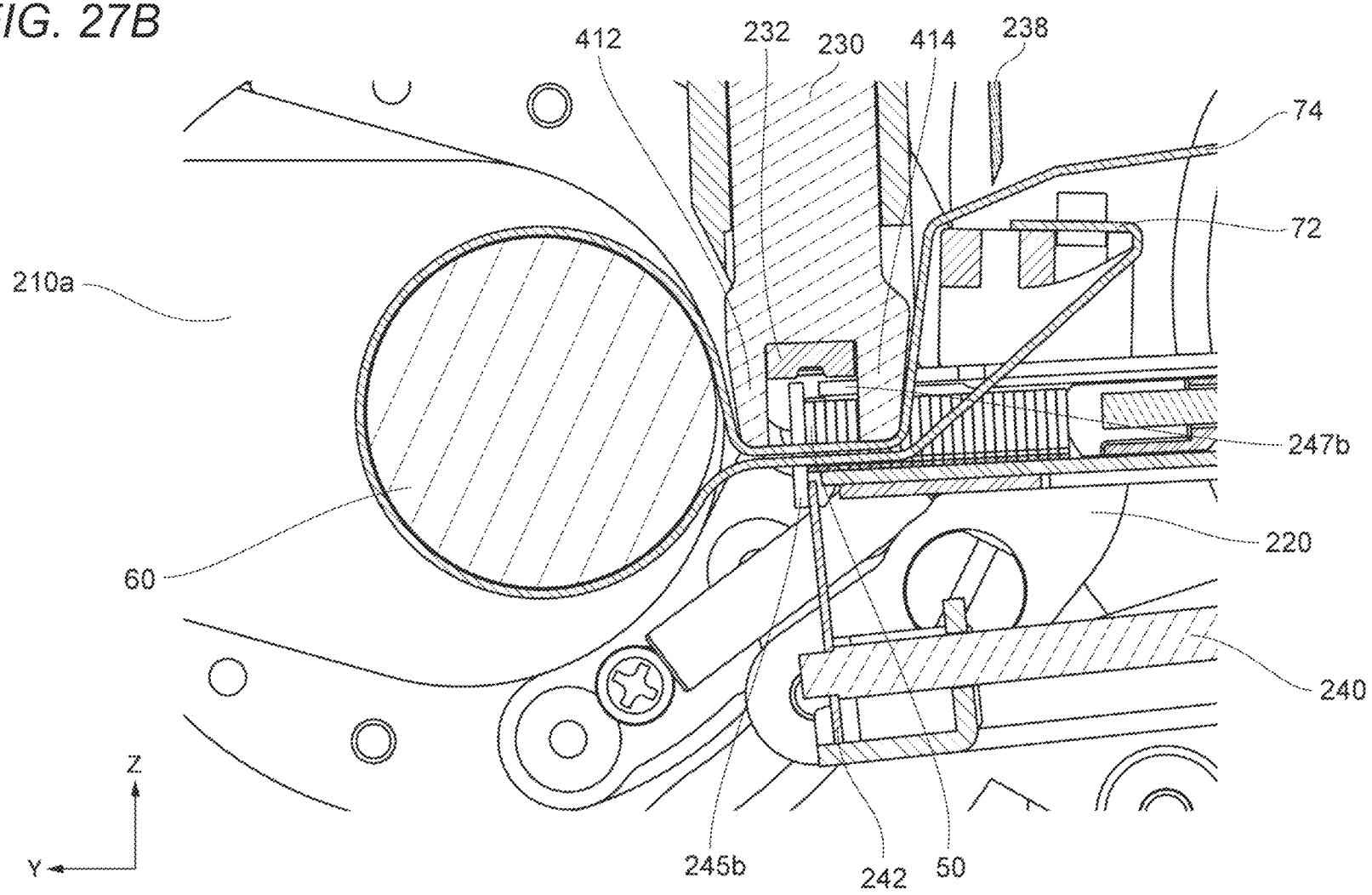
FIG. 27B illustrates a part of the clincher unit 230 and the magazine unit 240 according to the present embodiment viewed from a left side in an X direction.

FIG. 27B illustrates the vicinity of the clinching position at this time viewed from the −X direction. As illustrated in FIG. 27B, the first folder 412 and the second folder 414 of the folder 400 are respectively inserted into the +Y direction side and the −Y direction side of the opening 245*c*. In this state, the staple 50 is located between the first folder 412 and the second folder 414 in a sectional view taken along a plane perpendicular to the X direction. Accordingly, a position between the first folder 412 and the second folder 414 of the part of the tape 70 on which the first end 72 and the second end 74 are overlapped is clinched by the clincher 232 and the driver 242 using the staple 50.

In the present embodiment, a width of the opening 245*c* in the X direction is preferably smaller than a width of the tape 70 in the lateral direction. By making the width of the opening 245*c* in the X direction smaller than the width of the tape 70 in the lateral direction, the tape 70 is located in a flat state on the first abutment member 247*a* and the second abutment member 247*b* before the tape 70 is pressed into the opening 245*c* as illustrated in FIG. 26A, and can be deformed into a U shape in the sectional view as illustrated in FIG. 27A when the tape 70 is pressed into the opening 245*c*.

Figure 28:
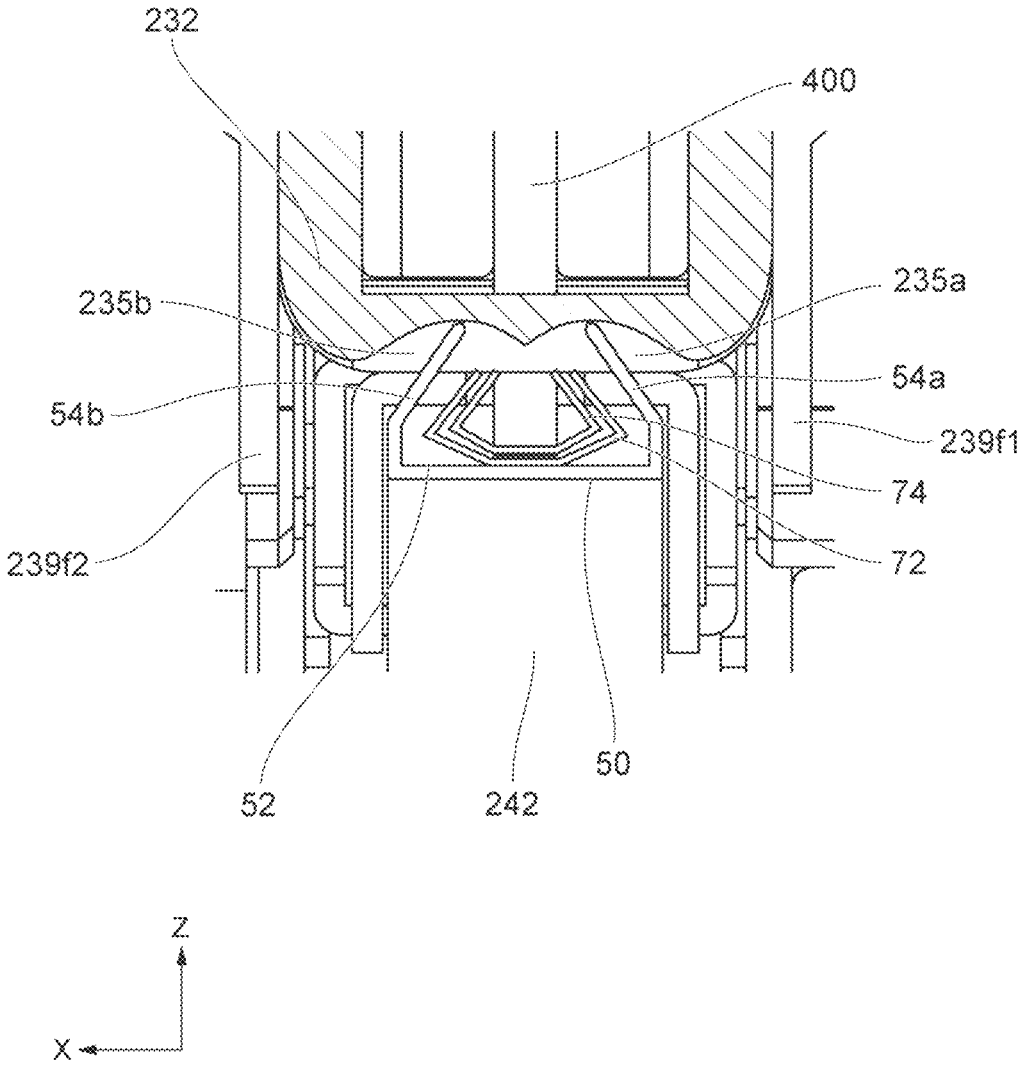
FIG. 28 illustrates a part of the clincher unit 230 and the magazine unit 240 according to the present embodiment viewed from the front side in the Y direction.

Next, as illustrated in FIG. 28, the driver 242 ascends in the +Z direction relative to the clincher 232 (the clincher 232 descends in the −Z direction relative to the driver 242), and the first end 72 and the second end 74 of the tape 70 are deformed in a state of being overlapped such that the U shape in the sectional view is crushed. That is, as illustrated in FIGS. 27A and 27B, in a state in which the first end 72 and the second end 74 of the tape 70 are urged in the −Z direction respectively by the first folder 412 and the second folder 414 in two positions separated from each other in the Y direction with the staple 50 clamped in between, the clincher 232 descends in the −Z direction relative to the driver 242, or the driver 242 ascends in the +Z direction relative to the clincher 232, as illustrated in FIG. 28, and the first end 72 and the second end 74 are clinched by the staple 50. In this way, the driver 242 functions as a staple driver that drives the staple 50, and the clincher 232 functions as a staple bender (bender in the present embodiment) that bends the staple 50 driven by the driver 242.

As described with reference to FIGS. 26A to 28, according to the tape clamping method according to the present embodiment, the first end 72 and the second end 74 of the tape 70 are overlapped in the Z direction, and the tape 70 is clamped by deforming the staple 50 in a manner of clamping the overlapped part of the first end 72 and the second end 74 from outer sides of the pair of side edges (side edges in the X direction) of the tape 70. The above embodiment describes an example in which the overlapped part of the first end 72 and the second end 74 of the tape 70 is clamped from the outer sides of the pair of side edges (two side edges) of the tape 70. Alternatively, the present disclosure is not limited thereto. For example, the tape 70 may be clamped by clamping the overlapped part of the first end 72 and the second end 74 of the tape 70 from the outer side of at least one of the pair of side edges. For example, the tape 70 may be clamped by deforming the staple 50 in a manner of clamping the overlapped part of the first end 72 and the second end 74 only from the outer side of the first side edge that is one of the pair of side edges of the tape 70, or the tape 70 may be clamped by deforming the staple 50 in a manner of clamping the overlapped part of the first end 72 and the second end 74 only from the outer side of the second side edge that is the other one of the pair of side edges of the tape 70.

For example, when the first side edge of the tape 70 is the side edge of the tape 70 in the −X direction, the tape 70 may be clamped by deforming the staple 50 in a manner of clamping the overlapped part of the first end 72 and the second end 74 from the −X direction of the tape 70, which is the outer side of the first side edge. Similarly, when the second side edge of the tape 70 is the side edge of the tape 70 in the +X direction, the tape 70 may be clamped by deforming the staple 50 in a manner of clamping the overlapped part of the first end 72 and the second end 74 from the +X direction of the tape 70, which is the outer side of the second side edge. At this time, when the tape 70 is clamped from two side edges of the tape 70, the tape 70 may be clamped by deforming the staple 50 from the −X direction of the first side edge and the +X direction of the second side edge in a manner of clamping the overlapped part of the first end 72 and the second end 74.

In addition, in the present embodiment as described above, the tape 70 is clamped by folding a part of the overlapped part of the first end 72 and the second end 74 in the lateral direction (X direction in FIG. 28) of the tape 70 by the first leg 54*a* of the staple 50 in a manner of forming a fold extending in the longitudinal direction of the tape 70.

In the present embodiment, the tape folder 400 is fixed to the clincher unit 230. Accordingly, the tape folder 400 does not move relative to the clincher 232 functioning as a staple bender. Alternatively, the tape folder 400 may be movable relative to the clincher 232. According to this configuration, for example, when clinching is performed, the tape folder 400 may move in the −Z direction relative to the clincher 232 and fold the tape 70. At this time, for example, the tape folder 400 may be urged in the −Z direction (that is, the direction toward the driver 242) from the clincher 232. For example, the tape folder 400 may be urged in the −Z direction by providing an urging member such as a spring in a space above (+Z direction side) the tape folder 400 (for example, a space above the tape folder 400 indicated by diagonal lines in FIG. 20A).

In the present embodiment as illustrated in FIG. 28, at this time, the tape 70, which has a U shape in a sectional view in the state illustrated in FIG. 27A, is crushed such that a fold is formed between a bottom, one end (corresponding to one side edge of the tape 70), and the other end (corresponding to the other side edge of the tape 70) of the U shape. In addition, a distance between the driver 242 and the clincher 232 decreases as the driver 242 descends in the +Z direction relative to the clincher 232, and thus the staple 50 is also folded. At this time, the staple 50 is folded such that the first leg 54*a* and the second leg 54*b* approaches the crown 52.

As illustrated in the section of FIG. 27A, a first recess 235*a* and a second recess 235*b*, which are a pair of recesses, may be provided in an end surface of the clincher 232 on the −Z direction side. The first recess 235*a* and the second recess 235*b* are provided such that a top end of the first leg 54*a* follows a curved surface of the first recess 235*a* and a top end of the second leg 54*b* follows a curved surface of the second recess 235*b* when the staple 50 is folded. The first recess 235*a* and the second recess 235*b* can restrict movement of the first leg 54*a* and the second leg 54*b* when the staple 50 is folded, and can accordingly improve folding accuracy of the staple. Accordingly, it is possible to prevent breakage or the like of the tape due to a failure which may occur at the time of folding, for example, distortion of the staple.

As described above, the part of the tape 70 where the first end 72 and the second end 74 are overlapped is fixed by the staple 50 in a state of being enclosed as illustrated in FIG. 25. In this way, the binding article used for binding the object to be bound 60 clamped by the tape clamping method according to the present embodiment includes the tape 70 in a band shape that surrounds the object to be bound 60 and the staple 50 that is provided at the part where the first end 72 of the tape 70 and the second end 74 of the tape are overlapped. The staple 50 includes the crown 52 and the first leg 54*a* connected to one end of the crown 52, and clamps the tape 70 by the top end of the first leg 54*a* being bent in a direction approaching the crown 52.

Figure 29:
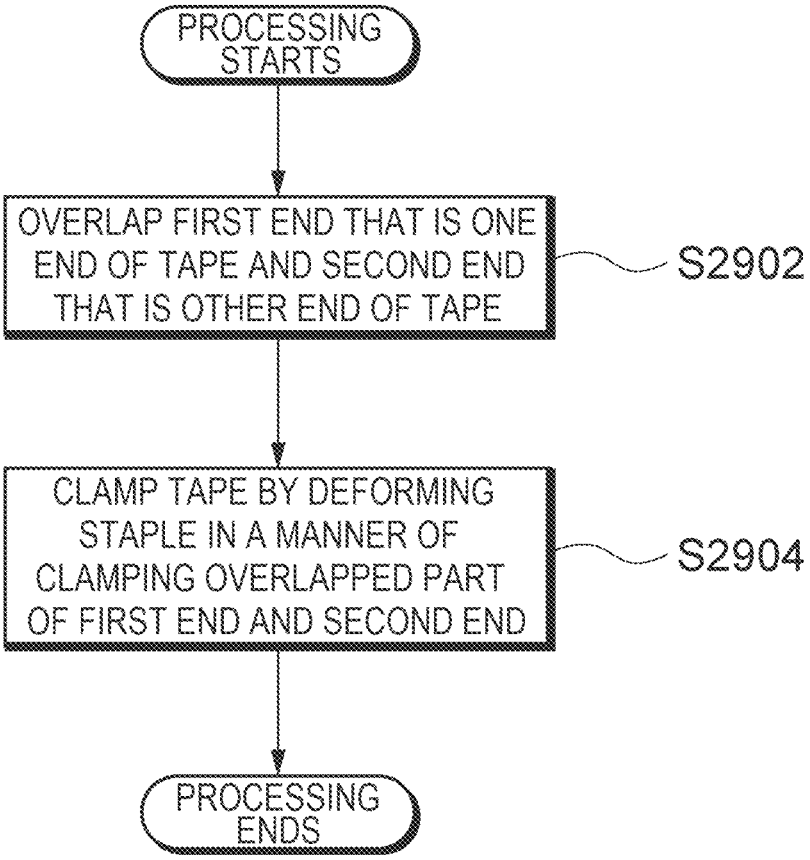
FIG. 29 is a flowchart showing a tape clamping method according to the present embodiment.

The tape clamping method according to the present embodiment will be described with reference to FIG. 29. FIG. 29 is a flowchart showing a tape clamping method of clamping, with a staple, a band-shaped tape that surrounds an object to be bound according to the present embodiment.

First, the first end that is one end of the tape and the second end that is the other end of the tape are overlapped (S2902).

Next, the tape is clamped by deforming the staple in a manner of clamping the overlapped part of the first end and the second end (S2904).

As described above, the first end that is one end of the tape 70 and the second end that is the other end of the tape 70 are clamped by the staple.

By the tape clamping method according to the present embodiment described above, the first end 72 and the second end 74 of the tape 70 are folded in the staple 50 (in the space defined by the crown 52, the first leg 54*a*, and the second leg 54*b* in a sectional view). As described above, a binding machine is proposed in the related art, in which the staple 50 is pieced into the tape 70 to fix the first end 72 and the second end 74 of the tape 70. According to the tape clamping method according to the present embodiment, since the tape is clamped by the staple, breakage or the like of the tape that may occur when the staple 50 pieces the tape 70 can be prevented and the binding strength by the tape 70 can be improved. Further, a thickness (for example, a thickness in the Z direction) of the tape 70 in the staple 50, which is considered to exhibit the binding strength, can be substantially doubled. Accordingly, for example, the binding strength can be improved without increasing the thickness of the tape 70 itself used for binding.

Figure 30A:
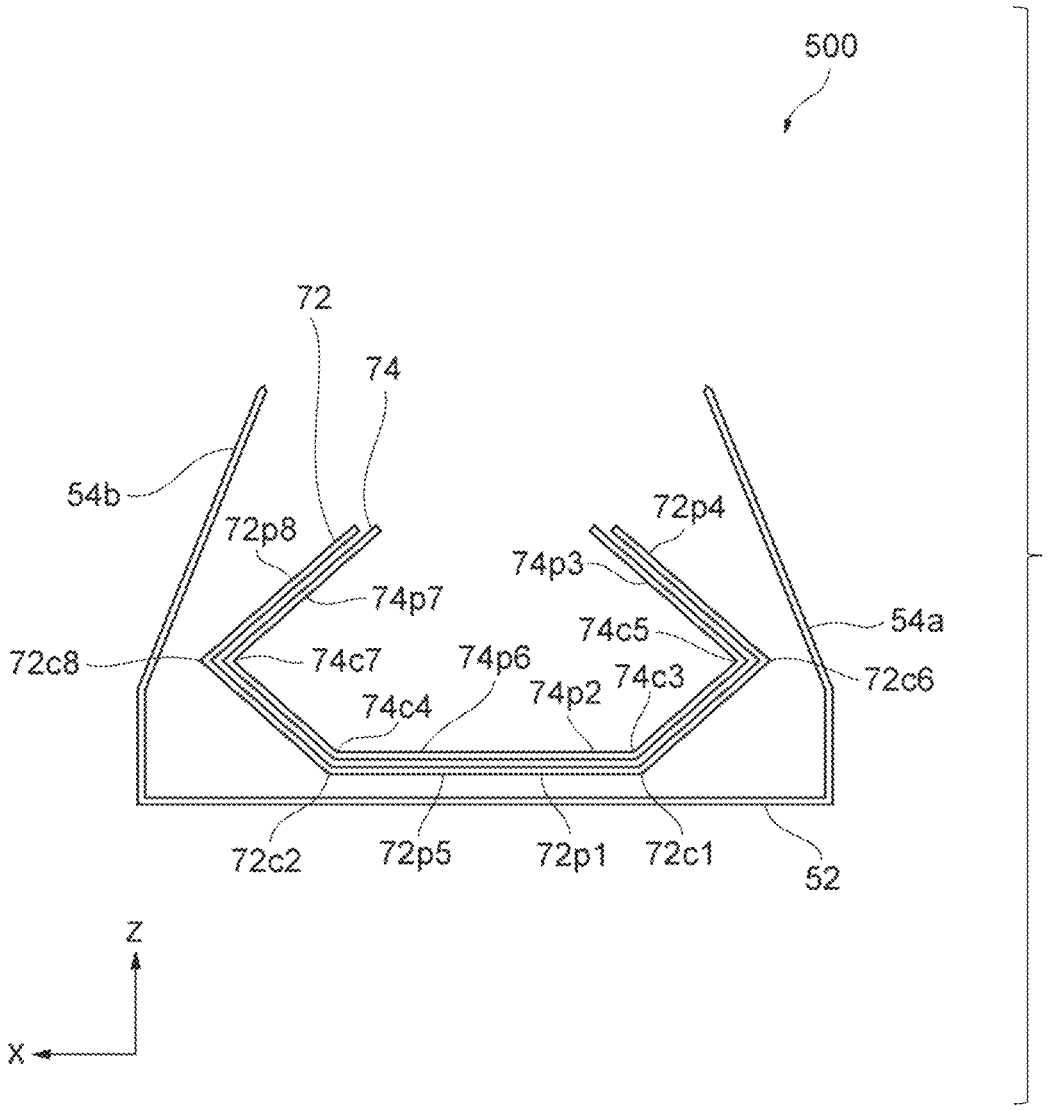
FIG. 30A is a schematic sectional view illustrating an example of a binding article 500 according to the present embodiment.
Figure 30B:
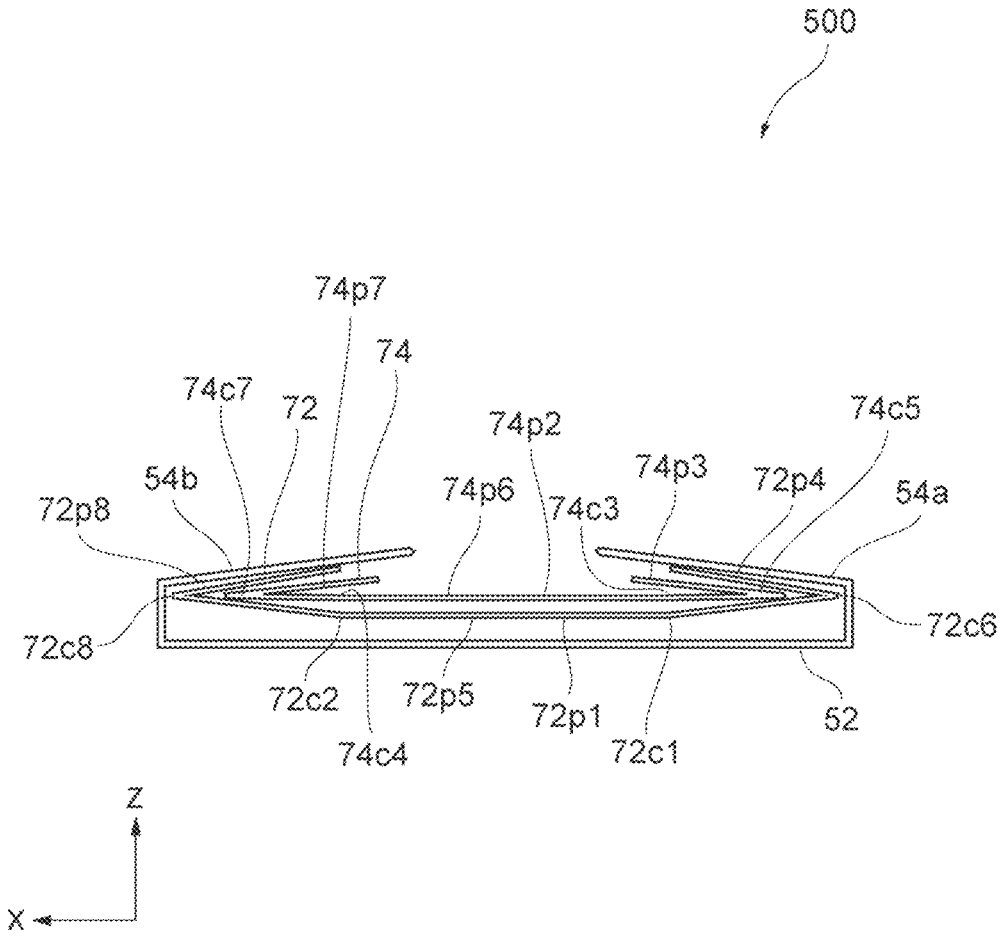
FIG. 30B is a schematic sectional view illustrating the example of the binding article 500 according to the present embodiment.

With reference to FIGS. 30A and 30B, a binding article 500 including the tape 70 clamped by the staple 50 by the tape clamping method according to the embodiment described above will be described. FIG. 30A is a schematic sectional view illustrating an example of the binding article 500 according to the present embodiment. FIG. 30A is a schematic sectional view perpendicular to the Y direction of the staple 50 and the tape 70 of the binding article 500 when being folded. FIG. 30B is a schematic sectional view perpendicular to the Y direction of the binding article 500 including the tape 70 clamped by the folded staple 50.

As illustrated in FIGS. 30A and 30B, the binding article 500 according to the present embodiment includes the tape 70 in a band shape that surrounds the object to be bound 60 and the staple 50 provided at the part where the first end 72 of the tape 70 and the second end 74 of the tape 70 are overlapped. The staple 50 includes the crown 52, the first leg 54*a* connected to one end of the crown 52 and having the top end thereof bent in the direction of approaching the crown 52, and the second leg 54*b* connected to the other end of the crown 52 and having the top end thereof bent in the direction of approaching the crown 52. That is, the binding article 500 according to the present embodiment is a binding article in which the overlapped part (part where the first end 72 and the second end 74 are overlapped) of the band-shaped tape 70 surrounding the object to be bound 60 is clamped by the staple 50, and the overlapped part of the tape 70 is clamped by the staple 50 in a state of being folded back in the lateral direction (X direction) of the tape 70.

As illustrated in FIGS. 30A and 30B, in the binding article 500 according to the present embodiment, the overlapped part of the tape 70 is clamped by the staple 50 in a state of being folded in the lateral direction (X direction) such that a fold extending in the longitudinal direction (Y direction) of the tape 70 is formed. As described above, the staple 50 includes the crown 52 and the pair of legs (first leg 54*a* second leg 54*b*) respectively connected to two ends of the crown 52, and the overlapped part of the tape 70 is clamped by the crown 52 and the pair of legs (first leg 54*a*, second leg 54*b*) in the state of being folded in the lateral direction (X direction).

The first leg 54*a* and the crown 52 of the staple 50 clamp a first fold part 72*p*1 of the first end 72 of the tape 70, a second fold part 74*p*2 of the second end 74 of the tape 70 stacked on the first fold part 72*p*1 (stacked in the Z direction), a third fold part 74*p*3 of the second end 74 of the tape 70 stacked on the second fold part 74*p*2 (stacked in the Z direction) when the second end 74 is folded along the longitudinal direction (Y direction) of the tape 70, and a fourth fold part 72*p*4 of the first end 72 stacked on the third fold part 74*p*3 (stacked in the Z direction) when the first end 72 of the tape 70 is folded along the longitudinal direction of the tape 70.

The second leg 54*b* and the crown 52 of the staple 50 clamp a fifth fold part 72*p*5 of the first end 72 of the tape 70, a sixth fold part 74*p*6 of the second end 74 of the tape 70 stacked on the fifth fold part 72*p*5 (stacked in the Z direction), a seventh fold part 74*p*7 of the second end 74 stacked on the sixth fold part 74*p*6 (stacked in the Z direction) when the second end 74 of the tape 70 is folded along the longitudinal direction of the tape 70 (Y direction in FIGS. 30A and 30B), and an eighth fold part 72*p*8 of the first end 72 stacked on the seventh fold part 74*p*7 (stacked in the Z direction) when the first end 72 is folded along the longitudinal direction of the tape 70 (Y direction).

In the first end 72 of the tape 70, a plurality of folds are formed in the longitudinal direction of the tape 70 between the first fold part 72*p*1 and the fourth fold part 72*p*4 and between the fifth fold part 72*p*5 and the eighth fold part 72*p*8. In the second end 74, a plurality of folds are formed in the longitudinal direction (Y direction) of the tape 70 between the second fold part 74*p*2 and the third fold part 74*p*3 and between the sixth fold part 74*p*6 and the seventh fold part 74*p*7.

The plurality of folds formed in the first end 72 include a first fold 72*c*1 formed on a first fold part 72*p*1 side between the first fold part 72*p*1 and the fourth fold part 72*p*4, a second fold 72*c*2 formed on a fifth fold part 72*p*5 side between the fifth fold part 72*p*5 and the eighth fold part 72*p*8, a sixth fold 72*c*6 formed on a fourth fold part 72*p*4 side between the first fold part 72*p*1 and the fourth fold part 72*p*4, and an eighth fold 72*c*8 formed on an eighth fold part 72*p*8 side between the fifth fold part 72*p*5 and the eighth fold part 72*p*8. The plurality of folds of the second end 74 include a third fold 74*c*3 formed on a second fold part 74*p*2 side between the second fold part 74*p*2 and the third fold part 74*p*3, a fourth fold 74*c*4 formed on a sixth fold part 74*p*6 side between the sixth fold part 74*p*6 and the seventh fold part 74*p*7, a fifth fold 74*c*5 formed on a third fold part 74*p*3 side between the second fold part 74*p*2 and the third fold part 74*p*3, and a seventh fold 74*c*7 formed on a seventh fold part 74*p*7 side between the sixth fold part 74*p*6 and the seventh fold part 74*p*7.

As illustrated in FIGS. 30A and 30B, the first fold 72*c*1 and the third fold 74*c*3 are formed in positions overlapping each other (positions overlapping each other in the Z direction). The second fold 72*c*2 and the fourth fold 74*c*4 are formed in positions overlapping each other (positions overlapping each other in the Z direction). The fifth fold 74*c*5 and the sixth fold 72*c*6 are formed in positions overlapping each other (positions overlapping each other in the X direction). The seventh fold 74*c*7 and the eighth fold 72*c*8 are formed in positions overlapping each other (positions overlapping each other in the X direction).

As described above with reference to FIG. 27A, the tape 70 is pressed into the opening 245*c* by the tape folder 400 in the state in which the first end 72 and the second end 74 are overlapped, so that two folds (folds extending in the Y direction) are formed in each of the first end 72 and the second end 74 in a sectional view perpendicular to the Y direction. Among the folds formed in the tape 70 in the state illustrated in FIG. 27A, the folds formed in the first end 72 correspond to the first fold 72*c*1 and the second fold 72*c*2 illustrated in FIG. 30A. Among the folds formed in the tape 70 in the state illustrated in FIG. 27A, the folds formed in the second end 74 correspond to the third fold 74*c*3 and the fourth fold 74*c*4 illustrated in FIG. 30A.

In the state in which the staple 50 is bent by the clincher 232 and the driver 242 and clinching is performed as described above with reference to FIG. 28, folds are formed in the −Y direction and the +Y direction by folding the tape 70 illustrated in FIG. 27A. The state illustrated in FIG. 28 corresponds to the state illustrated in FIG. 30A, and among the folds further formed in the tape 70 in this state, the folds formed in the first end 72 correspond to the sixth fold 72*c*6 and the eighth fold 72*c*8 illustrated in FIG. 30A. Among the folds further formed in the tape 70 in this state, the folds formed in the second end 74 correspond to the fifth fold 74*c*5 and the seventh fold 74*c*7 illustrated in FIG. 30A.

The above embodiment describes an example in which the tape 70 is clamped using the staple 50 including the pair of legs (first leg 54*a*, second leg 54*b*). Alternatively, the present disclosure is not limited thereto, and for example, the tape 70 may be clamped using a staple including only one leg. The staple including only one leg can also achieve the same effects such as enhancing the binding strength.

The above embodiment describes an example in which the tape 70 is pressed in the −Z direction on the front side (+Y direction side) and the rear side (−Y direction side) in the Y direction (longitudinal direction of the tape 70) respectively by the first folder 412 and the second folder 414. Alternatively, the present disclosure is not limited thereto, and the tape 70 may be pressed by one of the first folder 412 and the second folder 414.

The present embodiment is described above with reference to specific examples. However, the present disclosure is not limited to these specific examples. Design changes made by those skilled in the art as appropriate to these specific examples are also included within the scope of the present disclosure as long as the changes have characteristics of the present disclosure. Elements, arrangements, conditions, shapes, and the like included in the specific examples described above are not limited to those illustrated, and can be appropriately changed. The elements included in the specific examples described above can be appropriately changed in combination as long as technical contradiction does not occur.

Appendix 1

A tape clamping method for clamping a band-shaped tape surrounding an object to be bound with a staple, the method including:

overlapping a first end that is one end of the tape and a second end that is another end of the tape; and clamping the tape by deforming the staple in a manner of clamping an overlapped part of the first end and the second end from an outer side of at least one of a pair of side edges of the tape.

Appendix 2

The tape clamping method according to appendix 1, in which the tape is clamped by deforming the staple in a manner of clamping the overlapped part of the first end and the second end from the outer side of the one of the side edges in a lateral direction of the tape.

Appendix 3

The tape clamping method according to appendix 1, in which the staple includes a crown and a first leg whose one end is connected to the crown, and the tape is clamped by deforming the staple in a manner of clamping the overlapped part of the first end and the second end between the crown and the first leg.

Appendix 4

The tape clamping method according to appendix 1 or 3, in which the staple includes a second leg connected to another end of the crown, and the tape is clamped by deforming the staple in a manner of bending the first leg in a direction toward the crown and bending the second leg in a direction toward the crown.

Appendix 5

The tape clamping method according to appendix 4, in which the first end and the second end are located between the first leg and the second leg while being folded in a direction in which the pair of side edges in a lateral direction of the tape face each other.

Appendix 6

The tape clamping method according to appendix 3, in which the tape is clamped by folding a part of the overlapped part of the first end and the second end in a lateral direction of the tape by the first leg in a manner of forming a fold extending in a longitudinal direction of the tape.

Appendix 7

A binding machine configured to clamp a band-shaped tape surrounding an object to be bound with a staple by clamping the tape with the staple, the binding machine including:

a tape overlapping portion configured to overlap a first end that is one end of the tape and a second end that is another end of the tape; and a binding portion configured to clamp the tape by deforming the staple in a manner of clamping an overlapped part of the first end and the second end from an outer side of at least one of a pair of side edges of the tape.

Appendix 8

The binding machine according to appendix 7, in which the binding portion is configured to clamp the tape by deforming the staple in a manner of clamping the overlapped part of the first end and the second end from the outer side of the one of the side edges in a lateral direction of the tape.

Appendix 9

The binding machine according to appendix 7, in which the staple includes a crown and a first leg whose one end is connected to the crown, and the binding portion is configured to clamp the tape by deforming the staple in a manner of clamping the overlapped part of the first end and the second end between the crown and the first leg.

Appendix 10

The binding machine according to appendix 9, in which the staple includes a second leg connected to another end of the crown, and the binding portion is configured to clamp the tape in a manner of bending the first leg in a direction toward the crown and bending the second leg in a direction toward the crown.

Appendix 11

The binding machine according to appendix 10, further including:

a tape folder configured to locate the first end and the second end between the first leg and the second leg while folding the first end and the second end in a direction in which the pair of side edges in a lateral direction of the tape face each other.

Appendix 12

The binding machine according to appendix 11, in which the binding portion includes a staple driver configured to drive the staple, and the tape folder is configured to fold the tape by pressing one or another one of the first end and the second end against the staple driver in a longitudinal direction of the tape.

Appendix 13

The binding machine according to appendix 12, in which the binding portion includes a tape abutment configured to support the tape, and the tape abutment is provided in a position facing the staple driver and has an opening into which the tape folder is capable of being inserted.

Appendix 14

The binding machine according to appendix 13, in which the opening has a width in an extending direction of the crown smaller than a width of the tape.

Appendix 15

The binding machine according to any one of appendixes 11 to 14, in which the binding portion includes a staple driver configured to drive the staple and a bender configured to bend the staple driven by the staple driver, and the tape folder is movable relative to the bender and is urged in a direction toward the staple driver.

Appendix 16

The binding machine according to appendix 9, in which the binding portion includes a bender configured to bend the staple, the bender includes a recess configured to restrict movement of the first leg when being folded, and the recess is provided such that a top end of the first leg follows a curved surface of the recess when the staple is folded.

Appendix 17

The binding machine according to appendix 10, in which the binding portion includes a bender configured to bend the staple, the bender includes a first recess configured to restrict movement of the first leg when being folded, and a second recess configured to restrict movement of the second leg when being folded, the first recess is provided such that a top end of the first leg follows a curved surface of the first recess when the staple is folded, and the second recess is provided such that a top end of the second leg follows a curved surface of the second recess when the staple is folded.

Appendix 18

A binding article in which an overlapped part of a band-shaped tape is clamped by a staple while the tape is used, the tape configured to surround an object to be bound, in which the overlapped part of the tape is clamped by the staple in a state of being folded back in a lateral direction of the tape.

Appendix 19

The binding article according to appendix 18, in which the overlapped part is clamped by the staple in a state of being folded in the lateral direction in a manner of forming a fold extending in a longitudinal direction of the tape.

Appendix 20

The binding article according to appendix 18 or 19, in which the staple includes a crown and a pair of legs connected to two ends of the crown, and the overlapped part is clamped between the crown and the pair of legs in a state of being folded in the lateral direction.

What is claimed is:

1. A binding machine configured to clamp a band-shaped tape surrounding an object to be bound with a staple by clamping the tape with the staple, wherein the staple includes a crown, a first leg whose one end is connected to the crown, and a second leg connected to another end of the crown, the binding machine comprising:

a tape overlapping portion configured to overlap a first end that is one end of the tape and a second end that is another end of the tape;

a binding portion configured to clamp the tape by deforming the staple in a manner of clamping an overlapped part of the first end and the second end from an outer side of at least one of a pair of side edges of the tape; and a tape folder configured to locate the first end and the second end between the first leg and the second leg while folding the first end and the second end in a direction in which the pair of side edges in a lateral direction of the tape face each other, wherein:

the binding portion is configured to clamp the tape by deforming the staple in a manner of clamping the overlapped part of the first end and the second end between the crown and the first leg, and bending the first leg in a direction toward the crown and bending the second leg in a direction toward the crown.

2. The binding machine according to claim 1, wherein the binding portion is configured to clamp the tape by deforming the staple in a manner of clamping the overlapped part of the first end and the second end from the outer side of the at least one of the side edges in a lateral direction of the tape.

3. The binding machine according to claim 1, wherein the binding portion includes a staple driver configured to drive the staple, and the tape folder is configured to fold the tape by pressing one or another one of the first end and the second end against the staple driver in a longitudinal direction of the tape.

4. The binding machine according to claim 3, wherein the binding portion includes a tape abutment configured to support the tape, and the tape abutment is provided in a position facing the staple driver and has an opening into which the tape folder is capable of being inserted.

5. The binding machine according to claim 4, wherein the opening has a width in an extending direction of the crown smaller than a width of the tape.

6. The binding machine according to claim 1, wherein the binding portion includes a staple driver configured to drive the staple and a bender configured to bend the staple driven by the staple driver, and the tape folder is movable relative to the bender and is urged in a direction toward the staple driver.

7. The binding machine according to claim 1, wherein the binding portion includes a bender configured to bend the staple, the bender includes a recess configured to restrict movement of the first leg when being folded, and the recess is provided such that a top end of the first leg follows a curved surface of the recess when the staple is folded.

8. The binding machine according to claim 1, wherein the binding portion includes a bender configured to bend the staple, the bender includes a first recess configured to restrict movement of the first leg when being folded, and a second recess configured to restrict movement of the second leg when being folded, the first recess is provided such that a top end of the first leg follows a curved surface of the first recess when the staple is folded, and the second recess is provided such that a top end of the second leg follows a curved surface of the second recess when the staple is folded.

* * * * *